US011469535B1

(12) United States Patent
Satyanarayanan et al.

(10) Patent No.: US 11,469,535 B1
(45) Date of Patent: Oct. 11, 2022

(54) AUTOMATION COMPATIBLE SPRING ASSISTED SINGLE PART TAMPER RESISTANT SHUTTER MECHANISM FOR WIRING DEVICE PRODUCT

(71) Applicant: EATON INTELLIGENT POWER LIMITED, Dublin (IE)

(72) Inventors: Karthik Satyanarayanan, Vellore (IN); Erik Jeffrey Gouhl, Fayetteville, GA (US); Raj Karpe, Ahmednagar (IN); Fengguo Zhang, Shanghai Pudong (CN); Nilesh Sawai, Pune (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 17/224,636

(22) Filed: Apr. 7, 2021

(51) Int. Cl.

| | |
|---|---|
| ***H01R 13/453*** | (2006.01) |
| *H01R 103/00* | (2006.01) |
| *H01R 24/76* | (2011.01) |
| *H01R 25/00* | (2006.01) |

(52) U.S. Cl.
CPC ..... *H01R 13/4534* (2013.01); *H01R 13/4532* (2013.01); *H01R 24/76* (2013.01); *H01R 25/006* (2013.01); *H01R 2103/00* (2013.01)

(58) Field of Classification Search
CPC ..... H01R 13/4534; H01R 13/4532; H01R 13/453; H01R 13/447; H01R 13/44; H01R 24/76; H01R 25/006; H01R 2103/00
USPC ..... 439/138
See application file for complete search history.

(56) References Cited

U.S. PATENT DOCUMENTS

| | | | | |
|---|---|---|---|---|
| 4,722,693 | A | 2/1988 | Rose | |
| 5,020,997 | A * | 6/1991 | Calderara | H01R 13/4534 439/139 |
| 6,555,771 | B2 * | 4/2003 | Shao | H01R 13/4534 200/51 R |
| 7,452,221 | B1 * | 11/2008 | Oddsen | H01R 13/4534 439/140 |
| 7,833,030 | B1 * | 11/2010 | Huang | H01R 13/4534 439/137 |
| 7,934,935 | B1 * | 5/2011 | Gao | H01R 13/4534 439/137 |
| 8,562,362 | B2 | 10/2013 | Jiang et al. | |
| 9,059,529 | B1 | 6/2015 | Lai | |
| 9,196,995 | B2 * | 11/2015 | Scanzillo | H01R 13/453 |
| 9,735,493 | B2 * | 8/2017 | Lin | H01R 13/4534 |
| 10,141,674 | B2 * | 11/2018 | Scanzillo | H01R 13/4536 |

(Continued)

*Primary Examiner* — Harshad C Patel
(74) *Attorney, Agent, or Firm* — Eckert Seamans Cherin & Mellott, LLC

(57) ABSTRACT

A shutter assembly for a tamper-resistant electrical receptacle includes a shutter, a base clip, and a spring. The shutter is coupled at one end by the spring to the rear side of an individual outlet cover of the electrical receptacle, and two multi-sloped blocking mechanisms of the shutter block access to the live electrical terminals from the hot and neutral slots of the outlet cover when a plug is not inserted into the outlet. The shutter comprises a fulcrum that rests on the base clip, which allows one end of the shutter to interlock with divots formed in the rear side of the outlet cover and the other end of the shutter to interlock with the base clip in order to prevent access to the live electrical terminals when an object is inserted into only one of the hot or neutral slots of the individual outlet cover, or when an object is inserted into the outlet cover at a tilted angle.

19 Claims, 33 Drawing Sheets

(56) References Cited

U.S. PATENT DOCUMENTS

| | | | | |
|---|---|---|---|---|
| 10,424,863 | B1 * | 9/2019 | Zhuang | H01R 13/4532 |
| 10,958,009 | B2 * | 3/2021 | Mozdzer | H01R 13/4534 |

* cited by examiner

AUTOMATION COMPATIBLE SPRING ASSISTED SINGLE PART TAMPER RESISTANT SHUTTER MECHANISM FOR WIRING DEVICE PRODUCT

BACKGROUND

Field

The disclosed concept relates generally to electrical sockets and in particular, to devices for preventing objects other than standardized plugs from accessing live electrical terminals through electrical sockets and to devices for preventing misalignment of electrical plug prongs during insertion of electrical plugs into electrical sockets.

Background Information

Electrical outlets enable devices and appliances with electrical plugs to connect to utility power sources in residential, commercial, and industrial settings. A utility customer site receives utility power from the electrical grid via a distribution line that is electrically connected to a main service panel at the customer site. The main service panel at the customer site includes a number of main circuit breakers (each of which is referred to hereinafter as a "site main breaker"), and conductors installed throughout the utility customer site are used to electrically connect electrical outlets to the site main breaker(s) either directly or via branch circuit breakers. Electrical outlets comprise a receptacle structured to receive the prongs of electrical plugs and are structured such that, when an electrical plug is inserted into an outlet, the plug prongs establish electrical contact with the conductors connecting the outlet to a site main breaker.

In many countries, the national and local electrical codes, such as the National Electrical Code (NEC) in the U.S., require three-pronged grounded electrical receptacles to be installed rather than two-pronged ungrounded receptacles. The three-pronged electrical receptacle rated for use with utility power in the U.S. is the NEMA 5-15R receptacle (referred to hereinafter as a "NEMA electrical receptacle" or "NEMA receptacle"), which is characterized by two blade slots in a longitudinal orientation disposed side by side with a partially rounded slot spaced a short distance away from one end of the two blade slots. FIGS. 1A and 1B each show a typical electrical wall outlet that includes two such three-pronged NEMA electrical receptacles 1 fitted within a wall plate 2 or 2', and FIGS. 1C and 1D show the outlets with the wall plates 2, 2' removed. The outlets shown in FIGS. 1A and 1B function in the same manner, and the only difference between them is the style of cover used to cover the electrical circuitry underneath. The cover shown in FIGS. 1A and 1C comprised of a flat portion with two raised portions is known as a duplex cover 3, while the cover shown in FIGS. 1B and 1D comprised of a just one unitary flat portion is known as a decorator cover 3'.

In each electrical receptacle 1, one of the blade slots is a hot slot 4 and provides an electrical connection to a hot conductor of the site main circuit breaker, while the other blade slot is a neutral slot 6 and provides an electrical connection to a neutral conductor of the site main circuit breaker. The hot slot 4 is shorter than the neutral slot 6. When a device is plugged into an electrical receptacle 1, current flows from the hot conductor of the site main breaker through the device plug's hot blade inserted into the receptacle's hot slot 4, through the device circuit and out through the device plug's neutral blade inserted into the receptacle's neutral slot 6, back to the neutral conductor of the site main breaker, to complete a circuit. The rounded slot of each electrical receptacle 1 is a grounding slot 8 that provides a grounding path to prevent excessive current resulting from surge or overvoltage conditions from flowing through a plugged-in device by diverting the excess current to instead flow to ground, for example, via a connection to the bottom of the circuit breaker box.

NEMA 1-15P and NEMA 5-15P electrical plugs are rated for use with NEMA receptacles and include a hot blade prong and a neutral blade prong structured to be inserted into the hot slot 4 and the neutral slot 6 of electrical receptacles 1. In addition, NEMA electrical plugs rated for use with NEMA receptacles can either include or omit a grounding prong for insertion into the ground slot 8 of an electrical receptacle 1. NEMA 5-15P plugs include a grounding prong for insertion into the ground slot 8 of an electrical receptacle 1, while NEMA 1-15P plugs omit a grounding prong. FIG. 2A shows a NEMA 5-15P plug 10 (referred to hereinafter as a "three-pronged electrical plug" or "three-pronged plug") that includes a grounding prong 12 along with a hot prong 14 and neutral prong 16, and FIG. 2B shows a NEMA 1-15P plug 18 (referred to hereinafter as a "two-pronged electrical plug" or "two-pronged plug") that includes only a hot prong 20 and neutral prong 22 while omitting a grounding prong.

Behind the individual outlet cover of each receptacle 1, a shutter assembly can be installed between the outlet cover and the electrical terminals connecting the receptacle 1 to the site main breaker in order to prevent objects other than standard plug prongs from accessing the live electrical terminals. Electrical receptacles that include a shutter assembly are referred to as tamper-resistant and are desirable, for example, in areas likely to be accessible by children, in order to prevent a child who sticks a non-plug prong object into either of the hot or neutral blade slots 4, 6 of a receptacle 1 from accessing the live electrical terminals and creating an electrocution hazard. In fact, the NEC requires electrical receptacles installed in areas likely to be accessible by children to be tamper-resistant.

FIG. 3A shows a front view of a tamper-resistant electrical receptacle arrangement 40 comprising two individual outlets 41 along with a ground strap assembly 42, a hot terminal assembly 44, a neutral terminal assembly 46, an outlet housing 48 with a front cover 50 and individual outlet covers 52, and a number of shutter assemblies 54 coupled to the interior of the outlet housing 48 (in FIG. 3A, one individual outlet cover 52 is coupled to the front cover 50, obscuring one of the shutter assemblies 54 from view, while another individual outlet cover 52 is removed so that one of the shutter assemblies 54 can be viewed). FIG. 3B shows the electrical receptacle arrangement 40 with the front cover 50 removed such that two shutter assemblies 54 can be viewed, along with the ground strap assembly 42, hot terminal assembly 44, and neutral terminal assembly 46 that are all coupled to the bottom cover 56.

FIG. 3C, which shows an exploded view of the components of the electrical receptacle arrangement 40, shows that the hot terminal assembly 44 and neutral terminal assembly 46 are each comprised of a bracket and screws (unnumbered), the brackets and screws being produced from conductive material. The screws provide a coupling point to which the conductors run behind a building wall and coupled to the site main breaker can be fastened in order to electrically connect each of the hot and neutral terminal assemblies 44, 46 to its respective hot or neutral conductor counterpart of the site main breaker. Inserting the hot and neutral prongs of a NEMA plug such as plug 10 (shown in FIG. 2A) or plug 18 (shown in FIG. 2B) completely into the hot and neutral slots 58, 60 of an individual outlet cover 52 puts the hot prong into electrical contact with the bracket of the hot terminal assembly 44 and puts the neutral prong into electrical contact with the bracket of the neutral terminal assembly 46. Similarly, inserting the grounding prong of a three-pronged plug 10 completely into the grounding slot 61 of an individual outlet cover 52 puts the grounding prong 12 into electrical contact with the grounding strap 42.

Referring to FIGS. 4A and 4B, the shutter assembly 54 of each electrical receptacle arrangement 40 is comprised of two shutter arms 62, a shutter base 64, and a spring 66. Each of the shutter arms 62 comprises a grooved portion 68 and a slot 70 that allow the shutter arms 62 to be coupled to one another as shown in FIG. 4A, and shutter base 64 comprises a number of hooks 72, each of which snap fits over one of the shutter arms 62 in order to secure the shutter arms 62 to the shutter base 64. Each end of spring 66 fits onto a protrusion (not numbered) of one of the shutter arms 62 as shown. The shutter arms 62 are biased toward the positions shown in FIG. 4A, with spring 66 expanded. When the hot and neutral prongs of an electrical plug such as plugs 10 or 18 shown in FIGS. 2A and 2B are inserted into an individual outlet cover 62, the prongs push against the sloped portion 74 of each shutter arm 62 such that the spring 66 compresses and the sloped portion 74 of each shutter arm 62 is pushed closer toward the sloped portion 74 of the other shutter arm 62. When spring 66 compresses and each sloped portion 74 is pushed closer toward the other, openings 76 within shutter base 64 (which can be viewed more clearly in FIG. 4B) become exposed, enabling the hot and neutral prongs of the plug (prongs 4 and 6 or prongs 14 and 16) to make contact with the hot terminal assembly 44 and the neutral terminal assembly 46.

Both shutter arms 62 must move in order for the openings 76 within shutter base 64 to become exposed, i.e. if a non-standard plug object such as a pin is pushed through only one of the hot slot 58 or neutral slot 60 of an outlet cover 52 such that only one shutter arm 62 gets pushed toward the other, the lack of movement of the other shutter arm 62 prevents openings 76 within shutter base 64 from becoming exposed and accordingly prevents the object from moving through an opening 76 and coming into electrical contact with the underlying live electrical terminal. In order for shutter assembly 54 to function correctly in preventing non-standard plug objects from accessing the hot and neutral terminal assemblies 44, 46 each shutter arm 62 needs to be precisely positioned onto shutter base 64 so that the corresponding hook 72 can correctly snap fit onto the shutter arm 62 in order to couple the shutter arm 62 to the shutter base 64, the groove 68 and slot 70 of each shutter arm 62 need to be precisely aligned relative to the slot 70 and groove 68 of the other shutter arm 62 in order for the shutter arms 62 to be correctly coupled to another, and the spring 66 needs to be fit onto the protrusion of each shutter arm 62. While the shutter assembly 54 shown in FIGS. 3A-3E is only one specific iteration of a shutter assembly, it is representative of the number of components and alignment requirements of typical shutter assemblies.

A shutter assembly ensures that, in the event an object resembling a single plug prong is intentionally or unintentionally inserted into only one of the hot slot or the neutral slot of the receptacle (i.e. rather than both the hot slot and the neutral slot, as a standard electrical plug is), the object will not be able to access and electrically connect to the live power supply. Without a shutter assembly, if an object were able to electrically connect to only the hot conductor or only the neutral conductor of the power supply, the object could become a live conductor and present an electrocution hazard. Shutter assemblies are thus important for ensuring that electrical receptacles are as hazard-proof as possible. However, producing such shutter assemblies presents challenges, as shutter assemblies comprise several components, some of which are fairly minute in size, that require precise alignment for proper assembly. The quantity and relatively small size of the components required to produce a shutter assembly, as well as the alignment requirements, can complicate automation of the shutter manufacturing process, resulting in relatively high rejection rates during the automated production process and pronounced production inefficiencies.

There is thus room for improvement in devices for preventing objects other than standardized plugs from accessing live electrical terminals through electrical sockets and in devices for preventing misalignment of plug prongs during insertion of electrical plugs into electrical sockets.

SUMMARY

In accordance with one aspect of the disclosed concept, a tamper-resistant protection arrangement for an electrical receptacle comprises: a front cover; a number of individual outlet covers coupled to the front cover, and a shutter assembly coupled to the rear side of one of the number of individual outlet covers. Each of the individual outlet covers includes a front side and a rear side disposed opposite the front side, a spring coupling formation formed on the rear side of the individual outlet cover, a hot slot structured to receive a hot prong of an electrical plug, and a neutral slot structured to receive a neutral prong of an electrical plug. The shutter assembly comprises a shutter including a front side and a rear side disposed opposite the front side, a base clip including a front side and a rear side disposed opposite the front side, and a spring coupled at a first end to the spring mount of the shutter and coupled at a second end disposed opposite the first end to the spring coupling formation of the individual outlet cover. The shutter includes a spring mount formed at one end of the shutter, a first blocking mechanism formed with a plurality of sloped surfaces, a second blocking mechanism formed with a plurality of sloped surfaces, and a fulcrum formed on the rear side of the shutter. The base clip includes a main body with a hot opening structured to receive a hot prong of an electrical plug and a neutral opening structured to receive a neutral prong of an electrical plug. The fulcrum of the shutter is disposed upon the front side of the base clip such that, when no electrical plug is inserted into the protection arrangement, the first blocking mechanism blocks a hot path between the hot slot of the individual outlet cover and the hot opening of the base clip and the second blocking mechanism blocks a neutral path between the hot slot of the individual outlet cover and the hot opening of the base clip.

In accordance with another aspect of the disclosed concept, a tamper-resistant electrical receptacle comprises: a hot terminal structured to be connected to a utility power supply, a neutral terminal structured to be connected to a utility power supply, a grounding strap structured to divert current exceeding a predetermined threshold from flowing out of the electrical receptacle and a tamper-resistant protection arrangement. The tamper-resistant protection arrangement comprises: a front cover; a number of individual outlet covers coupled to the front cover, and a shutter assembly coupled to the rear side of one of the number of individual outlet covers. Each of the individual outlet covers includes a front side and a rear side disposed opposite the front side, a spring coupling formation formed on the rear side of the individual outlet cover, a hot slot structured to receive a hot prong of an electrical plug, and a neutral slot structured to receive a neutral prong of an electrical plug. The shutter assembly comprises a shutter including a front side and a rear side disposed opposite the front side, a base clip including a front side and a rear side disposed opposite the front side, and a spring coupled at a first end to the spring mount of the shutter and coupled at a second end disposed opposite the first end to the spring coupling formation of the individual outlet cover. The shutter includes a spring mount formed at one end of the shutter, a first blocking mechanism formed with a plurality of sloped surfaces, a second blocking mechanism formed with a plurality of sloped surfaces, and a fulcrum formed on the rear side of the shutter. The base clip includes a main body with a hot opening structured to receive a hot prong of an electrical plug and a neutral opening structured to receive a neutral prong of an electrical plug. The shutter assembly is disposed between the individual outlet cover and the hot terminal and the neutral terminal, and the hot opening of the base clip provides access to the hot terminal while the neutral opening of the base clip provides access to the neutral terminal. The fulcrum of the shutter is disposed upon the front side of the base clip such that, when no electrical plug is inserted into the protection arrangement, the first blocking mechanism blocks a hot path between the hot slot of the individual outlet cover and the hot opening of the base clip and the second blocking mechanism blocks a neutral path between the hot slot of the individual outlet cover and the hot opening of the base clip.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1A:
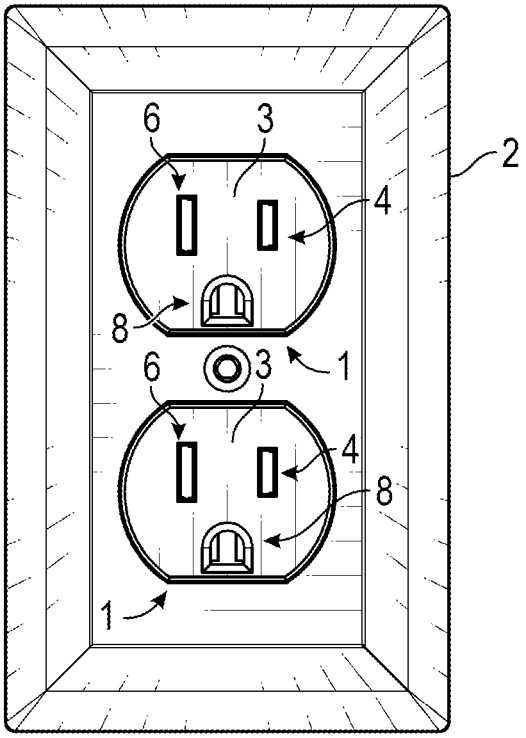
FIG. 1A (Prior Art)
FIG. 1A is a front elevation view of an electrical wall outlet including a pair of three-pronged NEMA 5-15R electrical receptacles covered with a duplex cover and fitted within a wall plate.
Figure 1B:
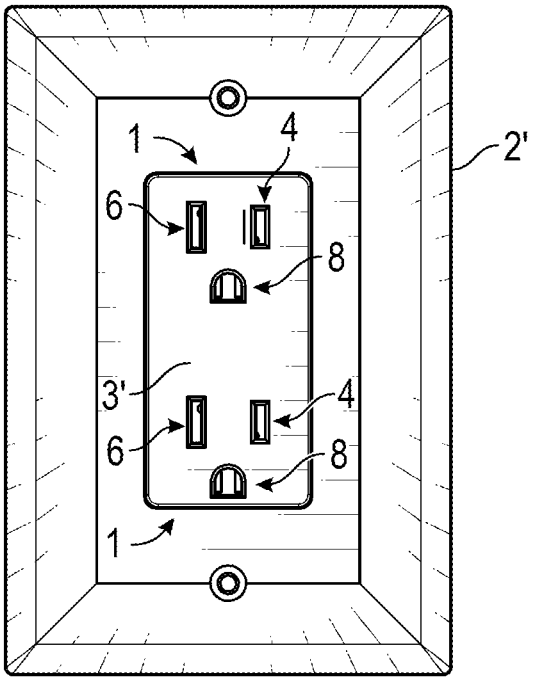
FIG. 1B (Prior Art)
FIG. 1B is a front elevation view of an electrical wall outlet including a pair of three-pronged NEMA 5-15R electrical receptacles covered with a decorator cover and fitted within a wall plate.

Directional phrases used herein, such as, for example, left, right, front, back, top, bottom and derivatives thereof, relate to the orientation of the elements shown in the drawings and are not limiting upon the claims unless expressly recited therein.

As used herein, the singular form of "a", "an", and "the" include plural references unless the context clearly dictates otherwise.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. As used herein, "movably coupled" means that two components are coupled so as to allow at least one of the components to move in a manner such that the orientation of the at least one component relative to the other component changes.

As employed herein, the term "number" shall mean one or an integer greater than one (i.e., a plurality).

Figure 1C:
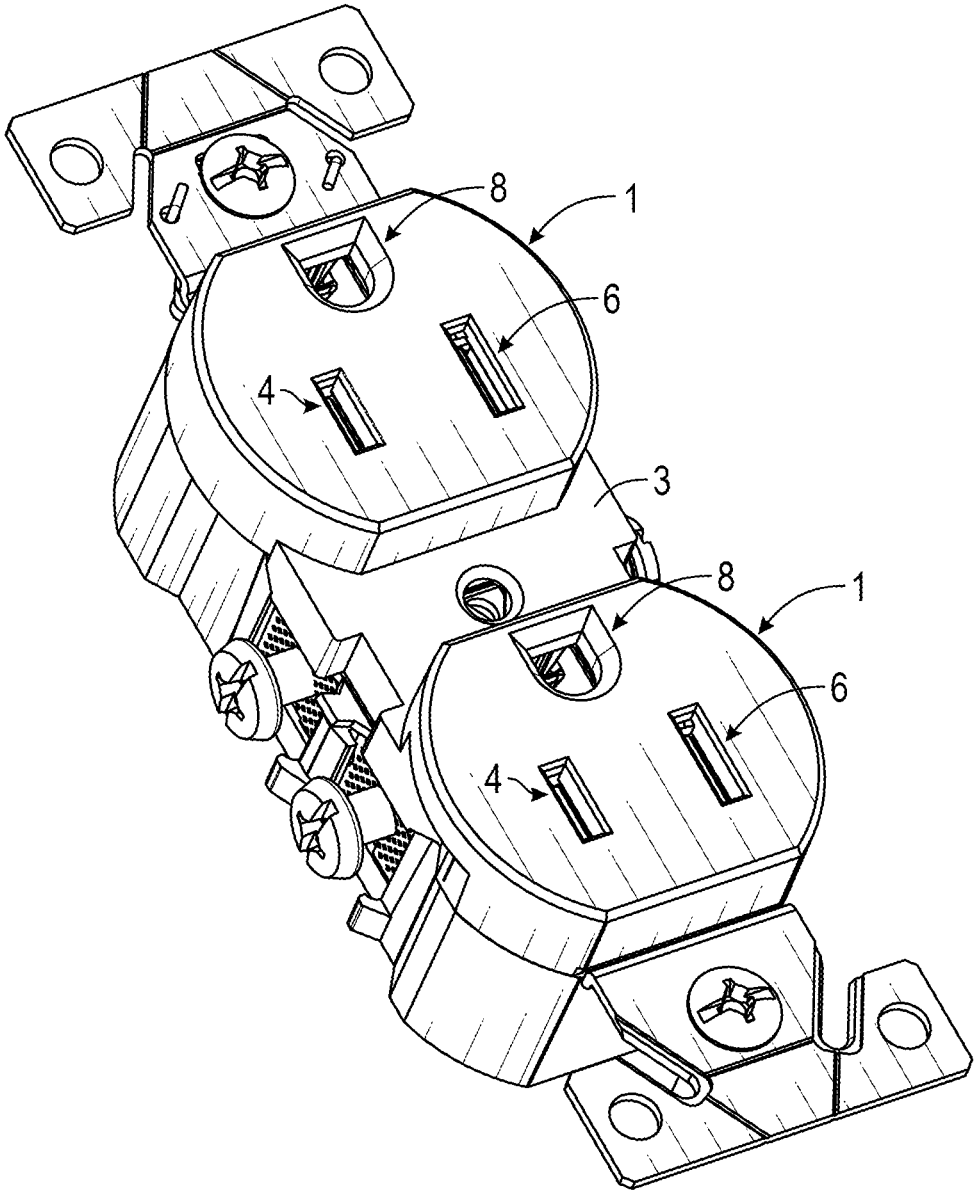
FIG. 1C (Prior Art)
FIG. 1C is an isometric view of the electrical receptacles shown in FIG. 1A with the wall plate removed.
Figure 1D:
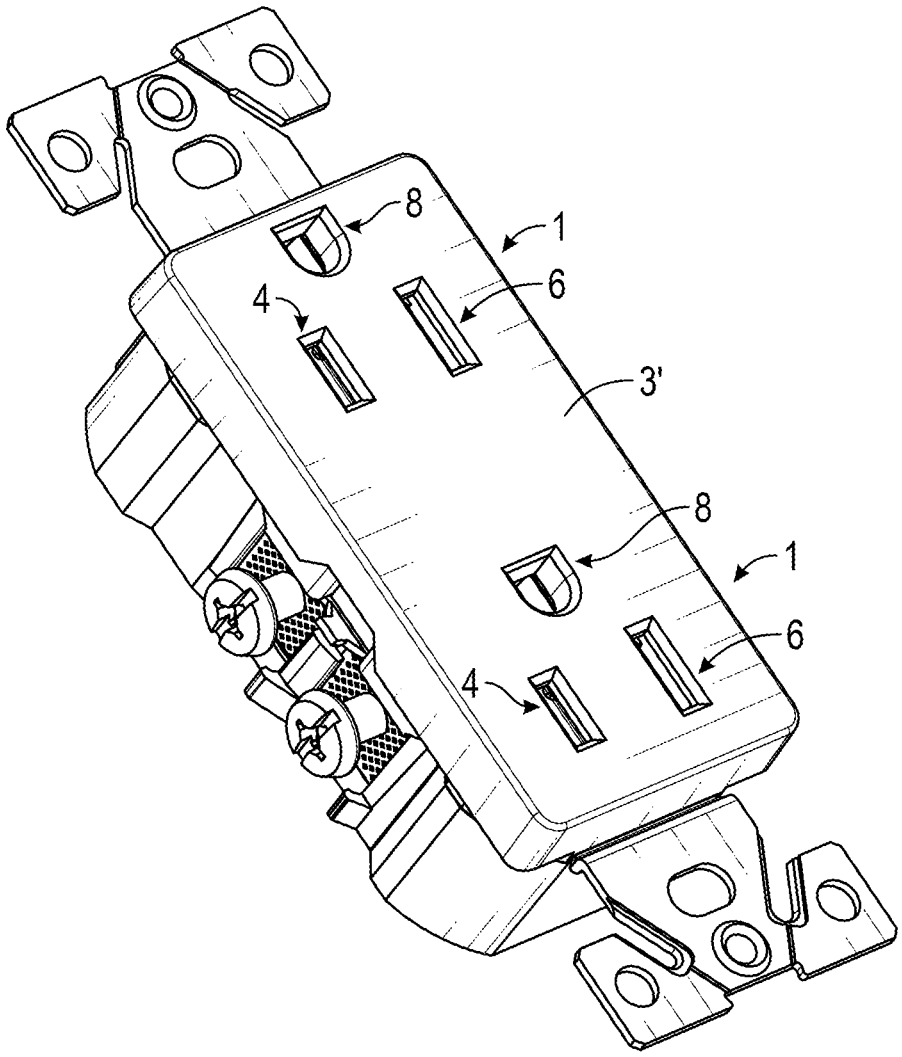
FIG. 1D (Prior Art)
FIG. 1D is an isometric view of the electrical receptacles shown in FIG. 1B with the wall plate removed.
Figure 3A:
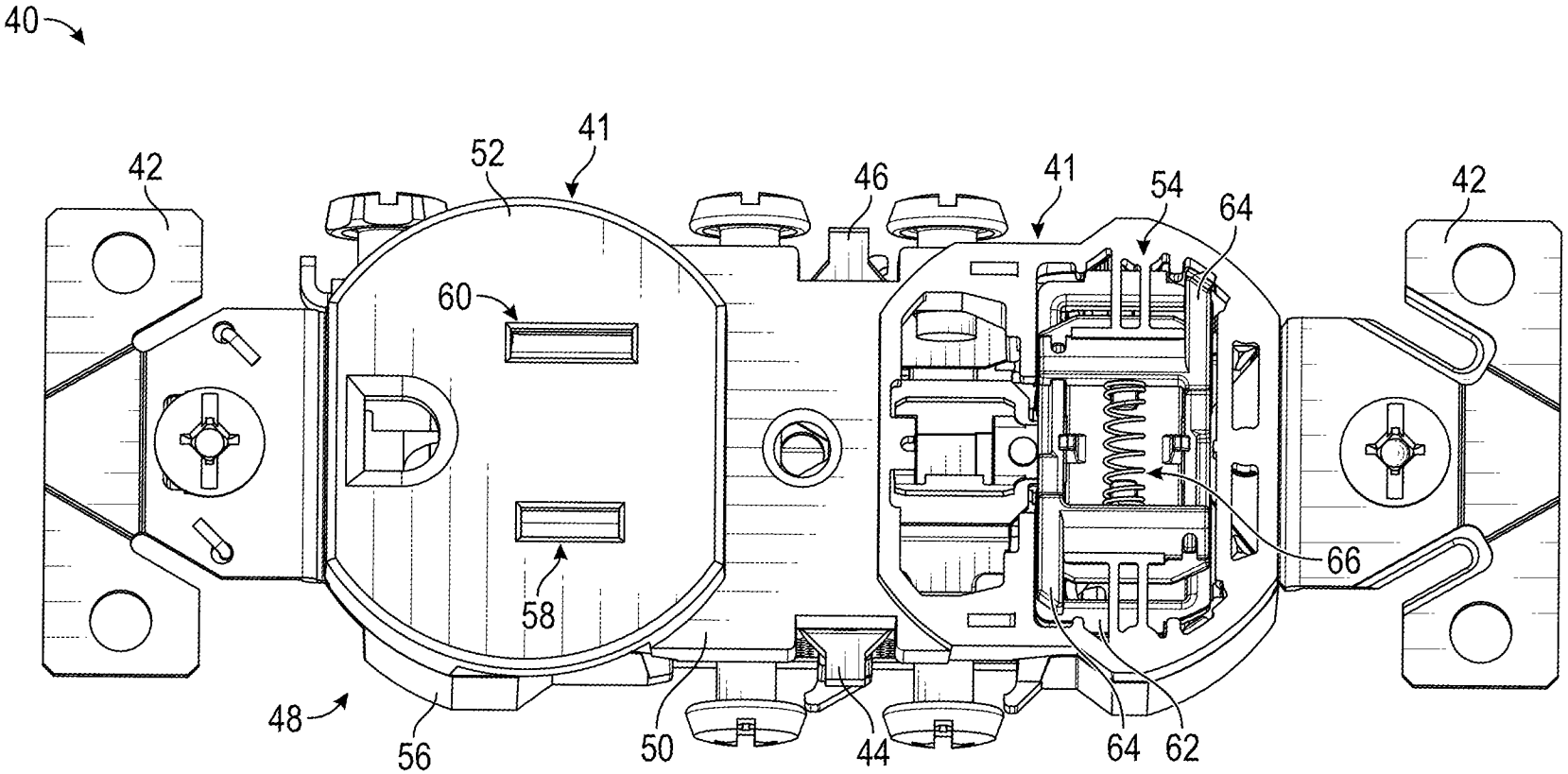
FIG. 3A (Prior Art)
FIG. 3A is a partial isometric view of a tamper-resistant NEMA 5-15R type electrical receptacle arrangement comprising two receptacles, with one individual outlet cover removed in order to show how the shutter assemblies and electrical terminals of the arrangement are coupled to the interior of the receptacle housing underneath the outlet covers.
Figure 3B:
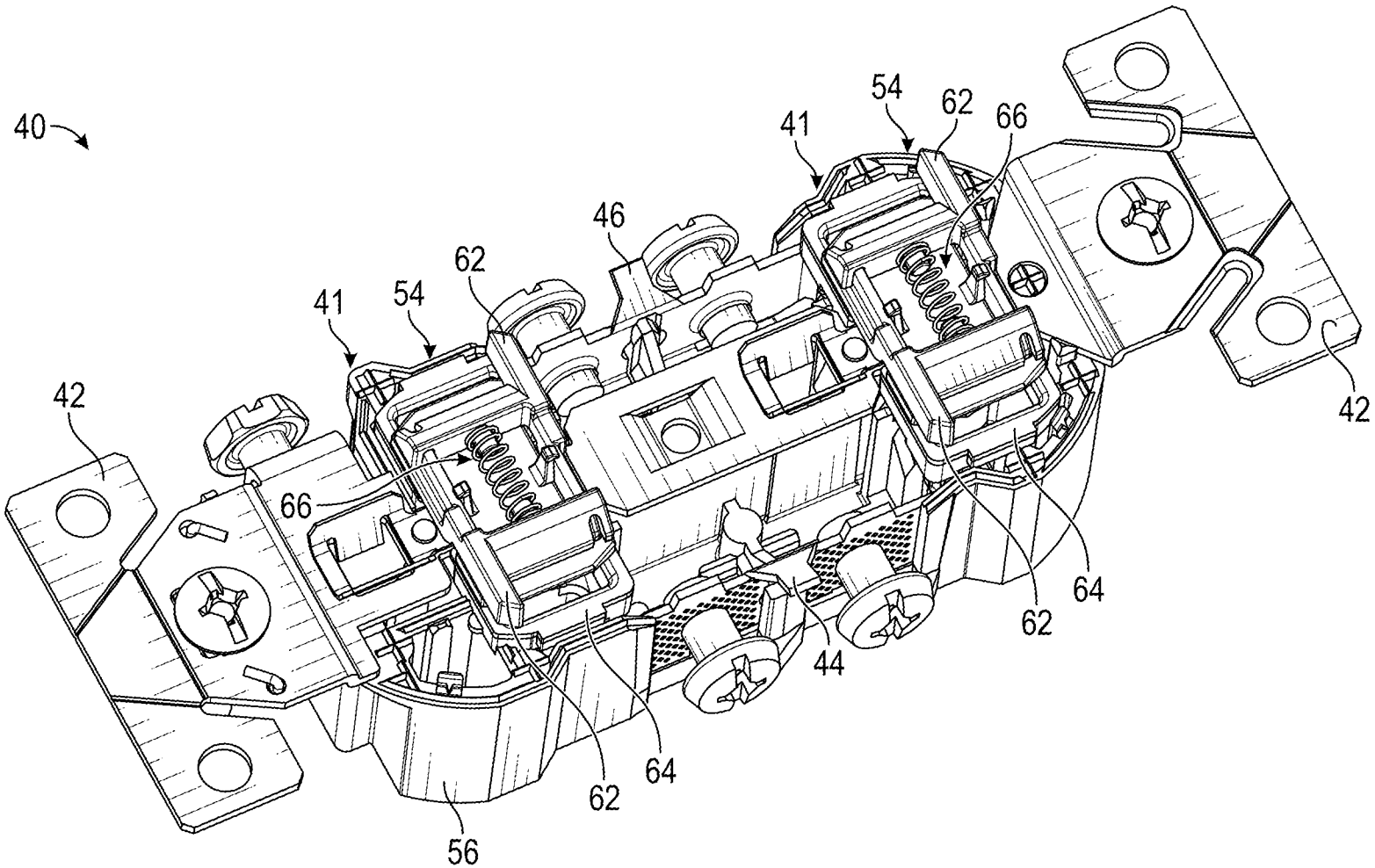
FIG. 3B (Prior Art)
FIG. 3B is an isometric view of the electrical receptacle arrangement shown in FIG. 3A with the outlet cover removed in order to show more details of the components coupled to the interior of the receptacle housing.
Figure 3C:
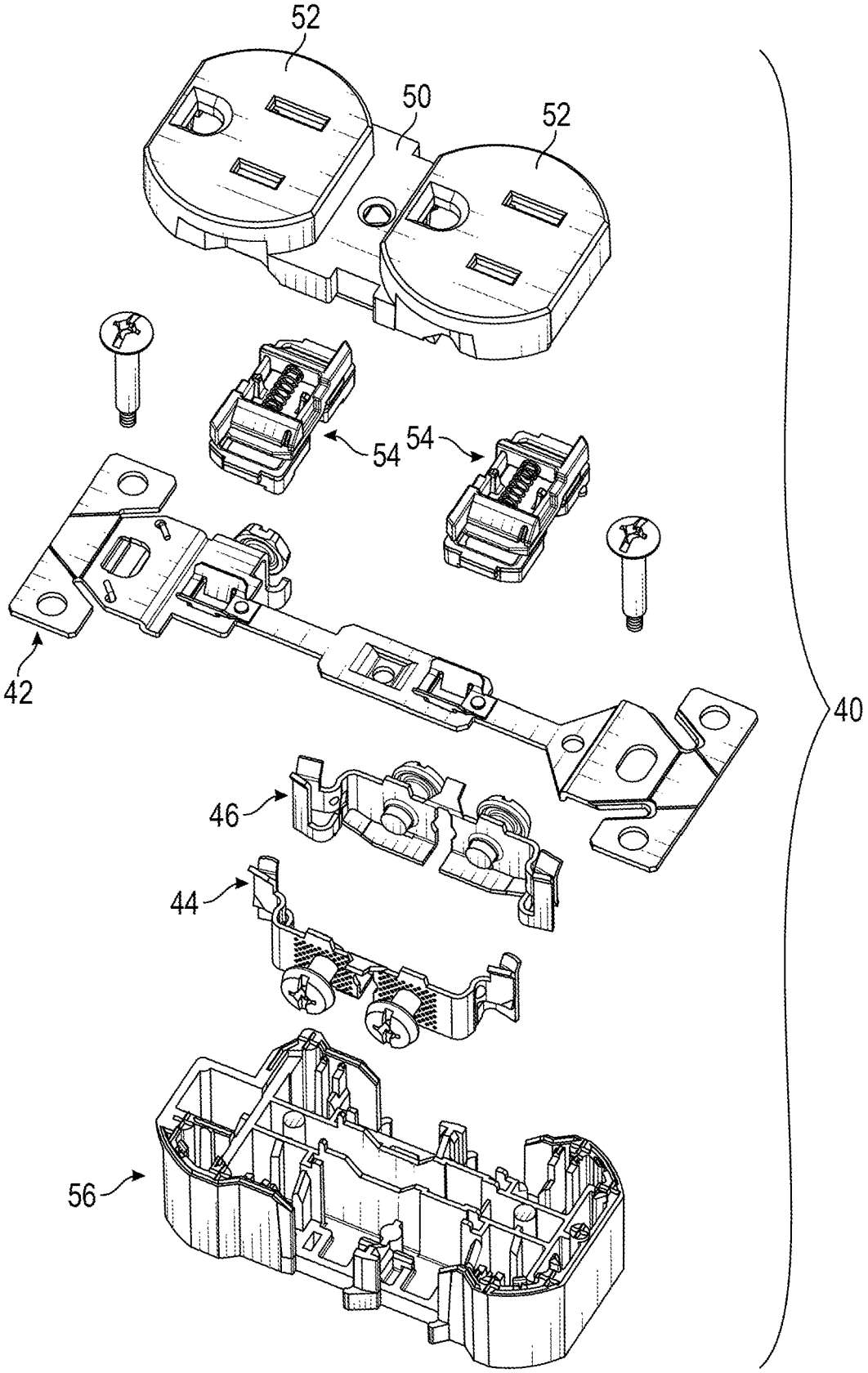
FIG. 3C (Prior Art)
FIG. 3C is an exploded isometric view of the electrical receptacle arrangement shown in FIG. 3A showing the individual components of the electrical receptacle arrangement.
Figure 3D:
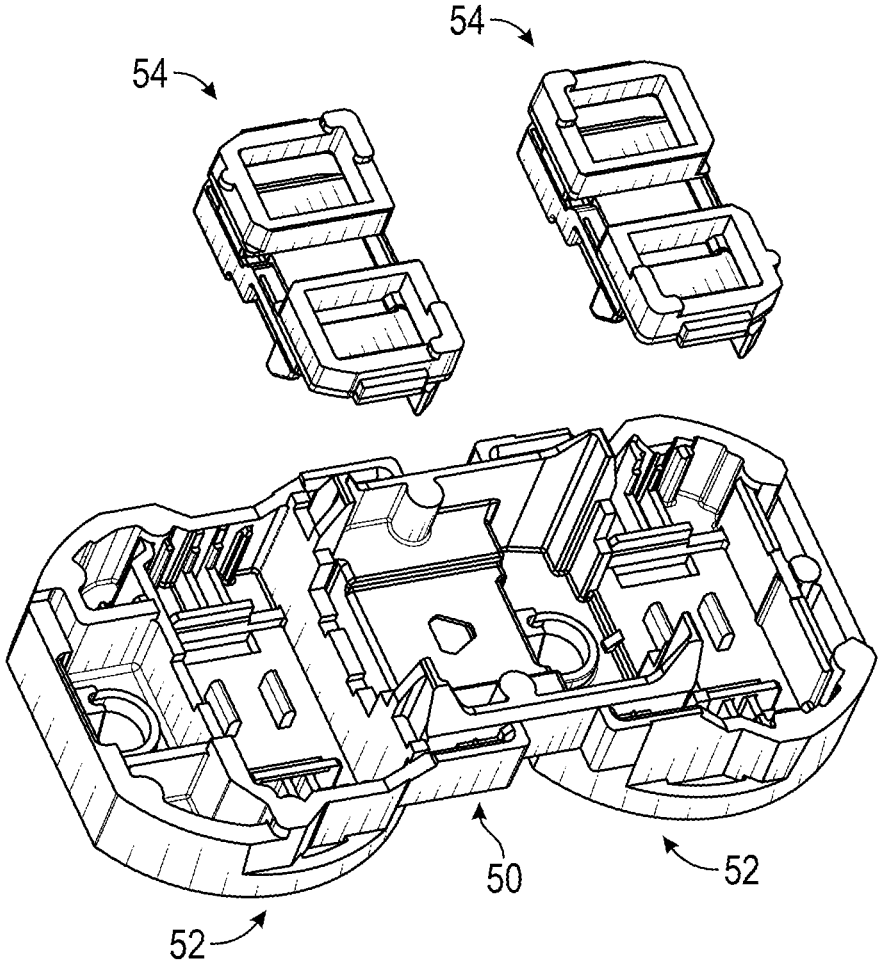
FIG. 3D (Prior Art)
FIG. 3D is a partial isometric exploded rear view of the front housing of the electrical receptacle arrangement shown in FIG. 3A showing the shutter assemblies positioned to be seated within the rear side of the individual outlet covers.
Figure 3E:
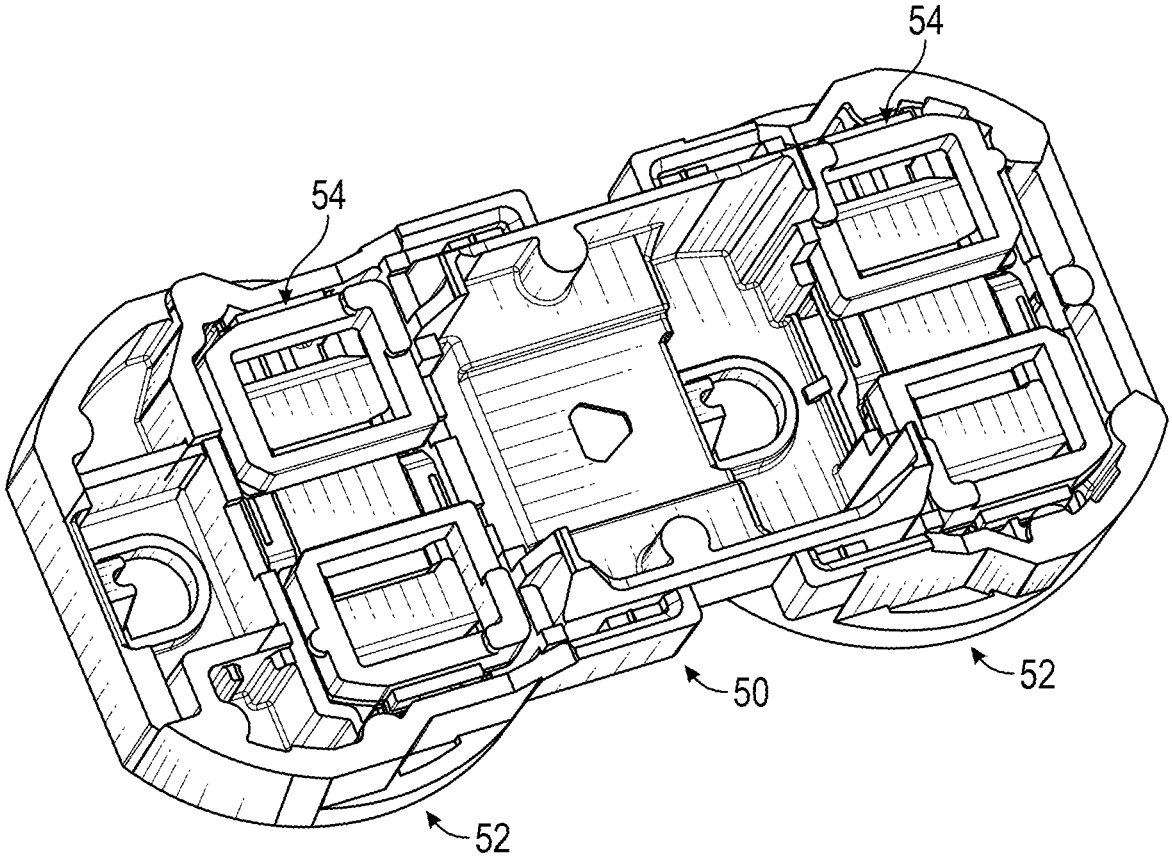
FIG. 3E (Prior Art)
FIG. 3E is a partial isometric view of the rear side of the front portion of the electrical receptacle arrangement shown in FIG. 3D showing how the shutter assemblies are seated within the rear side of the individual outlet covers.
Figure 5A:
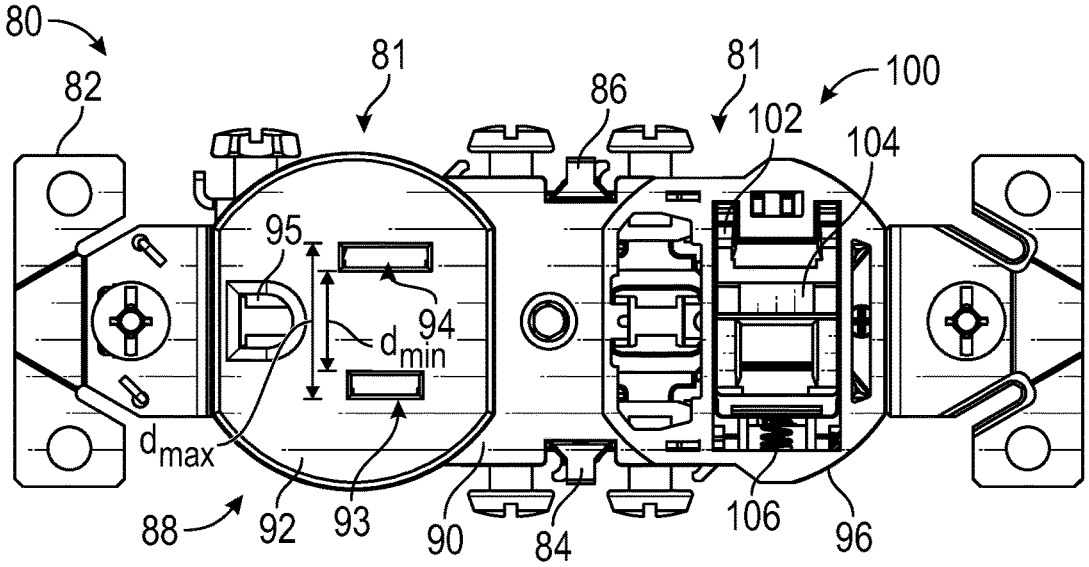
FIG. 5A is a partial isometric view of an electrical receptacle arrangement including two shutter assemblies produced in accordance with an exemplary embodiment of the disclosed concept, with one individual outlet cover removed in order to show how the shutter assemblies and electrical terminals of the arrangement are coupled to the interior of the receptacle housing underneath the outlet covers.
Figure 5B:
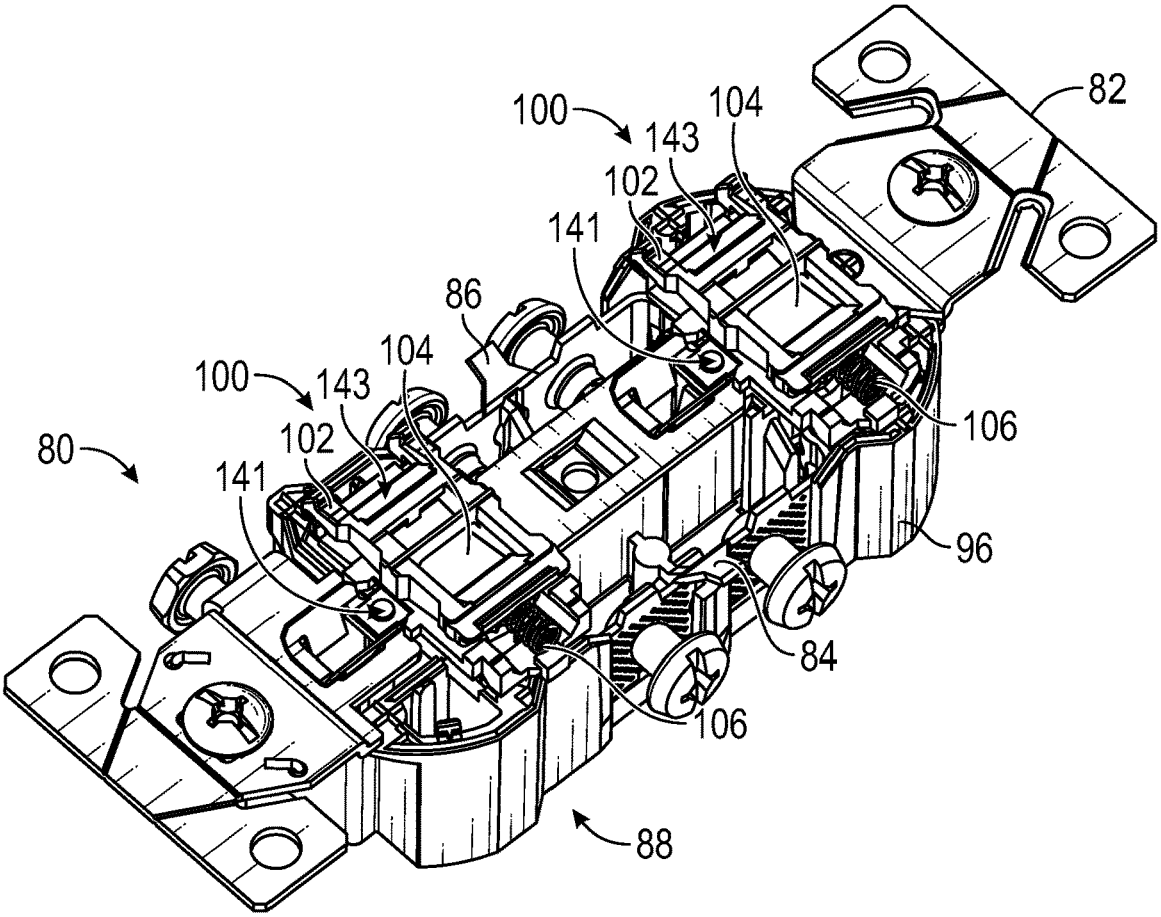
FIG. 5B is an isometric view of the electrical receptacle arrangement shown in FIG. 5A with the outlet cover removed in order to show more details of the components coupled to the interior of the receptacle housing.

FIGS. 5A and 5B show a tamper-resistant electrical receptacle arrangement 80 produced in accordance with an exemplary embodiment of the disclosed concept. The electrical receptacle arrangement 80 is similar to the electrical receptacle arrangement 40 shown in FIGS. 3A and 3B but includes a shutter assembly 100 produced in accordance with an exemplary embodiment of the disclosed concept instead of the shutter assembly 54 included in arrangement 40. For economy of disclosure, FIGS. 5A-5B and the remainder of the figures show shutter assembly 100 coupled to a duplex cover (such as the duplex cover 3 shown in FIG. 1C), however, it will be appreciated that production of a decorator cover (such as the decorator cover 3' shown in FIG. 1D) for use with the shutter assembly 100 also falls within the scope of the disclosed concept. The electrical receptacle arrangement 80 in FIGS. 5A and 5B forms two individual electrical outlets 81 and includes a ground strap assembly 82, a hot terminal assembly 84, a neutral terminal assembly 86, an outlet housing 88 with a front cover 90 and a number of individual outlet covers 92, and a number of shutter assemblies 100 coupled to the interior of the outlet housing 88 (in FIG. 5A, one individual outlet cover 92 is coupled to the front cover 90, obscuring one of the shutter assemblies 100 from view, while another individual outlet cover 92 is removed so that one of the shutter assemblies 100 can be viewed). Each individual outlet cover 92 includes a hot slot 93, a neutral slot 94, and a grounding slot 95 structured to receive the hot prong, neutral prong, and grounding prong, respectively, of an electrical plug.

Referring to FIG. 5A, it should be noted that the structure formed when one or more individual outlet covers 92 are coupled to the front cover 90 of the outlet housing 88 is hereinafter referred to as the "front housing" of the electrical receptacle arrangement 80. FIG. 5B shows the electrical receptacle arrangement 80 shown in FIG. 5A with the front housing removed such that two shutter assemblies 100 can be viewed, along with the ground strap assembly 82, hot terminal assembly 84, and neutral terminal assembly 86 that are all coupled to the bottom cover 96.

Figure 4A:
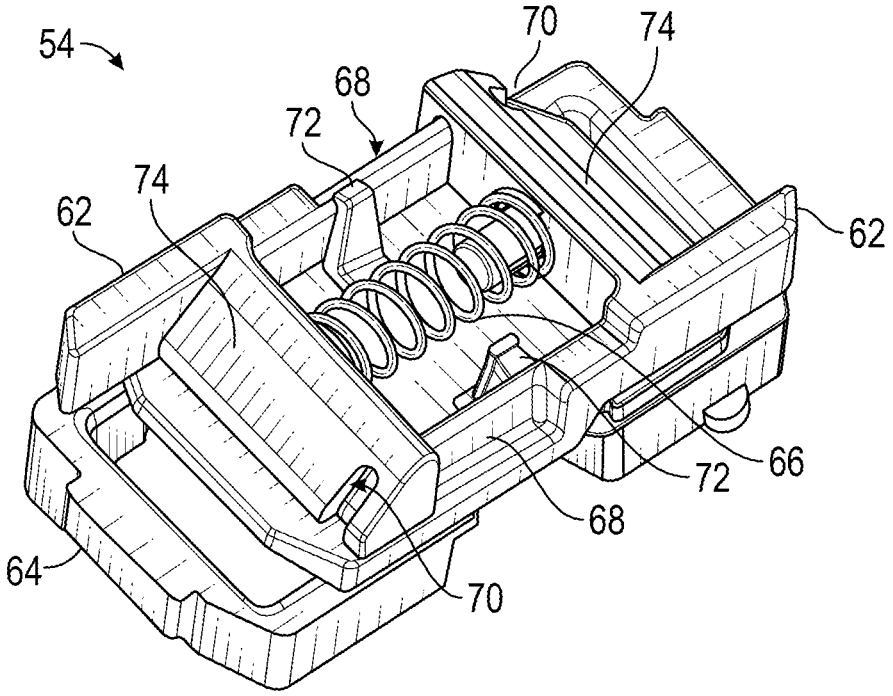
FIG. 4A (Prior Art)
FIG. 4A is a partial isometric view of the front side of a shutter assembly of the electrical receptacle arrangement shown in FIG. 3A.
Figure 4B:
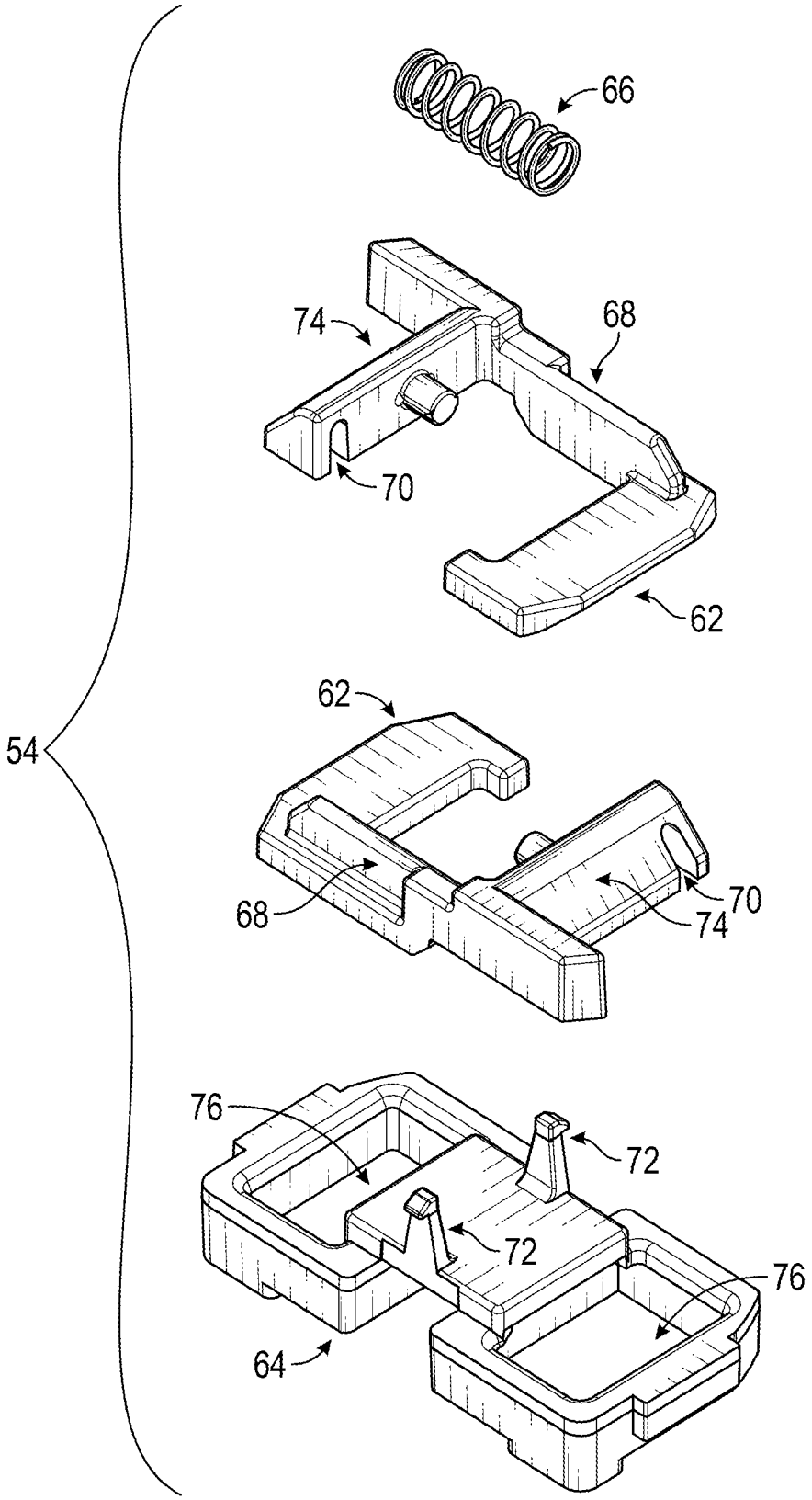
FIG. 4B (Prior Art)
FIG. 4B is a partial isometric exploded view of the shutter assembly shown in FIG. 4A showing the individual components of the shutter assembly.
Figure 6A:
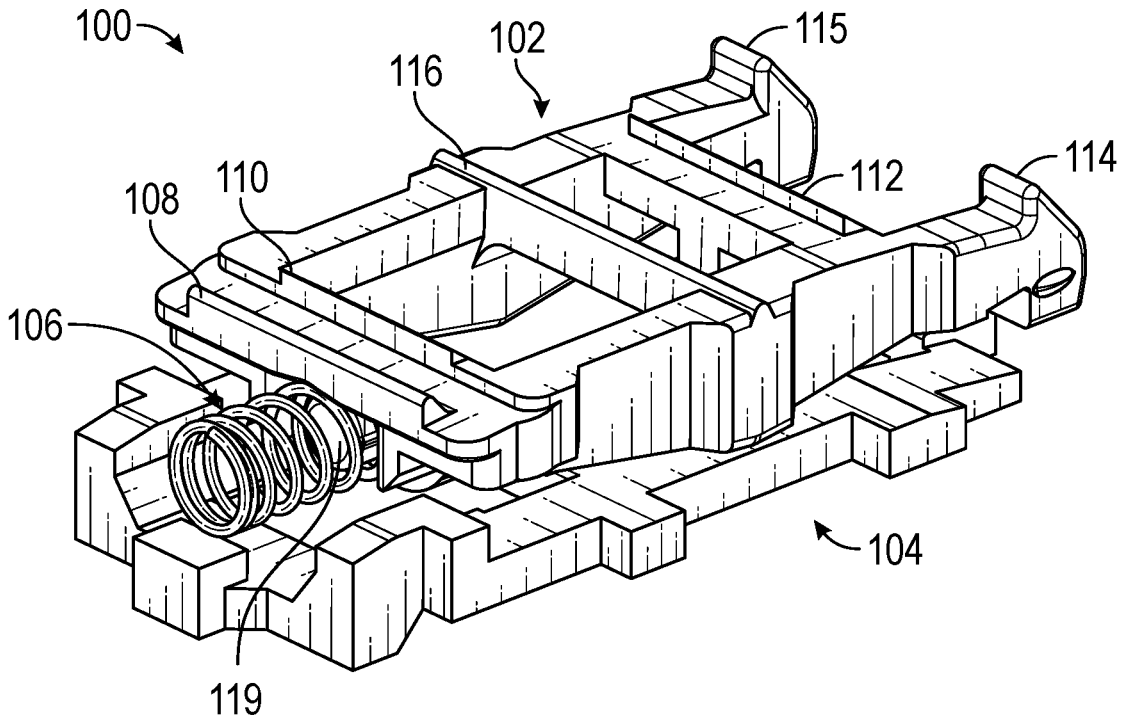
FIG. 6A is an isometric view of the front side of a shutter assembly from the electrical receptacle arrangement shown in FIG. 5A.
Figure 6B:
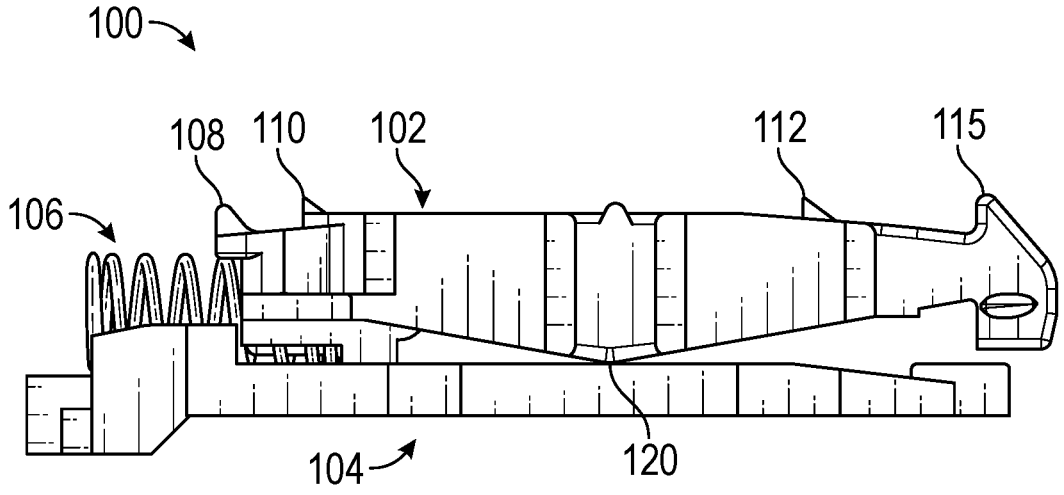
FIG. 6B is a side elevation view of the shutter assembly shown in FIG. 6A.

Referring to FIGS. 6A and 6B, the shutter assembly 100 shown as a component of the electrical receptacle arrangement 80 in FIGS. 5A and 5B comprises one shutter 102, one base clip 104, and one spring 106. The reduced number of components of shutter assembly 100 as compared to a typical shutter assembly such as the shutter assembly 54 shown in FIGS. 4A-4B reduces the number of opportunities for error when coupling the components of shutter assembly 100 to one another, as well as the time required to couple these components together during the production and assembly process, representing an improvement to shutter assemblies for tamper-resistant electrical receptacles. FIGS. 6C-6F show different views and details of the shutter 102 and FIGS. 6G-6H show different views and features of the base clip 104. Several of the features which are shown numbered in FIGS. 6A and 6B are explained in detail with respect to FIG. 6C-6F or 6G-6H.

Prior to describing the remaining figures, it should be noted that the term "front" as used herein in relation to an electrical receptacle arrangement or its components (including, for example and without limitation, a shutter assembly or the components thereof) refers to the side of the component that would face an electrical plug positioned for insertion into the electrical receptacle arrangement. For example, the side of the electrical receptacle arrangement 80 and its components shown in FIG. 5A is the front side. Accordingly, the term "rear" as used herein in relation to an electrical receptacle arrangement or the components of an electrical receptacle arrangement refers to the side of the component disposed opposite the front side, i.e. the side of the component that would face away from the interior of a room if the electrical receptacle arrangement were installed in a wall of the room.

Figure 6C:
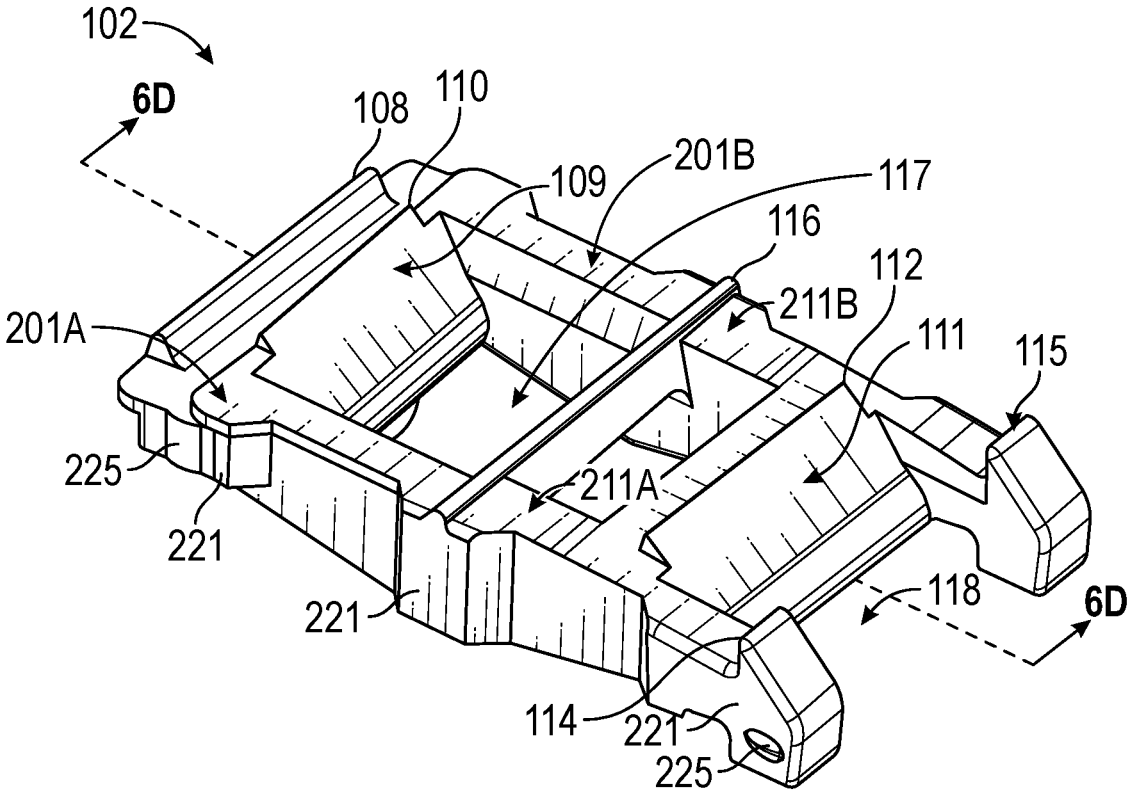
FIG. 6C is a partial isometric view of the front side of the shutter component of the shutter assembly shown in FIG. 6A.

FIG. 6C shows a partial isometric view of the front side of shutter 102 wherein a first shelf 108, a first block 109, a second shelf 110, a second block 111, a third shelf 112, a fourth shelf 114, and a fifth shelf 115 are formed, with a shutter crossbar 116 disposed between the first block 109 and the second block 111. The second shelf 110 is the front-most portion of the first block 109 and the third shelf 112 is the front-most portion of the second block 111. First block 109 and second block 111 serve as blocking mechanisms that prevent objects other than standard plug prongs from accessing the live electrical terminals of the electrical receptacle arrangement 80, as detailed further herein with respect to FIGS. 8A-8I, 9A-9D, 10A-10D, and 11A-11D. The shutter 102 also comprises a hot opening 117 disposed between first block 109 and shutter crossbar 116, and a neutral opening 118 disposed adjacent to second block 111 as an open U-shaped feature that are structured to align with the hot and neutral slots 93, 94, respectively, of an individual outlet cover 92 when electrical receptacle arrangement 80 is fully assembled.

Figure 6D:
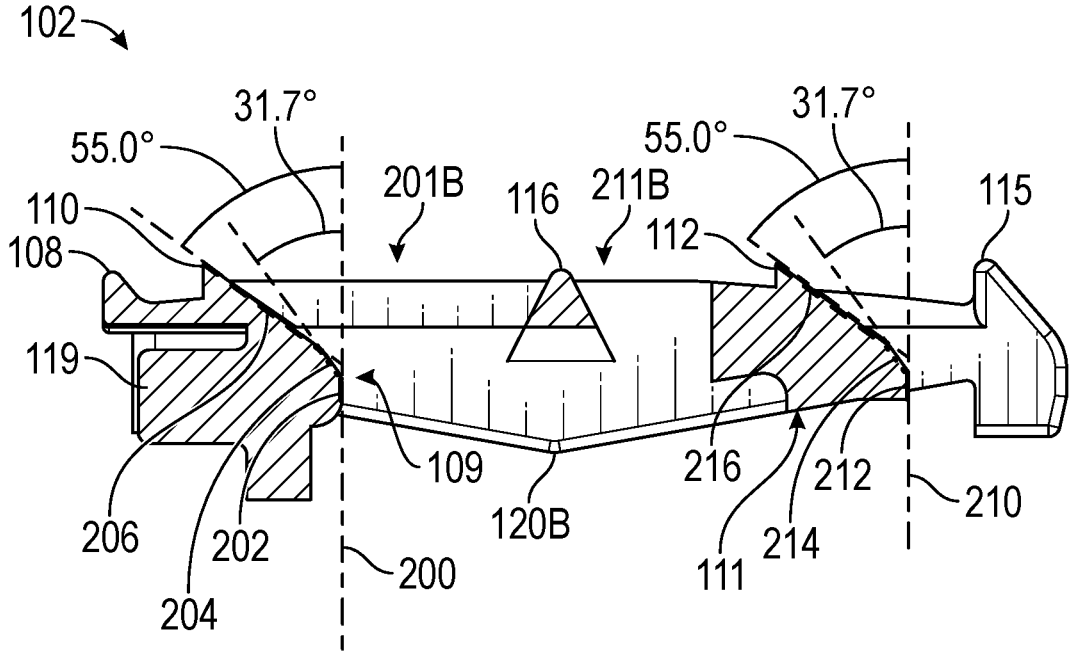
FIG. 6D is a sectional view of the shutter shown in FIG. 6C as indicated by the line 6D-6D shown in FIG. 6C.

FIG. 6D shows a sectional view of shutter 102 as indicated by the line 6D-6D in FIG. 6C. In an exemplary embodiment of the disclosed concept, a portion of each block 109, 111 comprises three different sloped surfaces, each of the three sloped surfaces being disposed at an angle relative to the dashed reference lines 200, 210 such that the angle of any one of the three sloped surfaces is unique relative to the other two sloped surfaces, as shown in the figure and detailed below. Both reference lines 200, 210 are orthogonal to the plane in which the front surfaces 201B, 211B (also shown in FIG. 6C) of the shutter 102 lie. Referring briefly to FIG. 6C, the plane containing the front surfaces 201B, 211B shown in FIG. 6D also contains the front surfaces 201A, 211A. The front surfaces 201A, 201B may be referred to or depicted collectively herein as front surfaces 201, and the front surfaces 211A, 211B may be referred to or depicted herein collectively as front surfaces 211.

Figure 6E:
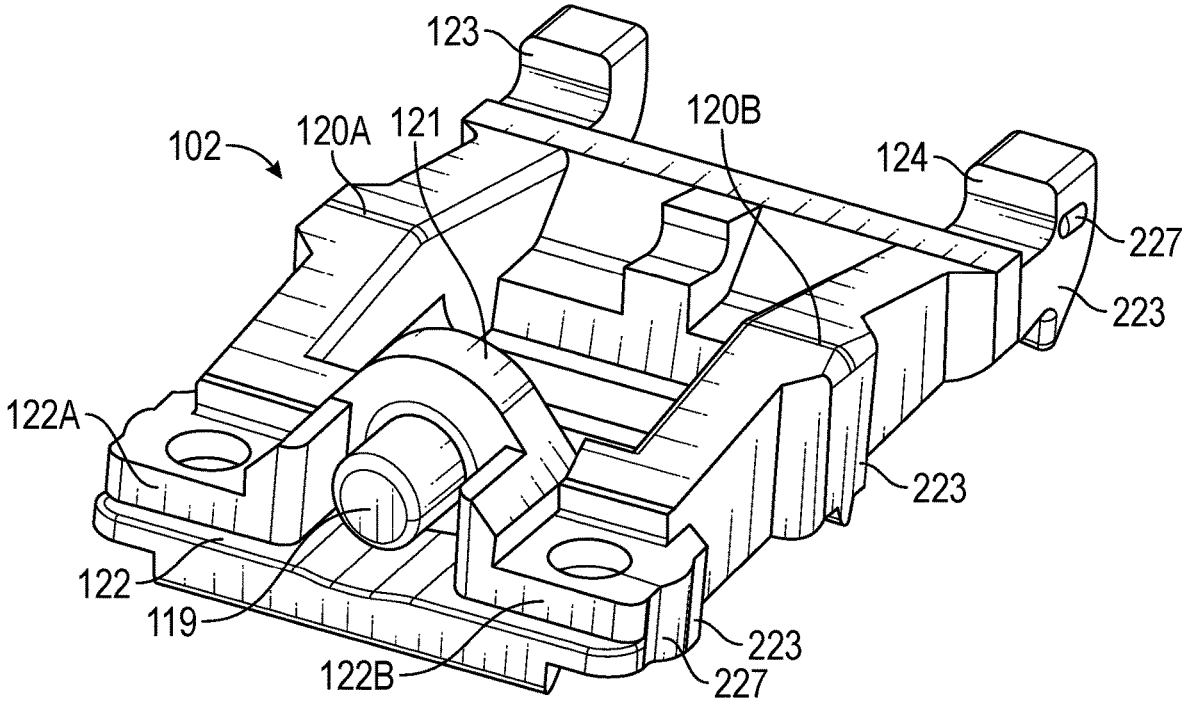
FIG. 6E is a partial isometric view of the rear side of the shutter shown in FIG. 6C.

Referring again to FIG. 6D, with respect to first block 109, a first sloped surface 202 is disposed 0° from the reference line 200, a second sloped surface 204 is disposed approximately 31.7° from the reference line 200, and a third sloped surface 206 is disposed approximately 55.0° from the reference line 200 as shown. With respect to second block 111, a first sloped surface 212 is disposed 0° from the reference line 210, a second sloped surface 214 is disposed approximately 31.7° from the reference line 210, and a third sloped surface 216 is disposed approximately 55.0° from the reference line 210 as shown. FIG. 6E shows the rear side of shutter 102, wherein a spring mount 119, a fulcrum 120 formed by a pair of surfaces 120A and 120B separated by a gap, a spring mount base 121, an overhang 122, a pair of vertical walls 122A and 122B, a first step 123, and a second step 124 are formed. Vertical walls 122A, 122B are so named due to their orientation relative to the view shown in FIG. 6E, and in an exemplary embodiment, vertical walls 122A, 122B are disposed at angle of 90° relative to overhang 122.

Figure 6F:
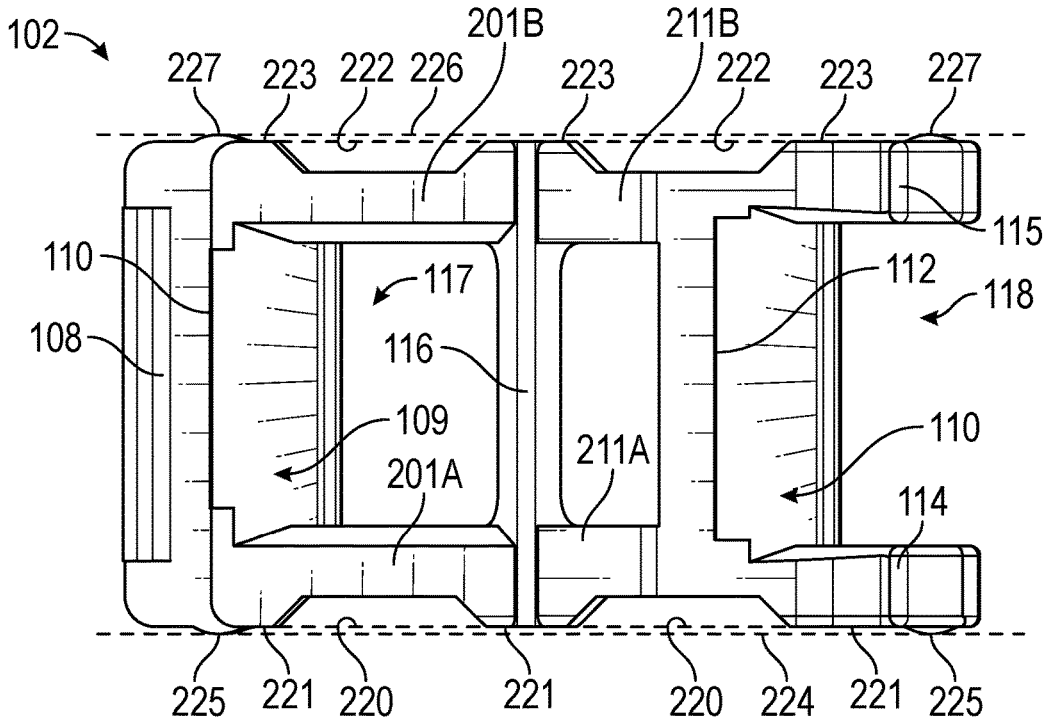
FIG. 6F is an elevation view of the front side of the shutter shown in FIG. 6C.
Figure 6G:
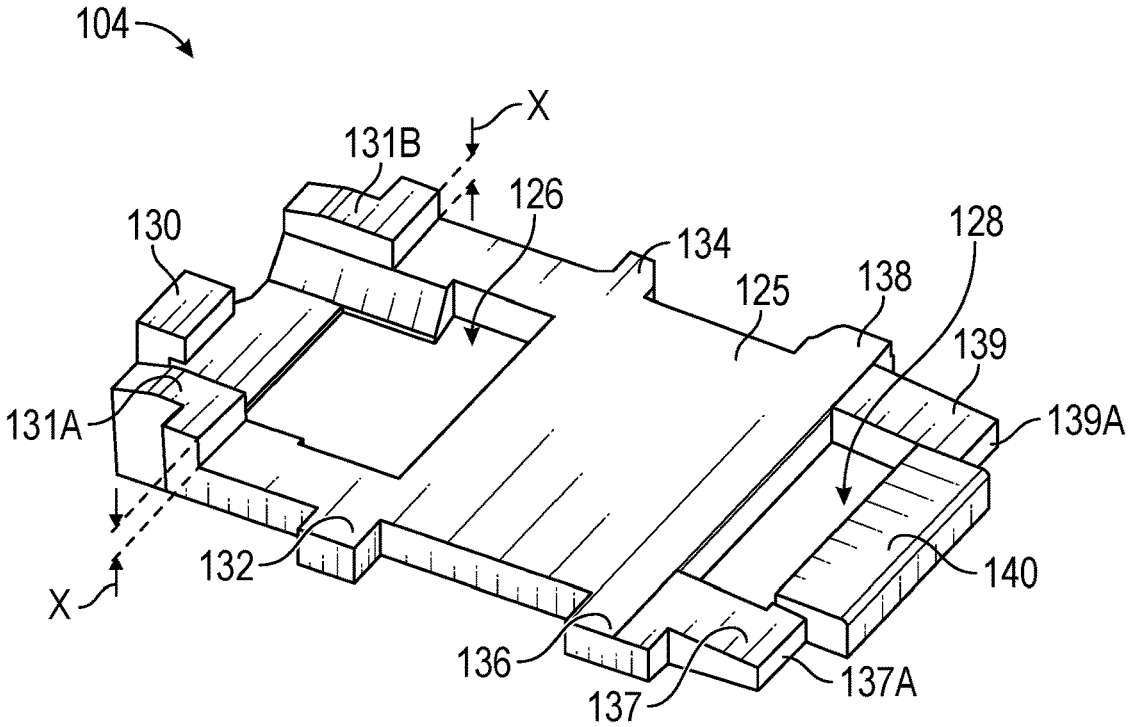
FIG. 6G is a partial isometric view of the front side of the base clip component of the shutter assembly shown in FIG. 6A.
Figure 6H:
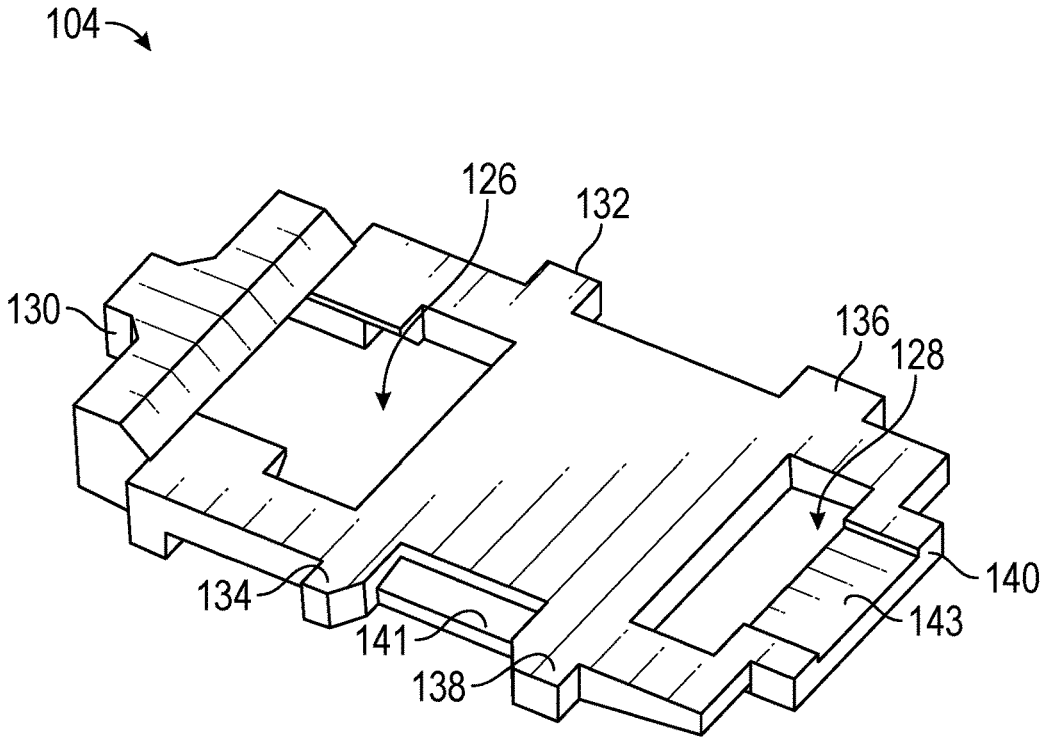
FIG. 6H is a partial isometric view of the rear side of the base clip component shown in FIG. 6G.

FIG. 6F shows an elevation view of the front side of shutter 102, in order to better show the details of a set of friction-reducing features of the shutter 102. In FIG. 6F, a dashed line 220 is drawn to show that a set of side surfaces 221 of a first side of the shutter 102 are co-planar with one another and with the dashed line 220. Similarly, a second side of the shutter 102 disposed opposite the first side, a dashed line 222 is drawn to show that a set of side surfaces 223 of the second side of the shutter 102 are co-planar with one another and with the dashed line 222. At the first side of the shutter 102, a dashed line 224 is drawn to show that a pair of side curvatures 225 of the shutter 102 extend outward from the shutter 102 relative to the side surfaces 221 such that an outward-most point of the surface of each of the side curvatures 225 are co-planar with one another and with the dashed line 224. Similarly, at the second side of the shutter 102, a dashed line 226 is drawn to show that a pair of side curvatures 227 of the shutter 102 extend outward from the shutter 102 relative to the side surfaces 223 such that an outward-most point of the surface of each of the side curvatures 227 are co-planar with one another and with the dashed line 226.

Figure 7A:
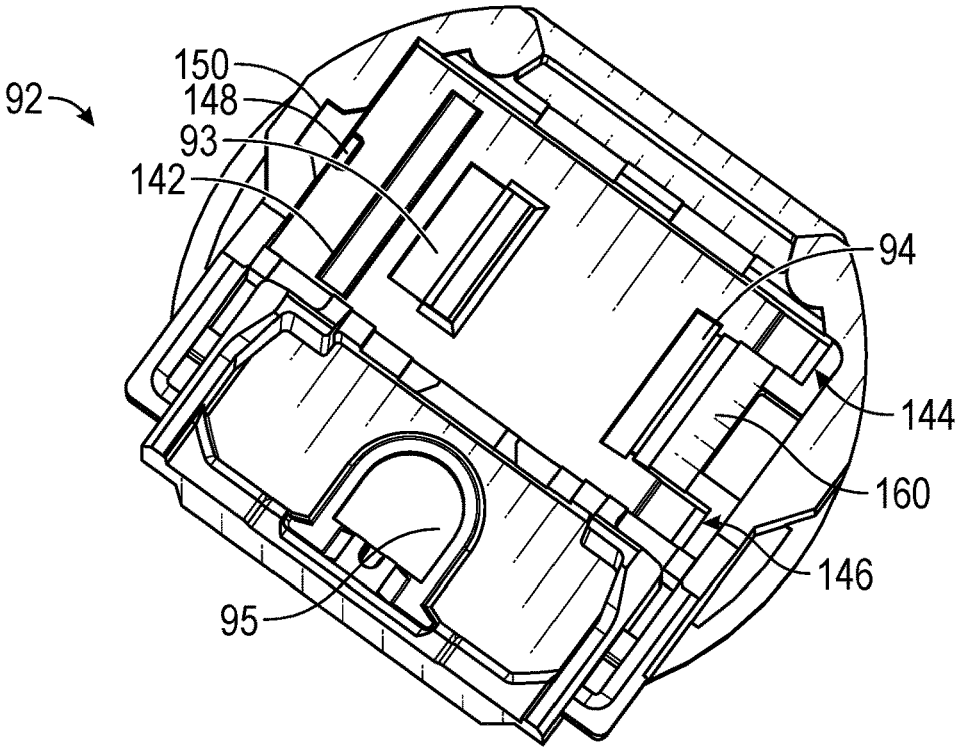
FIG. 7A is a partial isometric view of the rear side of an individual outlet cover from the electrical receptacle arrangement shown in FIG. 5A.
Figure 7B:
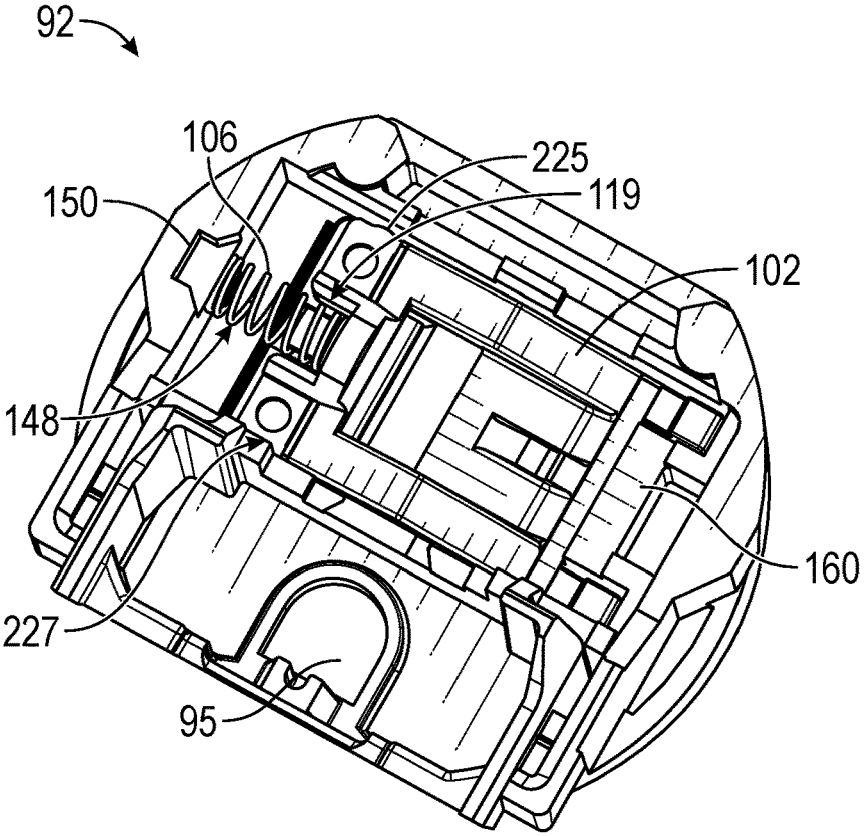
FIG. 7B shows the shutter component and spring of the shutter assembly shown in FIG. 6A seated within the individual outlet cover shown in FIG. 7A, in accordance with an exemplary embodiment of the disclosed concept.

Still referring to FIG. 6F and referring briefly to FIG. 7B (which is described in more detail herein), the shutter 102 is seated within the front side of the individual outlet cover 92 during the process of assembling shutter assembly 100, and when shutter 102 is seated within the individual outlet cover 92, the outward extension of the side curvatures 225 and 227 relative to the side surfaces 221 and 223, respectively, of shutter 102 result in the individual outlet cover 92 being in contact with a much smaller surface area of the first and second sides of shutter 102 than if the side surfaces 221 were coplanar with the outward-most points of the surfaces of side curvatures 225 and if the side surfaces 223 were coplanar with the outward-most points of the surfaces of side curvatures 227. This reduced surface area contact between the individual outlet cover 92 and the first and second sides of shutter 102 accordingly significantly decreases the friction between the individual outlet cover 92 and the first and second sides of shutter 102 when an electrical plug or non-plug object is inserted into the hot and/or neutral slots 93, 94 of the individual outlet cover 92 as described herein with respect to FIGS. 8A-8I, 9A-9D, 10A-10D, and 11A-11D.

FIG. 6G shows the front side of the base clip 104 of shutter assembly 100. The base clip 104 comprises a main body 125 that includes a hot opening 126 and a neutral opening 128, the hot and neutral openings 126, 128 being structured to align with the hot and neutral slots 93, 94, respectively, of an individual outlet cover 92 when electrical receptacle arrangement 80 is fully assembled. In addition, multiple seating features including a stepped arm 130, a first side arm 132, a first poka-yoke arm 134, a second side arm 136 adjacent to a first ramp 137, a second poka-yoke arm 138 adjacent to a second ramp 139, and a bench arm 140 are formed in the front side of the base clip 104. First ramp 137 comprises a vertical wall 137A and second ramp 139 comprises a vertical wall 139A which are discussed in more detail with respect to FIG. 11C herein. Vertical walls 137A, 139A are so named due to their vertical orientation relative to the view shown in FIG. 6G. The two poka-yoke arms 134 and 138 are produced with angled edges for use as poka-yoke (i.e. error-proofing) devices to ensure that the base clip 104 is oriented in the correct direction when seated within the individual outlet cover 92 during assembly, as described herein with respect to FIG. 7D. A first stopper 131A and a second stopper 131B extending a distance X in the frontward direction from main body 125 are also included on the front side of base clip 104 to stop the movement of shutter 102 in the event that any object is inserted through only the hot slot 93 of an individual outlet cover 92, as is described in more detail herein with respect to FIGS. 11A and 11B. In addition, while the hot prong 14, 20 and neutral prong 16, 22 of a plug 10, 18 are ideally the same length, sometimes the neutral prong of a plug is shorter than the hot prong, and the distance X that first stopper 131A and second stopper 131B extend from main body 125 determines how much shorter a neutral prong can be relative to the hot prong while still enabling the prongs to successfully engage the shutter assembly 100 (as described in more detail with respect to FIGS. 10A-10D herein) in order to access the hot and neutral electrical terminals 84, 86 of the electrical receptacle arrangement 80 when the plug is inserted into an individual outlet cover 92.

FIG. 6H shows the rear side of the base clip 104, which includes a first depression 141 disposed between the two poka-yoke arms 134, 138 and a second depression 143 formed on the rear side of benched arm 140 shown in FIG. 6G. Referring to FIG. 5B in addition to FIG. 6H, it will be appreciated that first depression 141 prevents interference between the rear side of base clip 104 with the ground strap 82, as first depression 141 lies adjacent to the front side of ground strap 82 (the reference arrow 141 in FIG. 5B points to where first depression 141 lies), and that second depression 143 prevents interference between the rear side of base clip 104 with the neutral terminal assembly 86, as second depression 143 lies adjacent to the front side of neutral terminal assembly 86 (the reference arrow 143 in FIG. 5B points to where depression 143 lies).

Figure 7C:
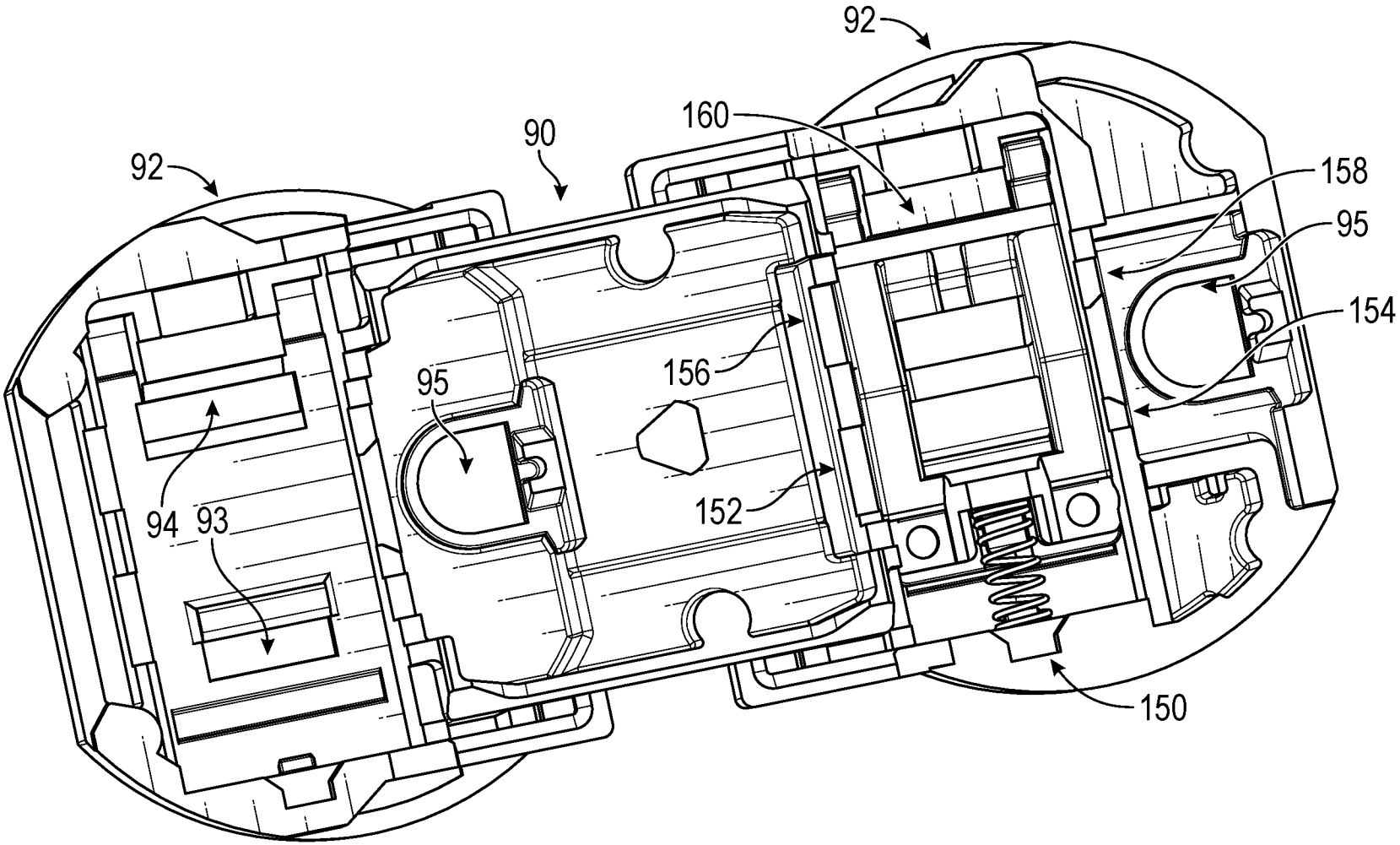
FIG. 7C is a partial isometric view of the rear side of the entire front housing of the electrical receptacle arrangement shown in FIG. 5A, including the individual outlet cover, shutter, and spring shown in FIG. 7B, in accordance with an exemplary embodiment of the disclosed concept.

As previously stated with respect to FIGS. 5A and 5B, the structure formed when one or more individual outlet covers 92 are coupled to the front cover 90 of the outlet housing 88 is referred to as the "front housing" of the electrical receptacle arrangement 80. Referring now to FIGS. 7A-7D, the steps of assembling shutter assembly 100 within the front housing of the outlet housing 88 are shown in FIGS. 7A-7D. In order to better show certain details of the rear side of each individual outlet cover 92 that facilitate assembly and coupling of the shutter assembly 100 to the rear side of the front housing, FIGS. 7A and 7B show a single individual outlet cover 92 in isolation, i.e. not coupled to a front cover 90, while FIG. 7C shows the entire assembled front housing, and 7D shows a portion of the assembled front housing.

Referring to FIG. 7A, in addition to the hot slot 93, the neutral slot 94, and the grounding slot 95 previously described with respect to FIG. 5A, the rear side of individual outlet cover 92 includes a number of features structured to properly align the front side of the shutter 102 during the assembly process. Such features include a first divot 142 structured to receive the first shelf 108 of shutter 102, a second divot 144 structured to receive the fourth shelf 114 of shutter 102, and a third divot 146 structured to receive the fifth shelf 115 of shutter 102, as well as a knob 148 structured to mount the spring 106. In addition, the hot opening 93 is structured to receive the second shelf 110 of shutter 102 and the neutral opening 94 is structured to receive the third shelf 112 of shutter 102.

As shown in FIG. 7B, the front side (shown in FIGS. 6A and 6C) of shutter 102 is seated within the rear side of the individual outlet cover 92 (such that the rear side of shutter 102 is visible in FIG. 7B), which is achieved by first mounting a first end of the spring 106 onto the spring mount 119 (visible in FIGS. 6A and 6C) of shutter 102 so as to couple the spring 106 to the shutter 102 and then mounting a second end of the spring 106 disposed opposite the first end onto the knob 148 of cover 92 so as to couple the spring to the individual outlet cover 92. After the spring 106 is coupled to both the shutter 102 and the individual outlet cover 92, the front side of shutter 102 is placed within and adjacent to the rear side of cover 92 such that the first shelf 108 of shutter 102 faces the first divot 142 of cover 92, the fourth shelf 114 of shutter 102 faces the second divot 144 of cover 92, and the fifth shelf 115 of shutter 102 faces the third divot 146 of cover 92.

FIG. 7C shows the partially assembled shutter assembly 100 shown in FIG. 7B placed within a complete front housing such that the individual outlet cover 92 shown in FIG. 7B is coupled to a front cover 90 with a second individual outlet cover 92. In the rear view of the front housing shown in FIG. 7C, it can be seen that certain portions of front cover 90 overlap portions of the rear side of the individual outlet covers 92. The rear side of the portions of the front cover 90 that overlap the individual outlet covers 92 comprise a number of features included to seat the front side of a base clip 104 (the various features of the front side of the base clip 104 having been previously iterated in the description of FIG. 6G herein).

Figure 7D:
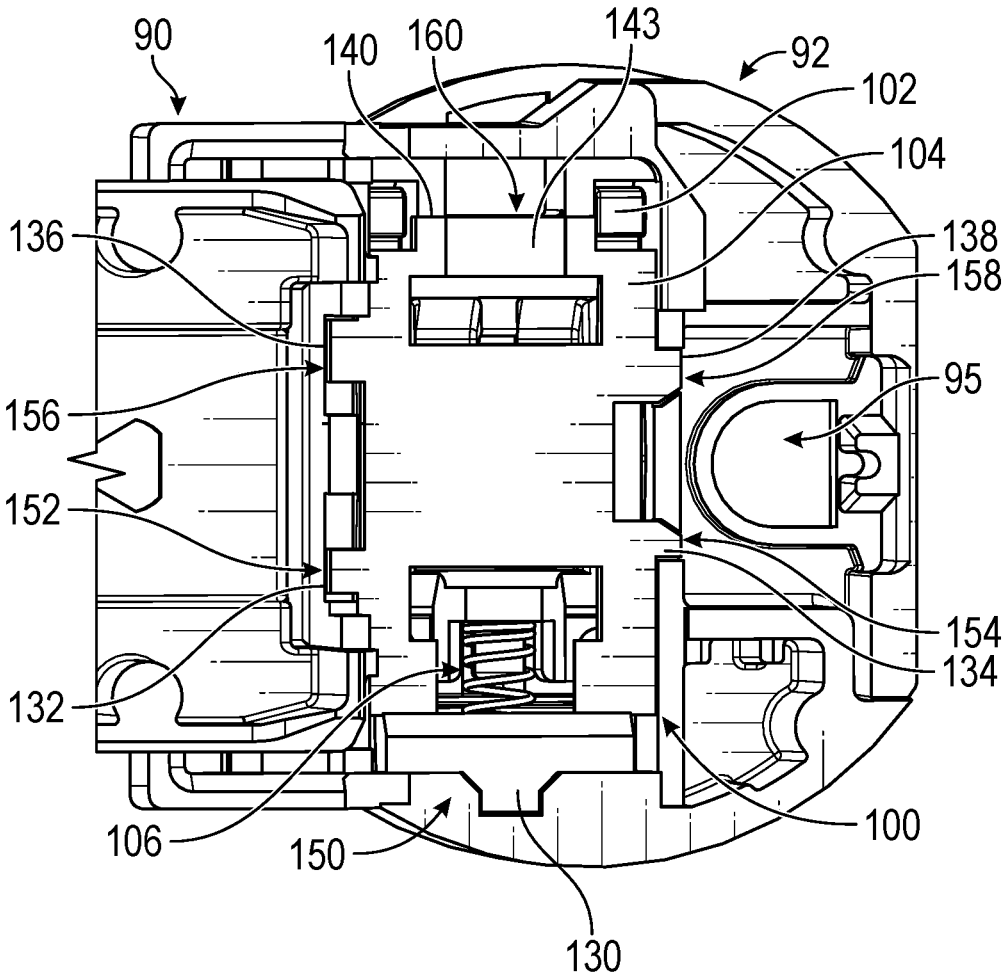
FIG. 7D shows a detail view of a portion of the arrangement shown in FIG. 7C showing how the base clip of the shutter assembly shown in FIG. 6A is seated on top of the shutter and spring shown in FIG. 7D in the rear side of the individual outlet cover to form a complete tamper-proof protection arrangement for the electrical receptacle arrangement shown in FIG. 5A, in accordance with an exemplary embodiment of the disclosed concept.

In particular, referring now to both FIGS. 7C and 7D, when the front side of the base clip 104 is seated on top of a shutter 102 within the rear side of an individual outlet cover 92 as shown in FIG. 7D, the front side of the base clip 104 is disposed adjacent to the rear side of shutter 102 such that the stepped arm 130 of base clip 104 is seated within a stepped notch 150 of individual outlet cover 92, the first side arm 132 of base clip 104 is placed within a first side notch 152 of front cover 90, the first poka-yoke arm 134 of base clip 104 is seated within a first poka-yoke notch 154 of front cover 90, the second side arm 136 of base clip 104 is placed within a second side notch 156 of front cover 90, the second poka-yoke arm 138 of base clip 104 is seated within a second poka-yoke notch 158 of front cover 90, and the bench arm 140 of base clip 104 is seated within a bench notch 160 of front cover 90. It will be appreciated that the angled cuts to the sides of poka-yoke arms 134, 138 of base clip 104 and corresponding angles of the first and second poka-yoke notches 154, 158 of front cover 90 are effective error-proofing devices for ensuring that base clip 104 in seated within the rear side of the front housing correctly.

Figure 7E:
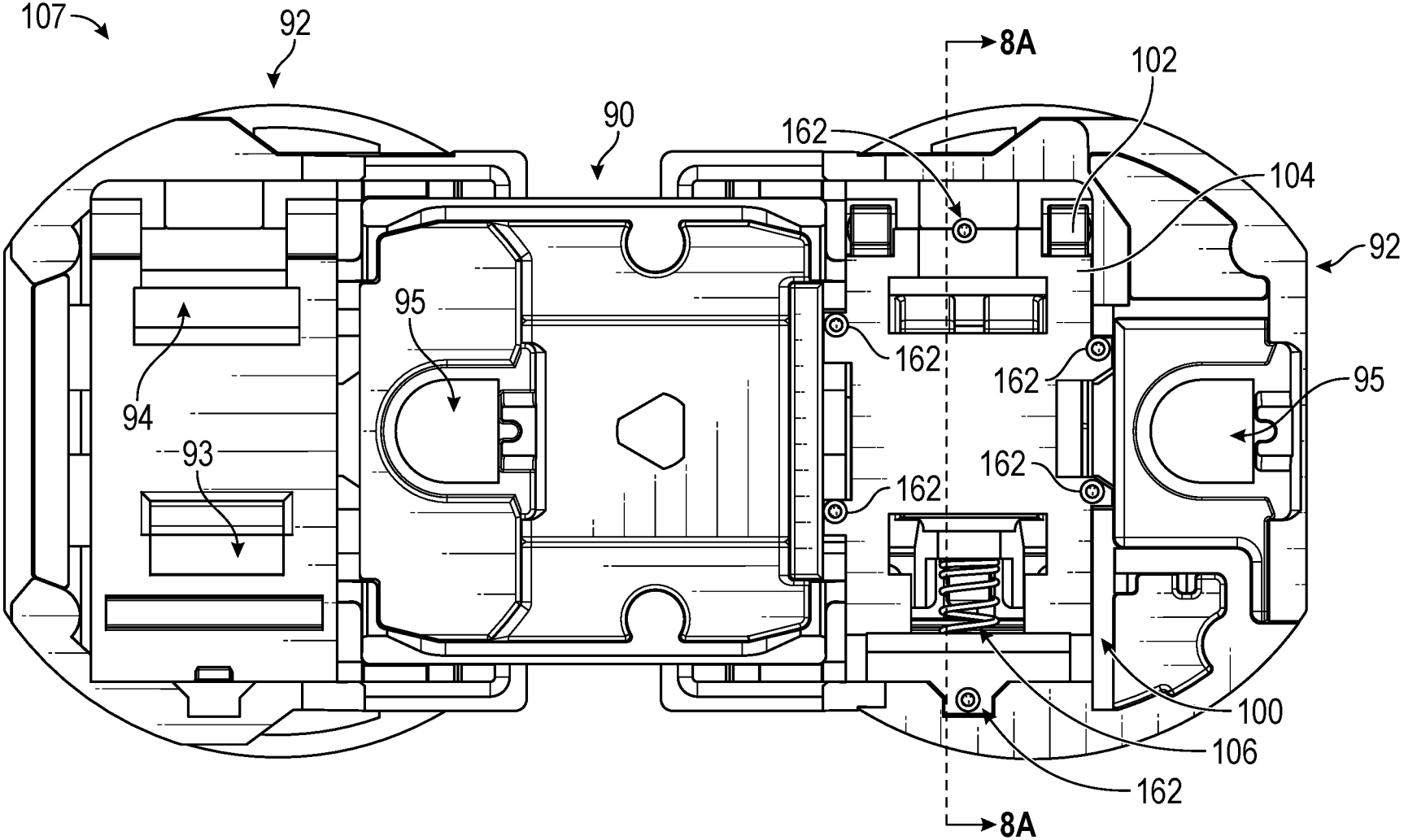
FIG. 7E is a partial isometric view of the tamper-proof protection arrangement shown in FIG. 7D coupled to the rear side of the entire front housing shown in FIG. 7C, with a number of locations marked to denote where coupling of the base clip of the shutter assembly to the front housing can be reinforced with ultrasonic welding or other similar joining operations or features such as hot stacking, mechanical interference based holding, or snapping features for additional security, in accordance with exemplary embodiments of the disclosed concept.

In an exemplary embodiment of the disclosed concept, the coupling of the shutter assembly 100 to the front housing can be reinforced by using joining operations or features such as ultrasonic welding, hot stacking, mechanical interference based holding, snap fitting, or any other suitable method to reinforce the coupling of the base clip 104 to the front housing at a number of locations to form joints 162 as shown in FIG. 7E, in order to better withstand the forces produced by insertion of a plug into the electrical receptacle arrangement 80. Six joints 162 are shown in FIG. 7E, however, the locations of the joints 162 shown in FIG. 7E are illustrative in nature and not intended to be limiting, and it will be appreciated that a different number of joints in locations other than those shown in FIG. 7E may be formed without departing from the scope of the disclosed concept. It should be noted that the base clip 104 is fixedly coupled to the rear side of the individual outlet cover 92, while the shutter 102 is movably coupled to the individual outlet cover 92 via the spring 106 such that the shutter 102 can move relative to the base clip 104, as described in more detail with respect to FIGS. 8A-8I herein. The arrangement depicted in FIG. 7E (as well as FIG. 7D), i.e. that of the shutter assembly 100 coupled to the front housing, forms a complete tamper-proof protection arrangement for a single outlet 81 of the electrical receptacle arrangement 80 shown in FIG. 5A. The protection arrangement shown in FIGS. 7D and 7E may be referred to hereinafter as the "protection arrangement 107" of the electrical receptacle arrangement 80.

Figure 7F:
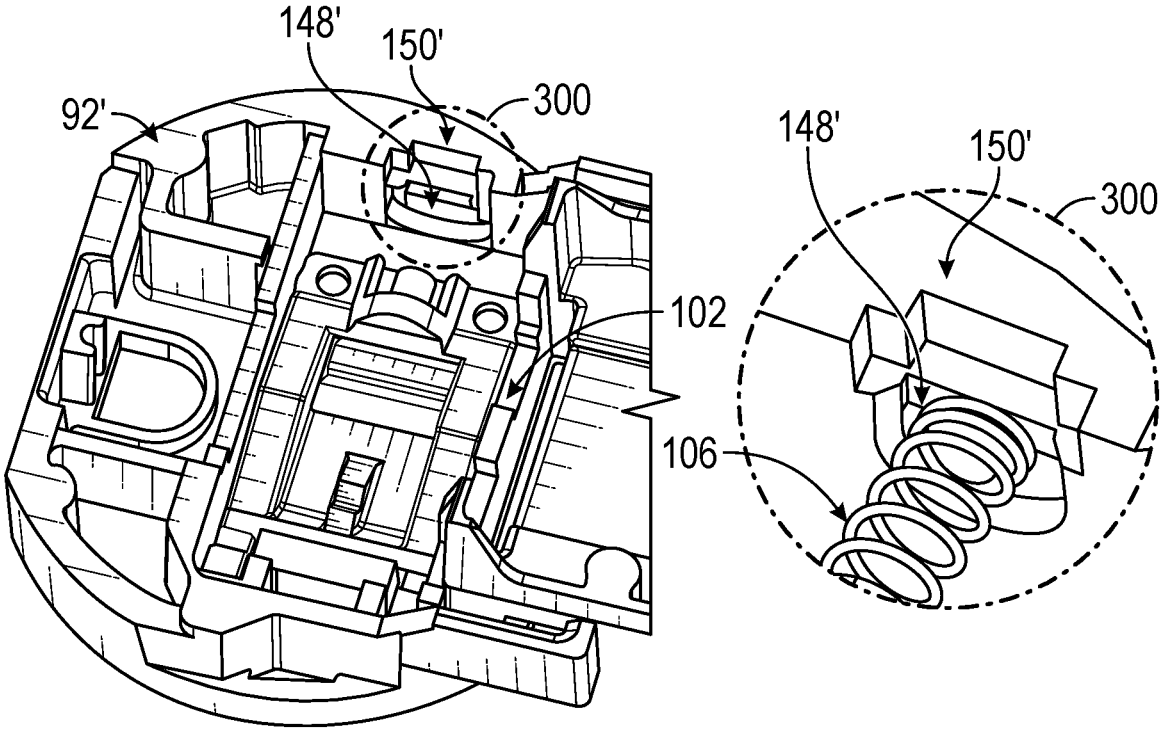
FIG. 7F shows a partial isometric view of a first alternative embodiment of the individual outlet cover shown in FIG. 7A that includes a first alternative embodiment of the spring coupling formation of the individual outlet cover, along with an enlarged view of the first alternative embodiment of the spring coupling formation, in accordance with another exemplary embodiment of the disclosed concept.
Figure 7G:
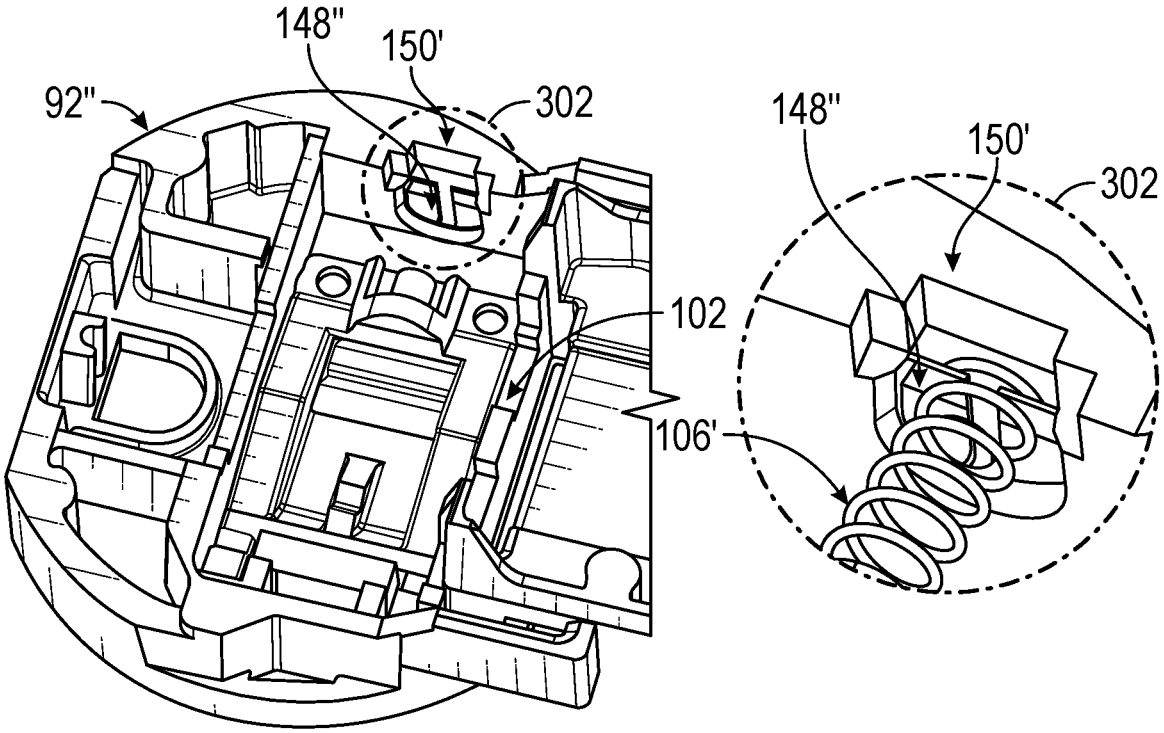
FIG. 7G shows a partial isometric view of a second alternative embodiment of the individual outlet cover shown in FIG. 7A that includes a second alternative embodiment of the spring coupling formation of the individual outlet cover, along with an enlarged view of the second alternative embodiment of the spring coupling formation, in accordance with a further exemplary embodiment of the disclosed concept.
Figure 7H:
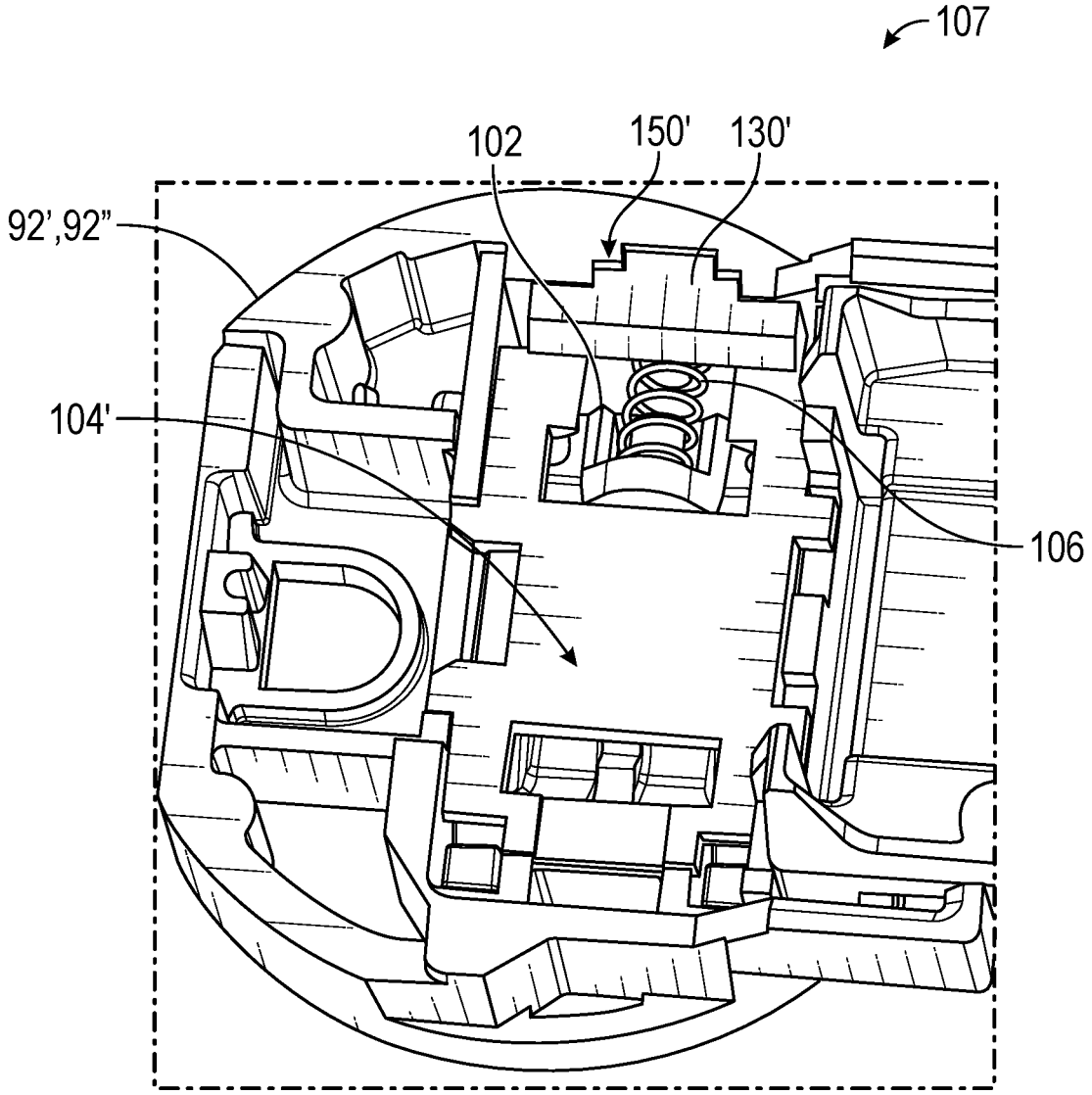
FIG. 7H shows a partial isometric view of an individual outlet cover that can be either of the individual outlet covers shown in FIGS. 7F and 7G, with a corresponding alternative embodiment of the base clip of the shutter assembly shown in FIG. 6A coupled to the individual outlet cover as part of the shutter assembly, in accordance with an exemplary embodiment of the disclosed concept.

Referring to FIGS. 7F-7H, in some exemplary embodiments of the disclosed concept, an electrical receptacle arrangement 80 may be produced using an individual outlet cover 92' or 92" and a base clip 104' instead of the individual outlet cover 92 and base clip 104. The rear side of individual outlet covers 92' and 92" shown in FIGS. 7F and 7G, respectively, are formed with a stepped notch 150' comprising edges forming all 90° angles in order to seat the corresponding stepped arm 130' of base clip 104' (shown in FIG. 7H), instead of being formed with the stepped notch 150 (shown numbered in FIGS. 7A-7D) that includes some non-perpendicular angles which is formed in the individual outlet cover 92 to seat the stepped arm 130 of base clip 104 (shown numbered in FIGS. 6G-6H and 7D). In addition to being formed with stepped notch 150' instead of stepped notch 150, the individual outlet covers 92' and 92" are formed with spring coupling formations that provide alternatives to the knob 148 formed in individual outlet cover 92.

Referring to FIG. 7F, an individual outlet cover 92' formed with a C-shaped alcove 148' is shown, along with an enlarged view 300 of the alcove 148' when a spring 106 is coupled to the alcove 148'. The alcove 148' couples the spring 106 to the individual outlet cover 92' solely by compressing the second end of the spring 106 against the alcove 148' as shown in the figure. Referring to FIG. 7G, an individual outlet cover 92" formed with a split wall 148" is shown, along with an enlarged view 302 of the split wall 148" when a spring 106 is coupled to the split wall 148". The split wall 148" couples the second end of the spring 106 to the individual outlet cover 92" by being inserted between two coils of the spring 106 as shown in the figure. The C-shaped alcove 148' of individual outlet cover 92' allows flexibility for adjustment in the positioning of the spring 106, while the split wall 148' of individual outlet cover 92" provides a fixed placement of the spring 106 similar to the fixed placement offered by the knob 148 of individual outlet cover 92.

Aside from the stepped arm 130' of base clip 104' forming a different outline than the stepped arm 130 of base clip 104 when viewed from the perspective shown in FIGS. 7D and 7H, the remainder of the structures of base clip 104 and 104' are identical. In addition, although all three spring coupling formations (i.e. the knob 148, the C-shaped alcove 148', and the split wall 148") couple the spring 106 to their respective individual outlet covers 92, 92', and 92" using different mechanisms, an electrical receptacle arrangement 80 using any one of the three spring coupling formations 92, 92', or 92" along with the corresponding base clip 104 or 104' functions the same way that the electrical receptacle protection arrangements 107 portrayed in FIGS. 8A-8I, 9A-9D, 10A-10D, and 11A-11D function, as described subsequently herein. The decision to include one of the individual outlet covers 92, 92', or 92" and the corresponding base clip 104 or 104' instead of the others is dictated by manufacturing and automated assembly targets. Manufacturing the individual outlet covers 92' and 92" is simpler than manufacturing the individual outlet cover 92, and the designs of individual outlet covers 92' and 92" facilitate faster automated assembly of a shutter assembly 100 within an individual outlet cover 92' or 92" as compared to assembly of a shutter assembly 100 within an individual outlet cover 92.

Figure 2A:
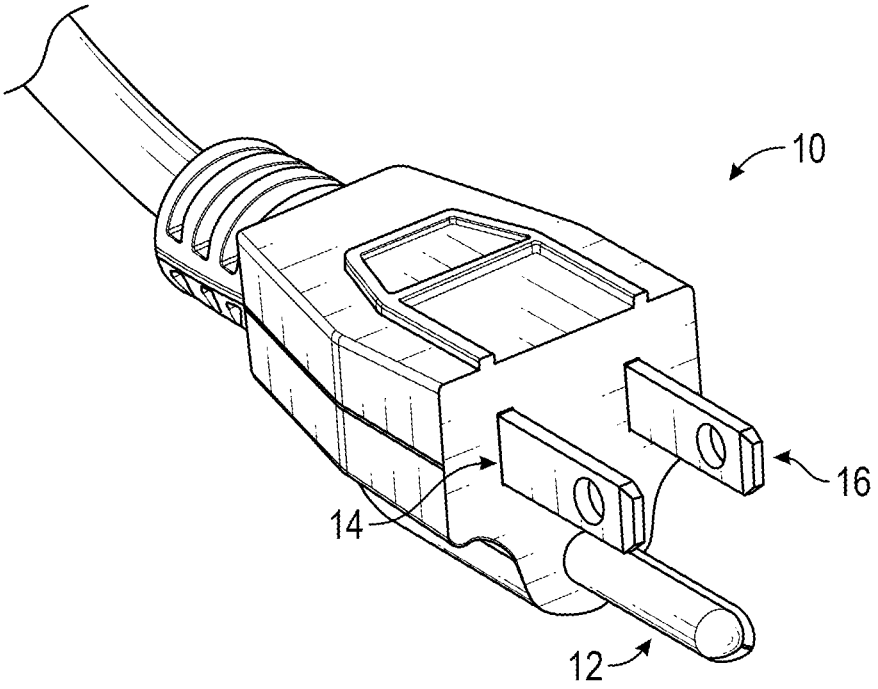
FIG. 2A (Prior Art)
FIG. 2A is an isometric view of a three-pronged grounded NEMA 5-15P electrical plug.
Figure 2B:
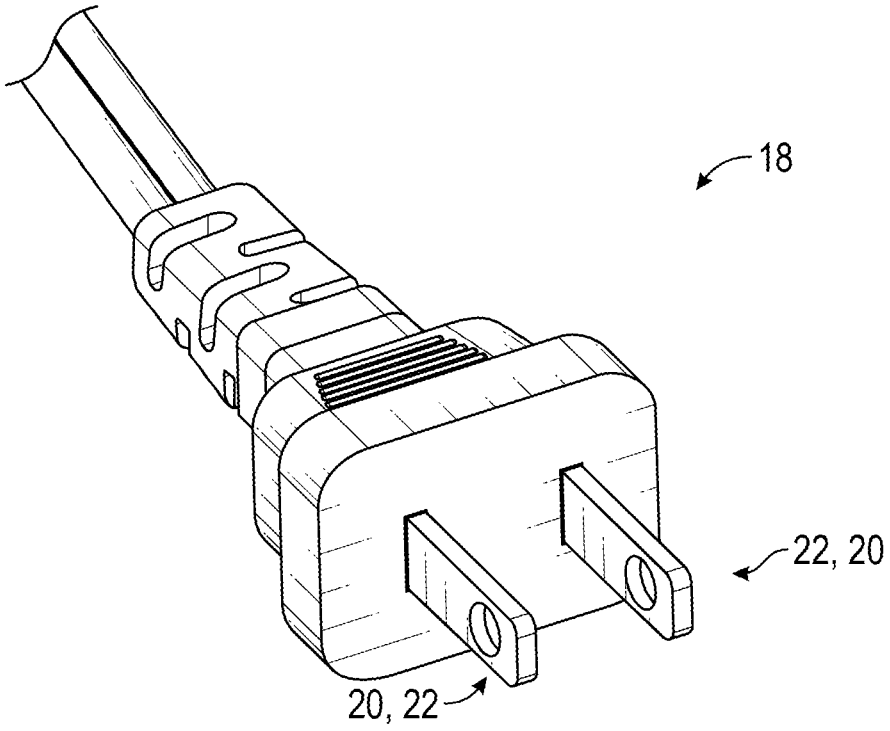
FIG. 2B (Prior Art)
FIG. 2B is an isometric view of a two-pronged ungrounded NEMA 1-15P electrical plug.
Figure 8A:
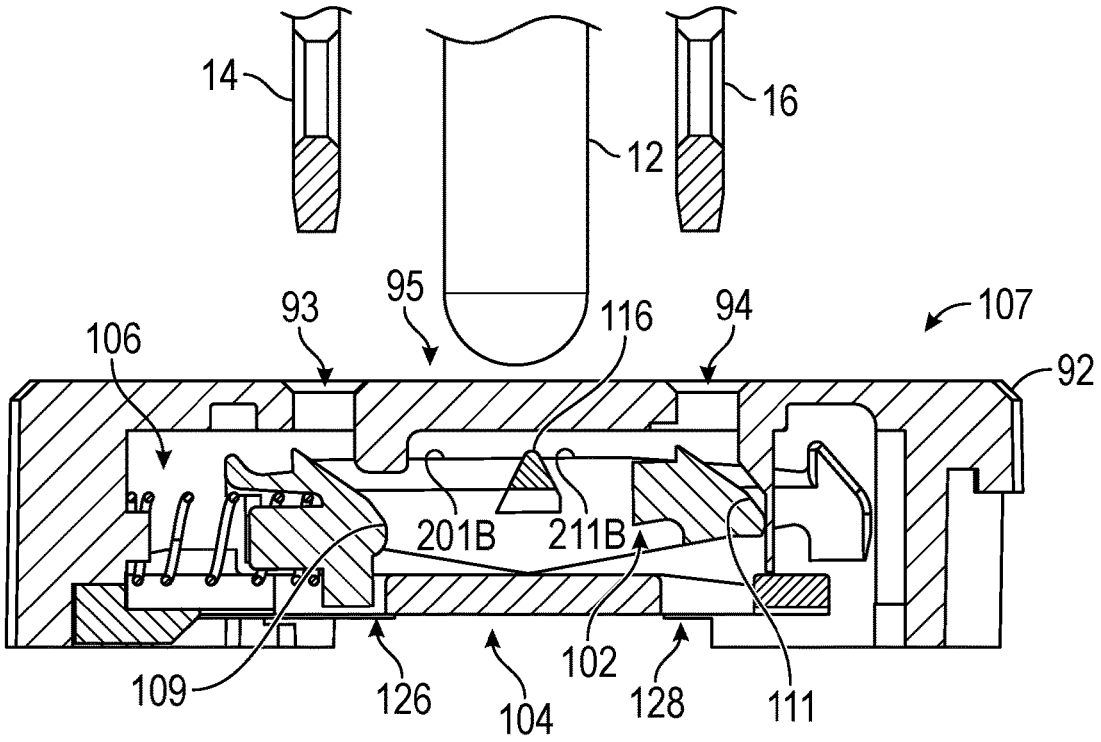
FIG. 8A is a sectional view of the electrical receptacle protection arrangement shown in FIG. 7E as indicated by the line 8A-8A shown in FIG. 7E, showing the spring of the shutter assembly disposed horizontally in its default state, demonstrating how the spring biases the shutter to block the path between the hot and neutral slots of the individual outlet cover and the hot and neutral openings in the base clip that provide access to the live electrical terminals of the electrical receptacle arrangement shown in FIG. 5A when a plug is not inserted into the shutter assembly, in accordance with an exemplary embodiment of the disclosed concept.

Even with a streamlined arrangement comprised of fewer components than existing shutter designs, shutter assembly 100 comprises several features that prevent a non-standard plug object from accessing the live electrical terminals disposed beneath shutter assembly 100. Before detailing how shutter assembly 100 prevents non-standard plug objects from accessing the live electrical terminals of an electrical receptacle arrangement 80, FIGS. 8A-8I show how the prongs of a standard plug can access the live electrical terminals through the shutter assembly 100, in accordance with some exemplary embodiments of the disclosed concept. FIG. 8A shows a sectional view of the electrical receptacle protection arrangement 107 shown in FIG. 7E (the front housing depicted as being transparent in FIG. 8A) with a standard three-pronged plug such as plug 10 in FIG. 2A positioned to be inserted into the outlet cover 92, viewed from the perspective of line 8A-8A shown in FIG. 7E. FIG. 8A shows how the spring 106 biases the shutter 102 to block the path between the hot slot 93 of the individual outlet cover 92 and the hot opening 126 of the base clip 104, which may be referred to hereinafter as the "hot path", and to block the path between the neutral slot 94 of the individual outlet cover 92 and the neutral opening 128 of the base clip 104, which may be referred to hereinafter as the "neutral path". It should be noted that the grounding prong 12 of plug 10 is longer than the hot prong 14 and the neutral prong 16, as is standard in all NEMA 5-15P three-pronged plugs, in order to ensure that a connection to ground is established before current can flow into the hot prong 14 and out of the neutral prong 16 when the plug 10 is being inserted into the electrical receptacle arrangement 80, in the event that excessive current needs to be diverted to ground. It should also be noted that the hot and neutral prongs 14, 16 are approximately the same length.

Figure 8B:
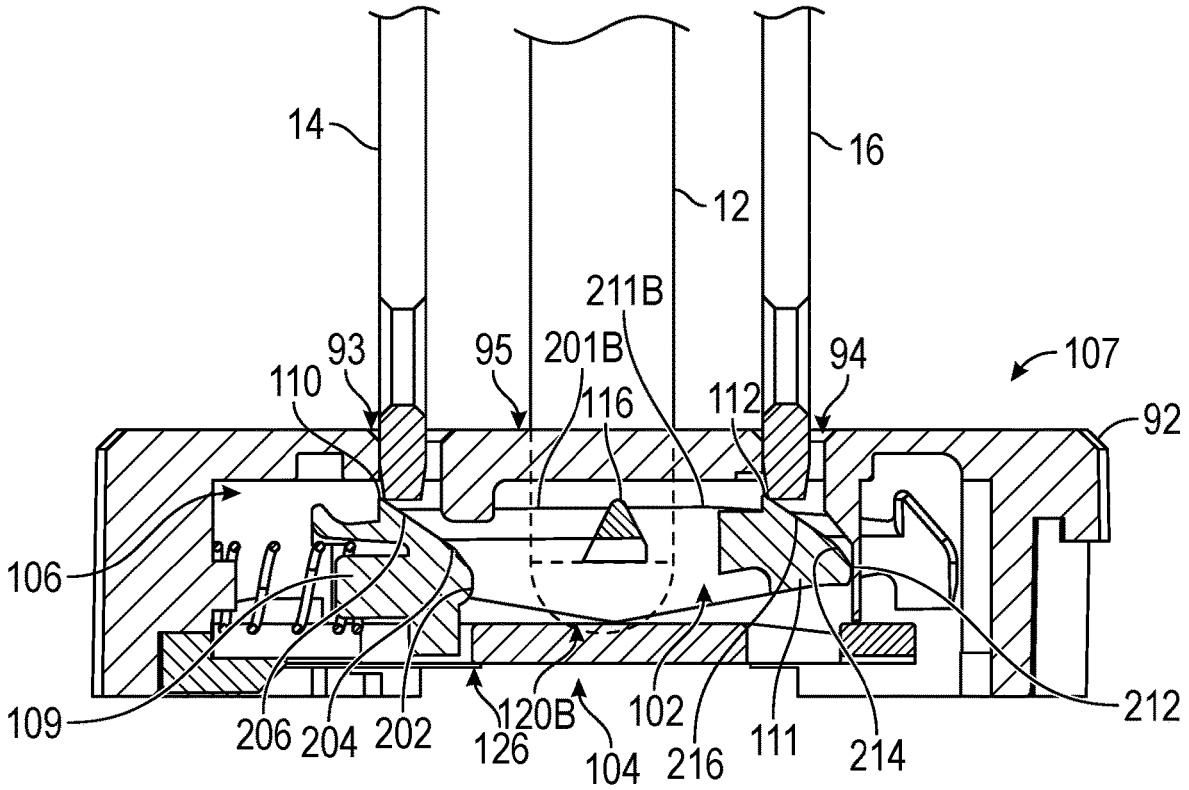
FIG. 8B shows the protection arrangement shown in FIG. 8A, showing the prongs of a plug inserted into the hot and neutral slots of the individual outlet cover, at the first step of engagement with the shutter assembly, in accordance with an exemplary embodiment of the disclosed concept.

FIG. 8B shows another sectional view of the electrical receptacle protection arrangement 107 shown in FIG. 7E (the front housing again depicted as being transparent as it was in FIG. 8A), viewed from the perspective of line 8B-8B shown in FIG. 7E, with the plug 10 from FIG. 8A partially inserted into the individual outlet cover 92 such that each of the grounding prong 12, hot prong 14, and neutral prong 16 is inserted partially into its respective grounding slot 95, hot slot 93, and neutral slot 94 of individual outlet cover 92. FIGS. 8C-8I show the same sectional view of the shutter assembly 100 and front housing arrangement shown in FIG. 8B, with the plug 10 from FIG. 8A in various stages of insertion in each of the figures. For the purpose of simplifying the figures, those portions of the front cover 90 shown in FIG. 8A, which generally fall below the dashed line 8B2-8B2 in FIG. 8A, are omitted from FIGS. 8B-8I.

Figure 8C:
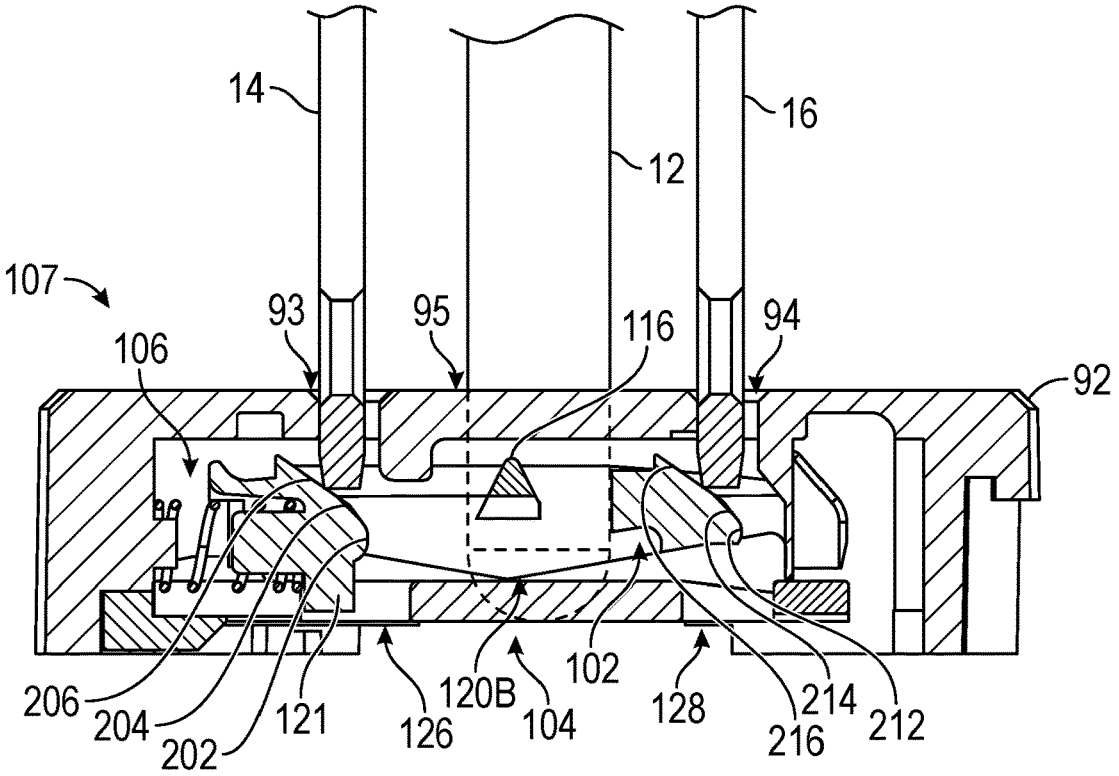
FIG. 8C shows the protection arrangement shown in FIG. 8B after the plug prongs have been pushed further into the hot and neutral slots of the individual outlet cover and are engaging the front-most sloped surfaces of two blocking mechanisms of the shutter, in accordance with an exemplary embodiment of the disclosed concept.

FIG. 8B represents a first stage of the process of a plug 10 successfully engaging with the shutter assembly 100 in order to access the live electrical terminals which the shutter assembly is intended to shield from non-plug objects. In FIG. 8B, the neutral prong 16 has made contact with the third shelf 112 of the second block 111 of shutter 102, while the hot prong 14 has not yet engaged the shutter assembly 100 (a very small gap exists between the bottom of the hot prong 14 and the second shelf 110 of the shutter 102). FIG. 8C represents a second stage of the process of the plug 10 successfully engaging with the shutter assembly 100 in order to access the live electrical terminals. FIG. 8C shows the sideways movement of the shutter 102 relative to its position in FIG. 8B resulting from the hot prong 14 and neutral prong 16 simultaneously pushing against the third sloped surfaces 206 and 216 of first block 109 and second block 111, respectively, of the shutter 102. As the hot and neutral prongs 14, 16 push against the third sloped surfaces 206, 216, the shutter 102 moves to the left (relative to the view shown in FIGS. 8B and 8C) such that spring 106 becomes more compressed than it was in FIG. 8B. This movement is made apparent by observing the change in the positions of the shutter crossbar 116 and shutter fulcrum surface 120B relative to the neutral prong 16 and the base clip 104 between FIG. 8B and FIG. 8C.

Figure 8D:
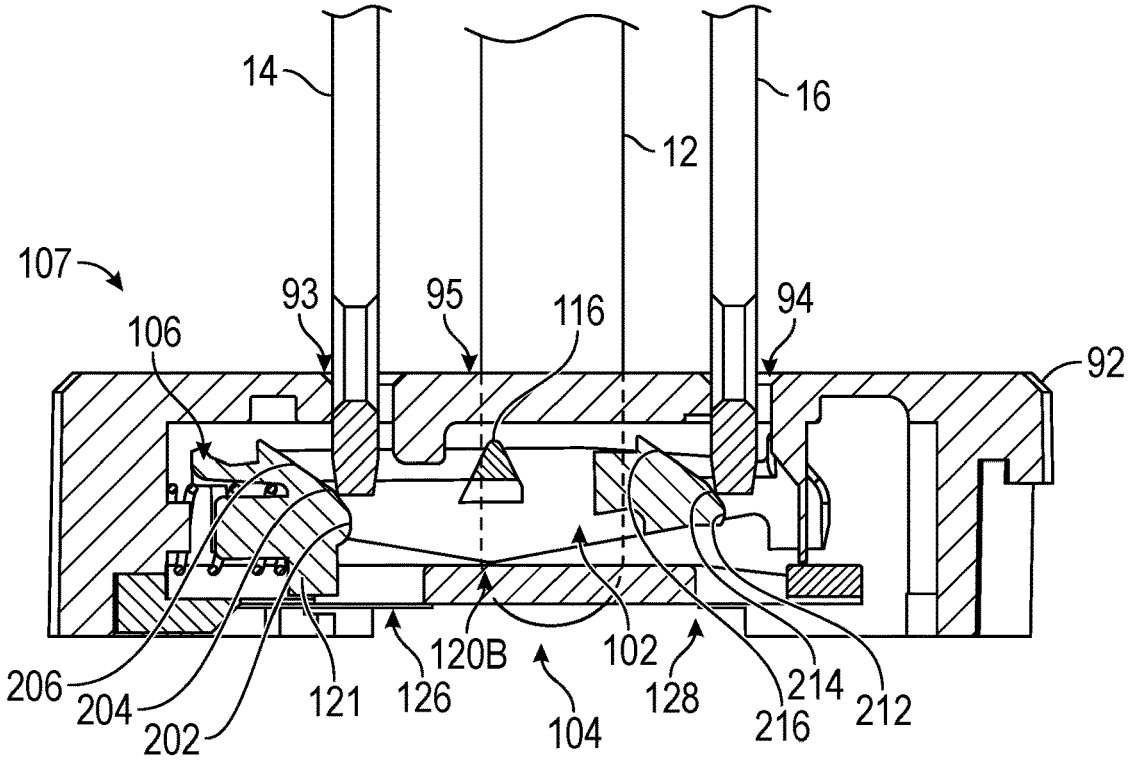
FIG. 8D shows the protection arrangement shown in FIG. 8C after the plug prongs have been pushed further into the hot and neutral slots of the individual outlet cover and are engaging the rear-most sloped surfaces of two blocking mechanisms of the shutter, in accordance with an exemplary embodiment of the disclosed concept.

FIG. 8D represents a third stage of the process of the plug 10 successfully engaging with the shutter assembly 100 in order to access the live electrical terminals. FIG. 8D shows the sideways movement of the shutter 102 relative to its position in FIG. 8C resulting from the hot prong 14 and neutral prong 16 simultaneously pushing against the second sloped surfaces 204 and 214 of first block 109 and second block 111, respectively. As the hot and neutral prongs 14, 16 push against the second sloped surfaces 204, 214, the shutter 102 moves further to the left (relative to the view shown in FIGS. 8C and 8D) such that spring 106 becomes more compressed than it was in FIG. 8C. This movement is made apparent by observing the change in the positions of the shutter crossbar 116 and shutter fulcrum surface 120B relative to the neutral prong 16 and the base clip 104 between FIG. 8C and FIG. 8D.

Figure 8E:
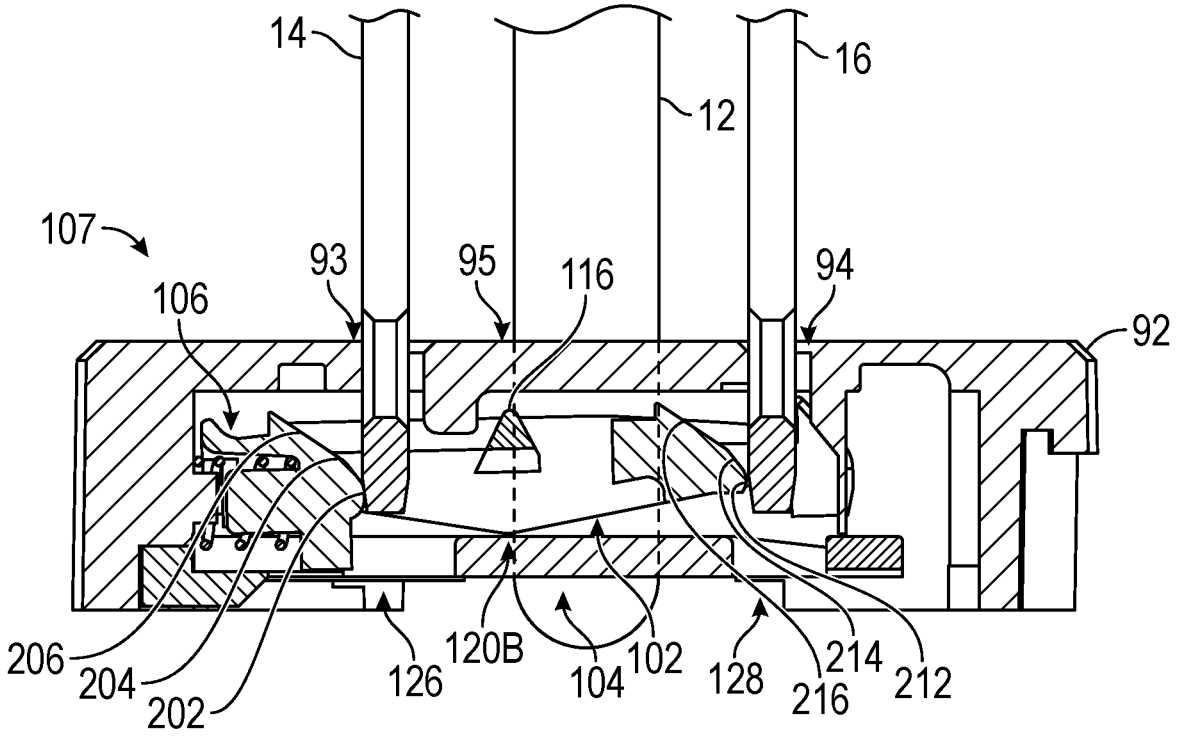
FIG. 8E shows the protection arrangement shown in FIG. 8D after the plug prongs have been pushed further into the hot and neutral slots of the individual outlet cover and have successfully moved the blocking mechanisms of the shutter out of the path of the hot and neutral openings in the base clip that allow the prongs to access the live electrical terminals of the electrical receptacle arrangement shown in FIG. 5A, in accordance with an exemplary embodiment of the disclosed concept.
Figure 8F:
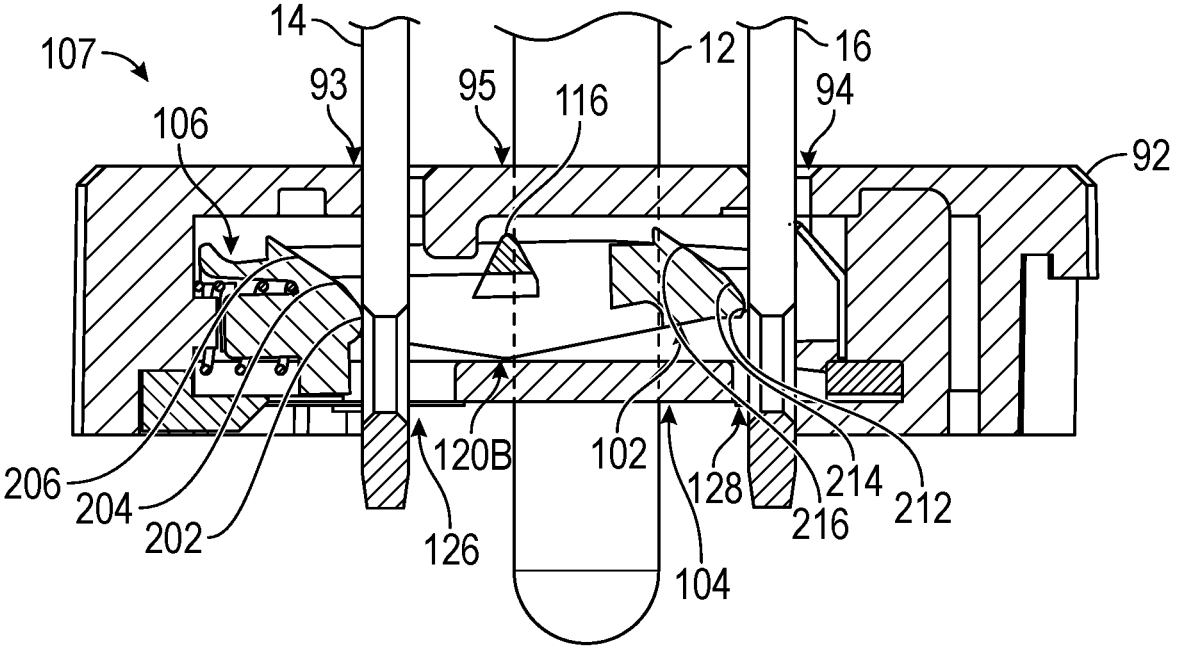
FIG. 8F shows the protection arrangement shown in FIG. 8E after the hot and neutral plug prongs have successfully been inserted into the hot and neutral openings in the base clip that allow the prongs to access the live electrical terminals of the electrical receptacle arrangement shown in FIG. 5A, in accordance with an exemplary embodiment of the disclosed concept.

FIG. 8E represents a third stage of the process of the plug 10 successfully engaging with the shutter assembly 100 in order to access the live electrical terminals. FIG. 8E shows the hot prong 14 and neutral prong 16 sliding adjacent to the first sloped surfaces 202 and 212 of first block 109 and second block 111, respectively, after having progressed past the second sloped surfaces 202 and 212, the sideways movement of the shutter 102 relative to its position in FIG. 8D resulting from the hot prong 14 and neutral prong 16 simultaneously pushing against the first sloped surfaces 202 and 212 of first block 109 and second block 111, respectively. It will be appreciated that, as a result of the hot prong 14 and neutral prong 16 having progressed past the second sloped surfaces 202 and 212, the spring 106 is disposed in its most compressed state in FIG. 8D. In addition, both the hot path between the hot slot 93 of the individual outlet cover 92 and the hot slot opening of the base clip 104 and the neutral path between the neutral slot 94 of the individual outlet cover 92 and the neutral opening 128 of the base clip 104 are no longer blocked such that the hot and neutral prongs 14, 16 slide adjacent to the first sloped surfaces 202, 212 until the hot prong 14 and neutral prong 16 enter the hot opening 126 and neutral opening 128 of the base clip 104 as shown in FIG. 8F and the outlet-facing surface of the plug 10 hits the front side of the individual outlet cover 92.

With respect to FIGS. 8A-8F, it will be appreciated that the function of shutter assembly 100 as shown in FIGS. 8A-8F is unaffected by the insertion of grounding prong 12 into the individual outlet cover 92 and that the shutter assembly 100 would still function as shown in FIG. 8A if a two-pronged ungrounded plug such as plug 18 were inserted into the assembly instead of the three-pronged plug 10. In addition, it will be appreciated that the movement of the shutter 102 is non-linear relative to the travel of the hot and neutral plug prongs 14, 16 due to the sloped surfaces 202, 204, 206, 212, 214, 216 of the shutter 102, i.e. a quarter inch of linear downward movement of the plug prongs 14, 16 does not results in a quarter inch of linear sideways movement of the fulcrum 120 of the shutter 102. It should also be noted that the sloped surfaces 202, 204, 206 may be collectively referred to hereinafter as the "front surfaces" or "front side" of the first block 109 and that the sloped surfaces 212, 214, 216 may be collectively referred to hereinafter as the "front surfaces" or "front side" of the second block 111 due to the fact that the prongs of an electrical plug inserted into the front side of an individual outlet cover 92 approach the shutter 102 from the front side to engage the sloped surfaces 202, 204, 206, 212, 214, 216.

Figure 8G:
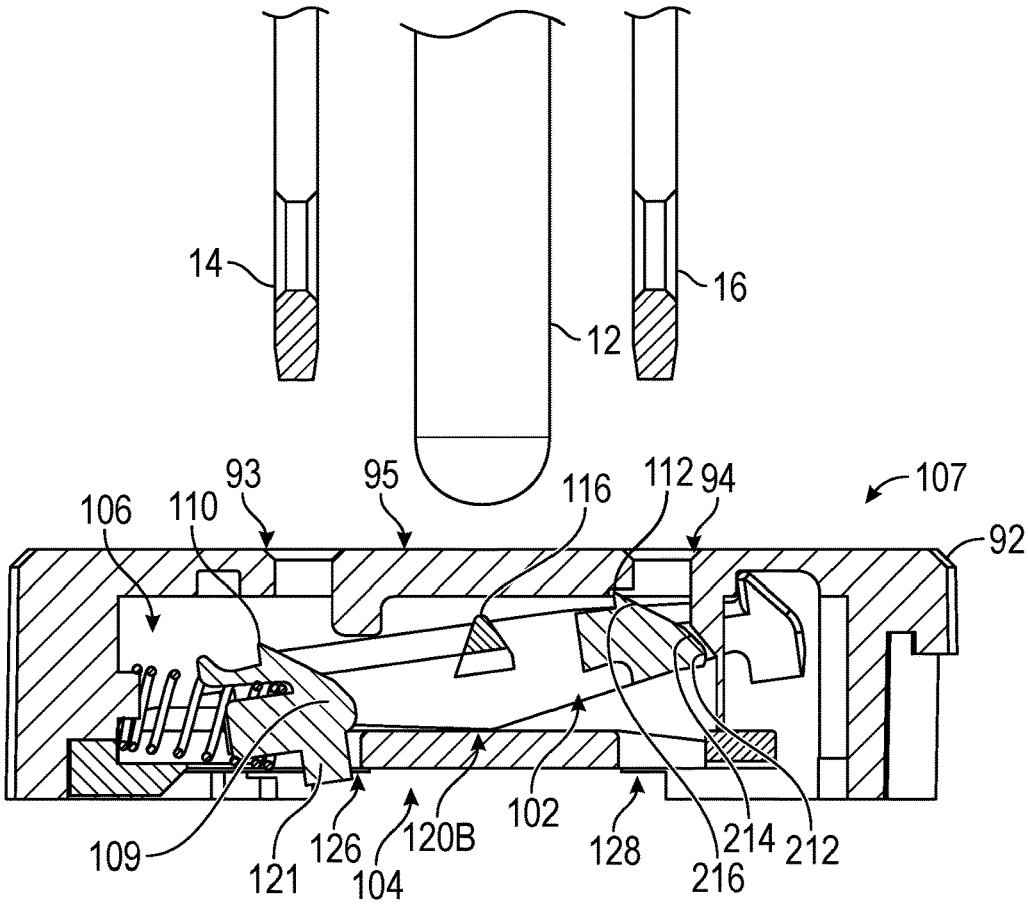
FIG. 8G shows the protection arrangement shown in FIG. 8B prior to insertion of a plug into the individual outlet cover, with the spring of the shutter assembly disposed at an incline due to buckling of the spring in its default state, in contrast to the horizontal disposition of the spring shown in FIG. 8A, in accordance with an exemplary embodiment of the disclosed concept.

Referring now to FIG. 8G, as well as FIG. 8A, both FIGS. 8G and 8A show shutter assembly 100 disposed in a default state, the default state of shutter assembly 100 being that in which objects are not inserted through the slots of individual outlet cover 92 and are not pushing against any of the surfaces 202, 204, 206, 212, 214, 216 of first block 109 or second block 111 of shutter 102. FIG. 8A shows front surfaces 201B, 211B of shutter 102 disposed substantially parallel to the portion of the front surface of base clip 104 that lies between the hot opening 126 and the neutral opening 128 when shutter assembly 100 is disposed in its default state. It is possible, however, for a spring 106 to buckle when shutter assembly 100 is disposed in its default state due to the V shape of fulcrum 120 such that shutter 102 is disposed in an inclined position as shown in FIG. 8G instead of the horizontal position shown in FIG. 8A. As detailed further with respect to FIGS. 8H and 8I below, even if the spring 106 buckles when assembly 100 is in the default state, the assembly 100 still functions as shown in FIGS. 8B-8F.

Figure 8H:
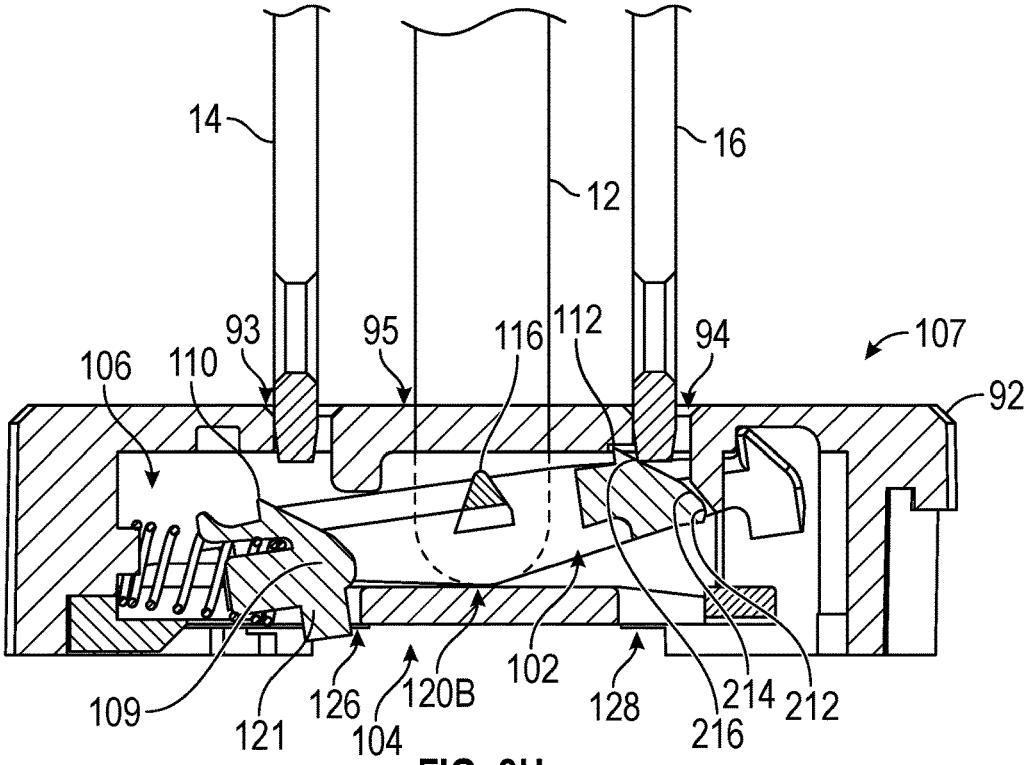
FIG. 8H shows the protection arrangement shown in FIG. 8G after the plug prongs have been pushed further into the hot and neutral slots of the individual outlet cover and the neutral prong is in initial engagement with the front-most sloped surface of a blocking mechanism of the shutter, in accordance with an exemplary embodiment of the disclosed concept.
Figure 8I:
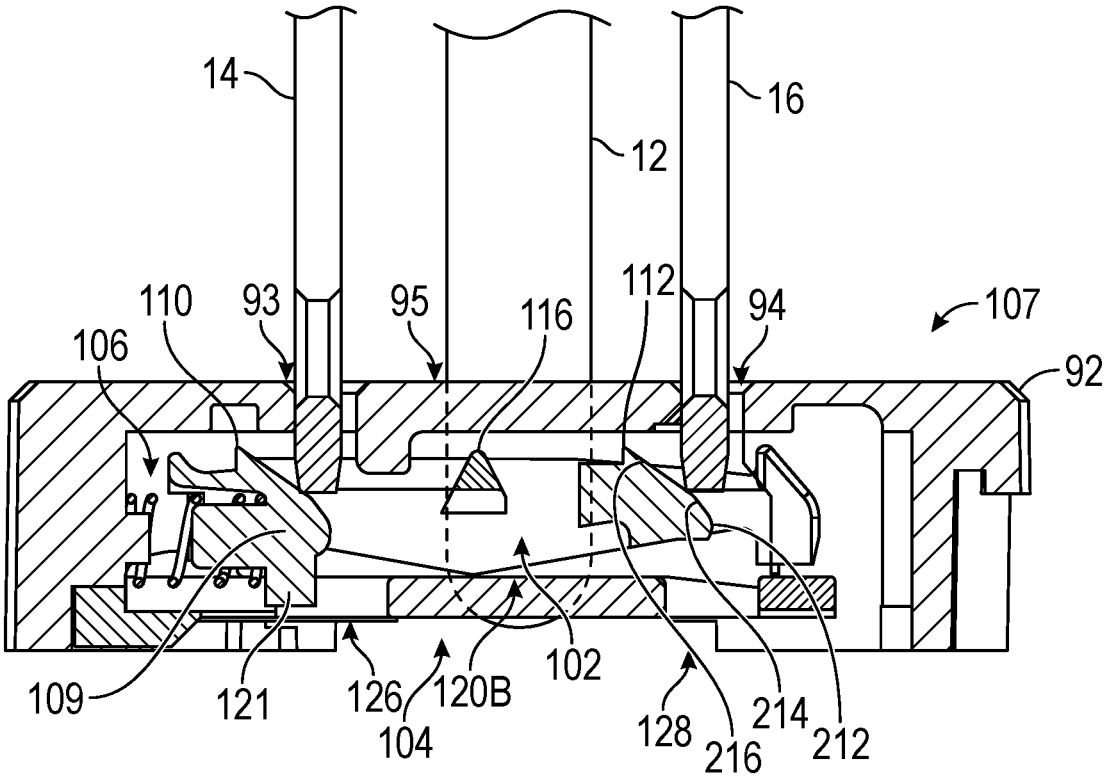
FIG. 8I shows the protection arrangement shown in FIG. 8H after the plug prongs have been pushed further into the hot and neutral slots of the individual outlet cover and the neutral prong has further engaged the front-most sloped surface of the blocking mechanism of the shutter it engaged in FIG. 8H in order to bring the shutter to a more horizontal disposition, in accordance with an exemplary embodiment of the disclosed concept.

Still referring to FIG. 8G, the components of the shutter assembly 100 and individual outlet cover 92 are proportioned such that, if a spring 106 buckles when the shutter assembly 100 is in its default state, the rear portion of the spring mount base 121 remains confined within the hot opening 126 of base clip 104 and the third shelf 112 of the shutter 102 rests against the rear side of the individual outlet cover 92. Referring now to FIGS. 8H and 8I, FIG. 8H shows the neutral prong 16 of plug 10 making initial contact with the third sloped surface 216 of block 211 of shutter 102 as the hot and neutral prongs 14, 16 of plug 10 are initially inserted into the hot and neutral slots 93, 94 of individual outlet cover 92, and FIG. 8I shows how the neutral prong 16 changes the disposition of the shutter 102 after the hot and neutral prongs 14, 16 are inserted even further into the hot and neutral slots 93, 94 than shown in FIG. 8H. In FIG. 8I, the first shelf 110 of first block 109 of shutter 102 has moved closer toward hot prong 14 from its position in FIG. 8H. As with FIGS. 8A-8F, the shutter assembly 100 would still function as shown in FIGS. 8G-8I if a two-pronged ungrounded plug such as plug 18 were inserted into the assembly instead of the three-pronged plug 10.

As demonstrated by the change of position of shutter 102 between FIG. 8H and FIG. 8I, when the hot and neutral prongs 14, 16 of a plug 10 are inserted into the hot and neutral slots 93, 94 of the individual outlet cover 92 and the neutral prong 16 pushes against the third sloped surface 216 of the shutter 102, the slope of the third sloped surface 216 and the shape of the fulcrum 120 (only fulcrum surface 120B is visible in the view shown in FIGS. 8A-8I) cause the shutter 102 to reorient itself toward the disposition shown in FIG. 8B, i.e. the disposition in which front surfaces 201B, 211B of shutter 102 are disposed substantially parallel to the portion of the front surface of base clip 104 that lies between the hot opening 126 and the neutral opening 128. The material(s) from which shutter 102 and base clip 104 are each produced also influence the ability of shutter 102 to reorient itself toward the disposition shown in FIGS. 8A and 8B, as producing shutter 102 and base clip 104 from a material that is sufficiently smooth to minimize the friction between the fulcrum 120 and base clip 104 and sufficiently durable to prevent gouging of base clip 104 as fulcrum 120 slides across it enables the shutter 102 to reorient itself from a buckled disposition as shown in FIG. 8G to a parallel disposition as shown in FIG. 8B with minimal resistance in an exemplary embodiment of the disclosed concept.

It will be appreciated that, in addition to influencing the ability of the shutter 102 to reorient itself as depicted in FIGS. 8H and 8I, minimizing the friction between the shutter 102 and the base clip 104 increases the general ability of the shutter 102 to perform as depicted with respect to all FIGS. 8A-8I, 9A-9D, 10A-10D, and 11A-11D. Furthermore, as previously detailed with respect to FIG. 6F, the design of the side curvatures 225, 227 of the shutter 102 significantly reduces the surface area of the sides of the shutter 102 with which the individual outlet cover 92 is in contact, further minimizing the friction between the shutter 102 and the individual outlet cover 92 when the shutter assembly 100 is engaged by an electrical plug as detailed with respect to FIGS. 8A-8I above or by a non-plug object as detailed with respect to FIGS. 9A-9D, 10A-10D, and 11A-11D below.

In addition to the components of the shutter assembly 100 and individual outlet cover 92 being proportioned to ensure that the shutter assembly 100 functions as shown in FIGS. 8B-8G whether or not spring 106 buckles in the default state, the components of shutter assembly 100 and individual outlet cover 92 are also proportioned to ensure that the components of shutter assembly 100 function as shown in FIGS. 8A-8I when there are variations in the distance between the position of the hot prong 14 and the neutral prong 16 of a plug relative to the hot and neutral slots 93, 94 of the individual outlet cover 92. As shown in FIGS. 8A-8I, the hot and neutral slots 93, 94 of individual outlet cover 92 are somewhat wider than the hot and neutral prongs 14, 16, resulting in a gap between the edges of the hot slot 93 and the edges of the hot prong 14, as well as a gap between the edges of the neutral slot 94 and the edges of the neutral prong 16. Referring briefly back to FIG. 5A, a distance $d_{min}$ marked on the individual outlet cover 92 represents the minimum distance that the inner edge of a hot prong 14 and the inner edge of a neutral prong 16 can be spaced apart in order for a plug to fit into the individual outlet cover 92, while a distance $d_{max}$ represents the maximum distance that the outer edge of a hot prong 14 and the outer edge of a neutral prong 16 can be spaced apart in order for a plug to fit into the individual outlet cover 92. FIGS. 8A-8I show a plug 10 whose hot and neural prongs 14, 16 are spaced apart a distance that falls between distance $d_{min}$ and distance $d_{max}$, as the outer edge of hot prong 14 is adjacent to the outer edge of the hot slot 93 of individual outlet cover 92 while the inner edge of neutral prong 16 is adjacent to the inner edge of the neutral slot 94 of individual outlet dover 92, but the shutter assembly 100 is structured to function as shown in FIGS. 8B-8G with plugs whose hot and neutral prongs 14, 16 are spaced apart any distance in the range from distance $d_{min}$ to distance $d_{max}$.

Figure 9A:
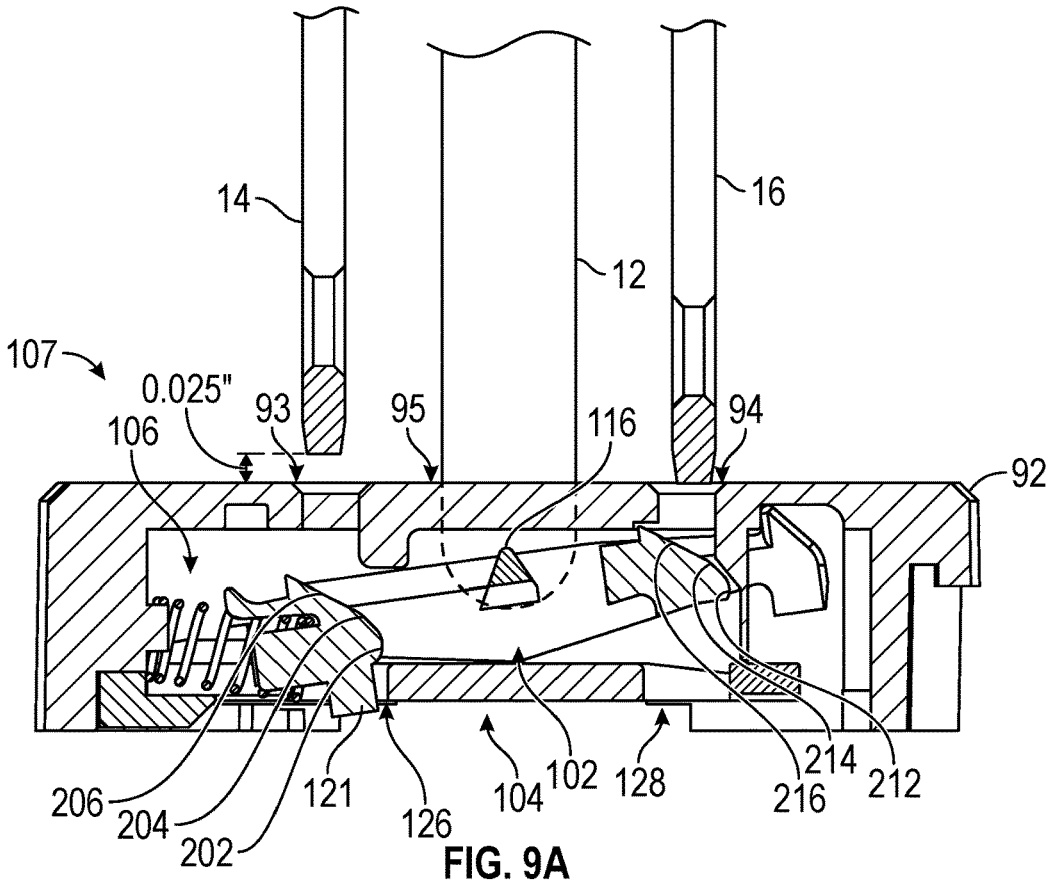
FIG. 9A shows the protection arrangement shown in FIG. 8G prior to insertion of a plug into the individual outlet cover, wherein the hot prong of the plug is shorter than the neutral prong of the plug by 0.025 inches and wherein the hot and neutral prongs are spaced the maximum distance apart that enables the shutter assembly to work as intended, in accordance with an exemplary embodiment of the disclosed concept.
Figure 9B:
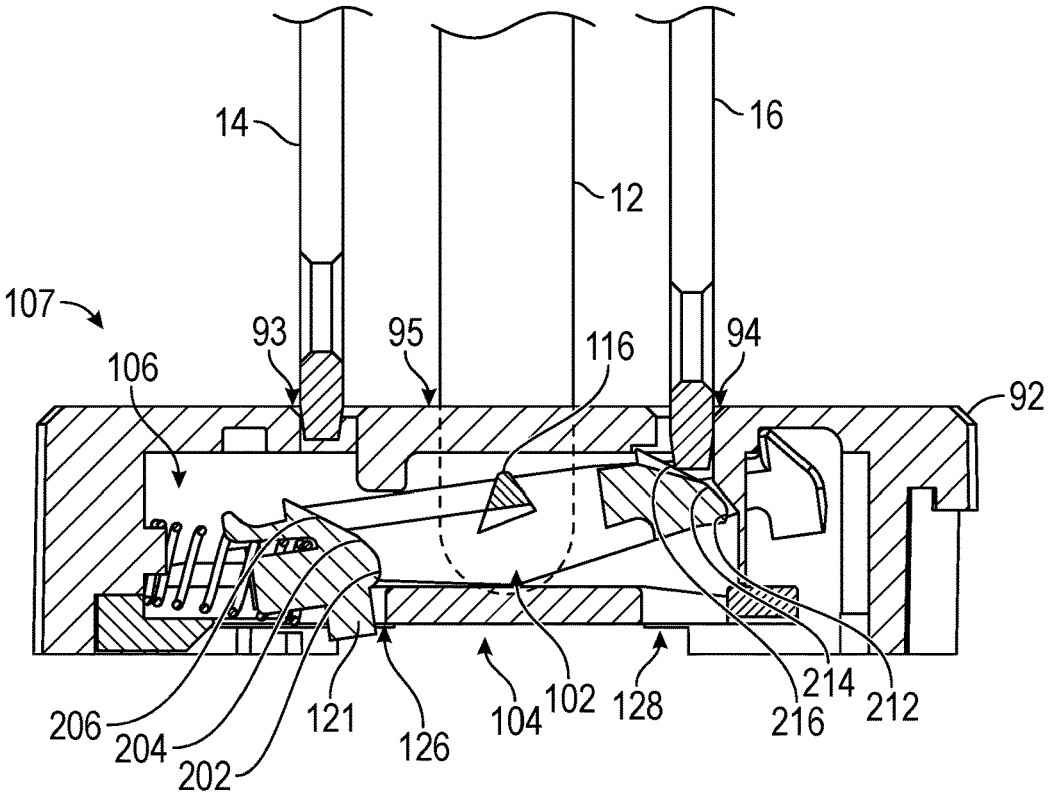
FIG. 9B shows the protection arrangement shown in FIG. 9A, after the plug prongs have been pushed further into the hot and neutral slots of the individual outlet cover and the neutral prong is in initial engagement with the front-most sloped surface of a blocking mechanism of the shutter, in accordance with an exemplary embodiment of the disclosed concept.
Figure 9C:
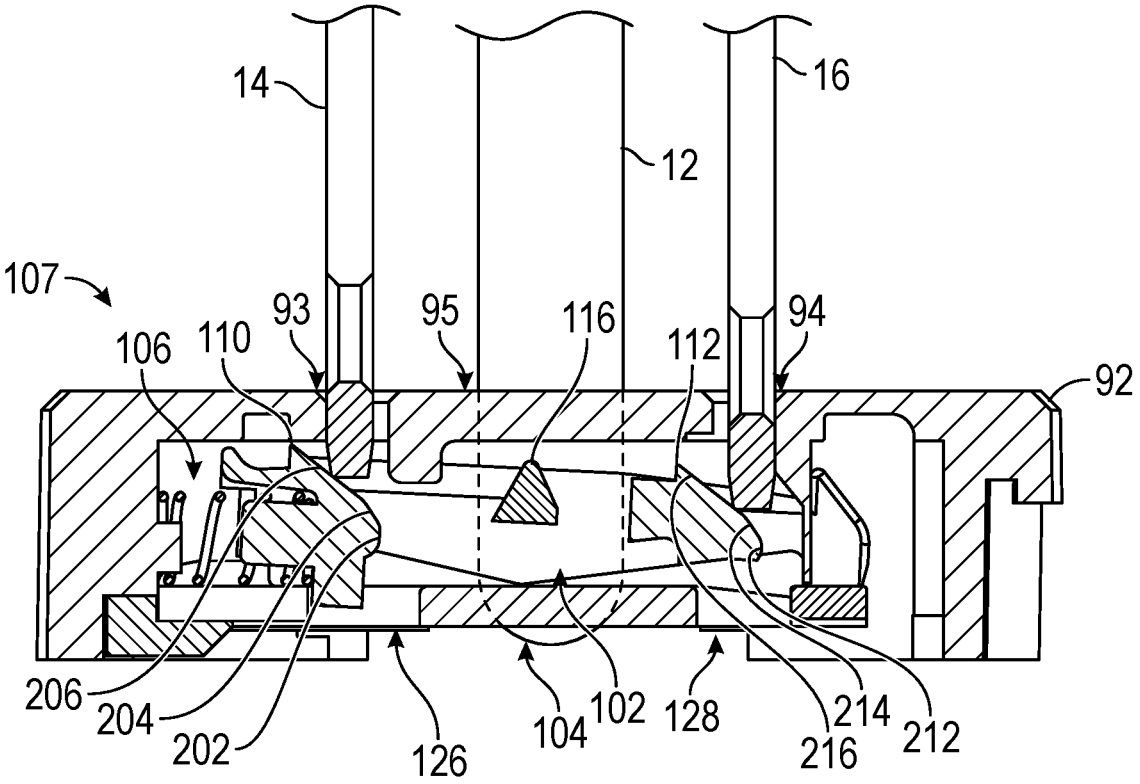
FIG. 9C shows the protection arrangement shown in FIG. 9B after the plug prongs have been pushed further into the hot and neutral slots of the individual outlet cover and the neutral prong has further engaged the front-most sloped surface of the blocking mechanism of the shutter that was engaged in FIG. 9B, in order to bring the shutter to a more horizontal disposition to enable the hot prong to engage the other blocking mechanism, in accordance with an exemplary embodiment of the disclosed concept.
Figure 9D:
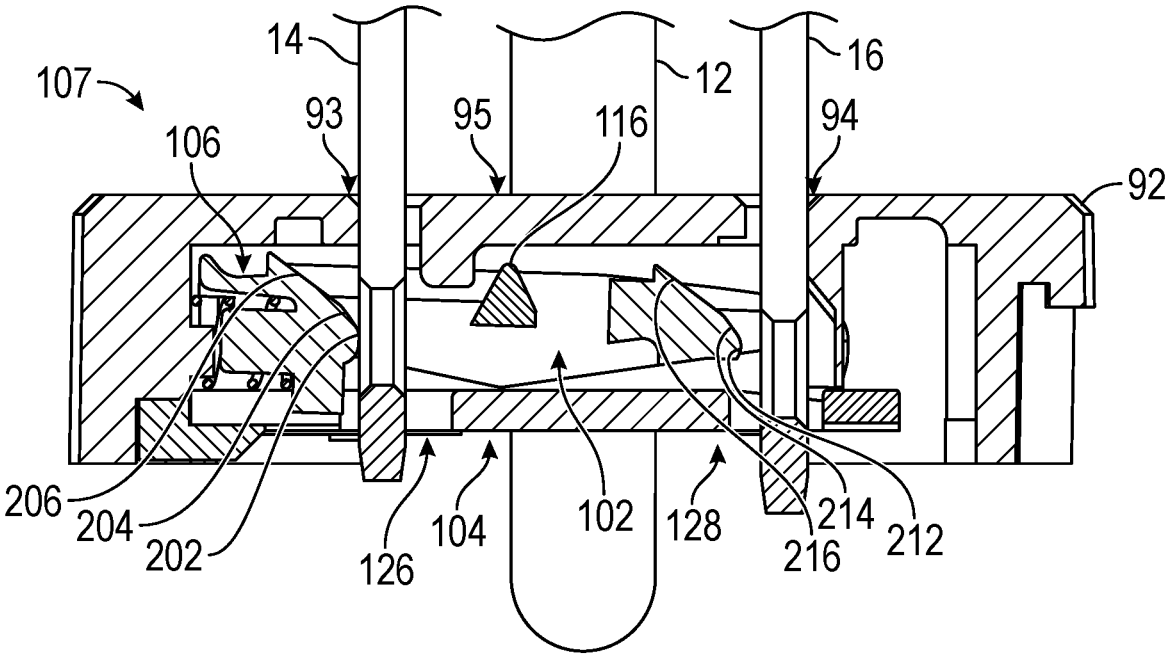
FIG. 9D shows the protection arrangement shown in FIG. 9C after the plug prongs have been pushed further into the hot and neutral slots of the individual outlet cover and have successfully moved the blocking mechanisms of the shutter out of the path of the hot and neutral openings in the base clip that allow the prongs to access the live electrical terminals of the electrical receptacle arrangement shown in FIG. 5A, in accordance with an exemplary embodiment of the disclosed concept.

Furthermore, referring to FIGS. 9A-D and FIGS. 10A-10D, the components of shutter assembly 100 and individual outlet cover 92 are also proportioned to ensure that the components of shutter assembly 100 function as shown in FIGS. 8A-8I when there are variations of up to 0.025 inches between the length of the hot prong 14 and neutral prong 16. Referring first to FIG. 9A, a plug 10 with a hot prong 14 that is 0.025 inches shorter than the neutral prong 16 is depicted. In addition, the hot prong 14 and hot prong 16 are spaced a distance $d_{max}$ apart (distance $d_{max}$ being depicted in FIG. 5A). FIG. 9B depicts hot and neutral prongs 14, 16 being inserted into hot and neutral slots 93, 94 and the neutral prong 16 of plug 10 making initial contact with the third sloped surface 216 of block 111 of shutter 102. FIG. 9C depicts how the force exerted by neutral prong 16 against the third sloped surface 216 of second block 111 changes the disposition of the shutter 102 after the hot and neutral prongs 14, 16 are inserted even further into the hot and neutral slots 93, 94 than shown in FIG. 9B, and FIG. 9D depicts how inserting the hot and neutral prongs 14, 16 far enough into the hot and neutral slots 93, 94 to push against the surfaces of blocks 109, 111 causes spring 106 to compress enough to make the hot and neutral openings 126, 128 of base clip 104 accessible to the hot and neutral prongs 14, 16 of plug 10.

Figure 10A:
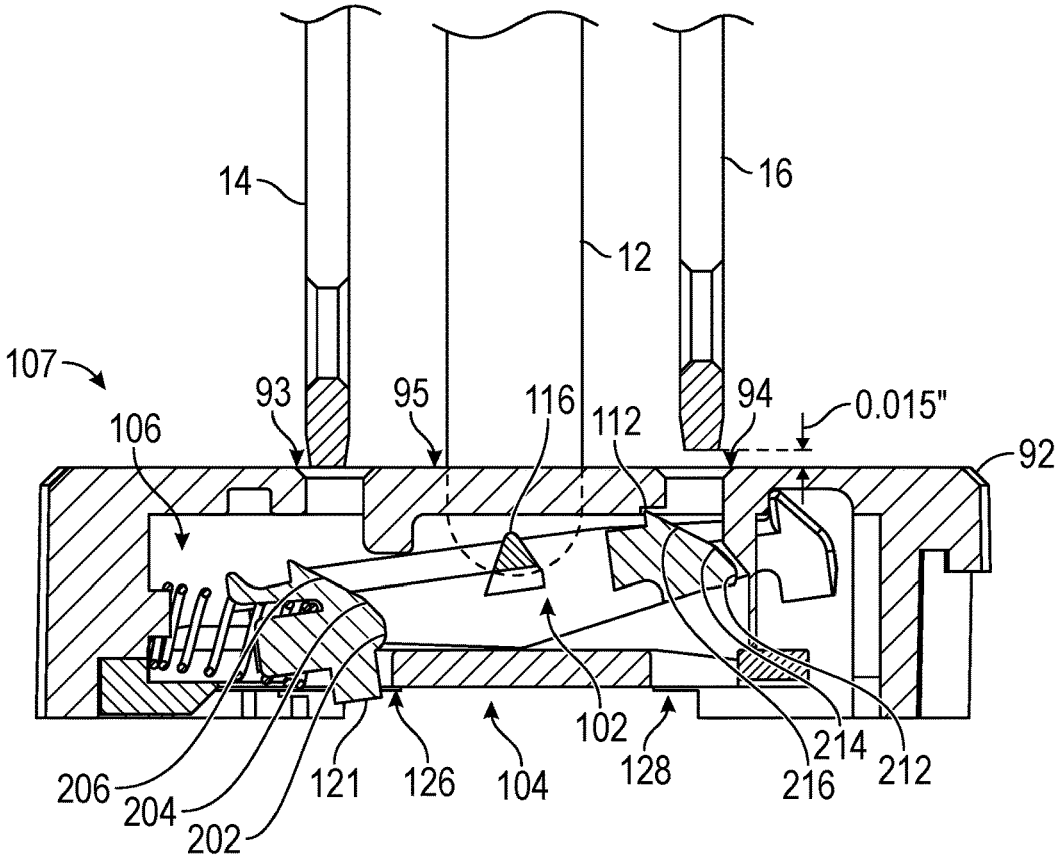
FIG. 10A shows the protection arrangement shown in FIG. 8G prior to insertion of a plug into the individual outlet cover, wherein the neutral prong of the plug is shorter than the hot prong of the plug by 0.015 inches and wherein the hot and neutral prongs are spaced the maximum distance apart that enables the shutter assembly to work as intended, in accordance with an exemplary embodiment of the disclosed concept.
Figure 10B:
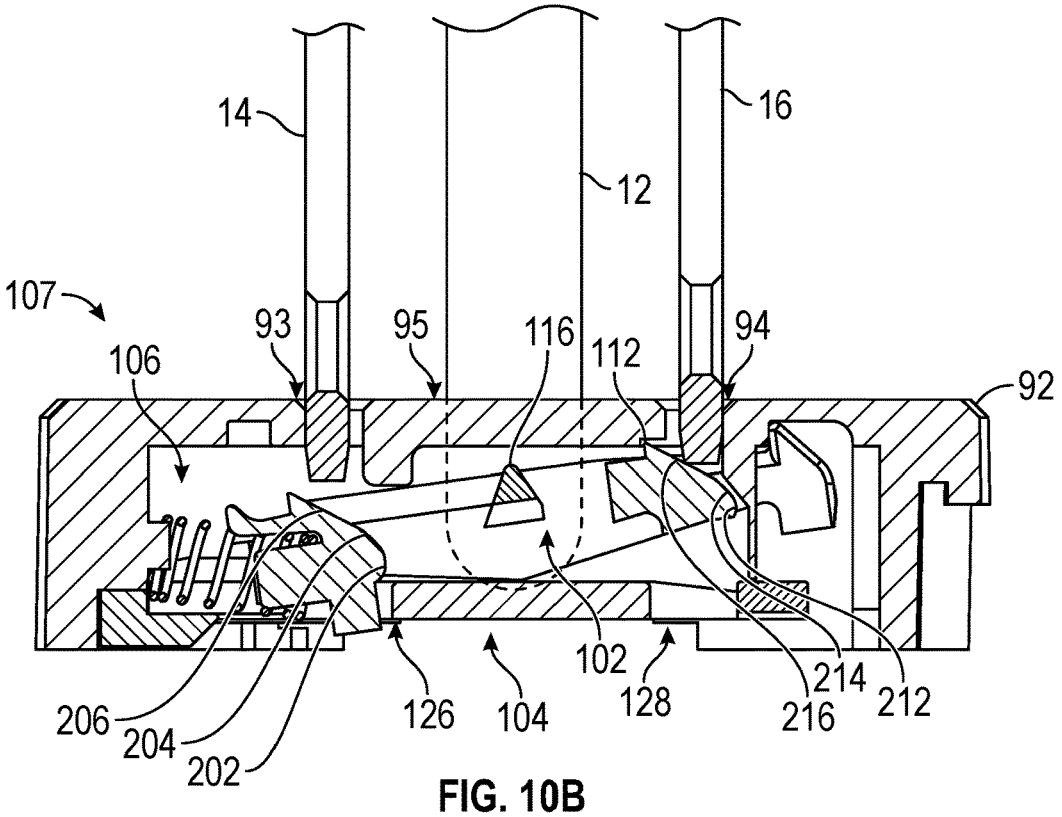
FIG. 10B shows the protection arrangement shown in FIG. 10A, after the plug prongs have been pushed further into the hot and neutral slots of the individual outlet cover and the neutral prong is in initial engagement with the front-most sloped surface of a blocking mechanism of the shutter, in accordance with an exemplary embodiment of the disclosed concept.

Referring now to FIG. 10A, a plug 10 with a neutral prong 16 that is 0.015 inches shorter than the hot prong 14 is depicted. In addition, the hot prong 14 and hot prong 16 are spaced a distance $d_{max}$ apart (distance $d_{max}$ being depicted in FIG. 5A). FIG. 10B depicts hot and neutral prongs 14, 16 being inserted into hot and neutral slots 93, 94 and the neutral prong 16 of plug 10 making initial contact with the third sloped surface 216 of first block 111 of shutter 102. It will be appreciated that, when hot prong 14 is longer than neutral prong 16, hot prong 14 is disposed noticeably closer to the third sloped surface 206 of first block 109 of shutter 102 when the neutral prong 16 makes initial contact with the third sloped surface 216 than when the hot prong 14 is shorter than neutral prong 16 (as shown in FIG. 9B) or when hot prong 14 is the same length as neutral prong 16 (as shown in FIG. 8B or 8H).

Figure 10C:
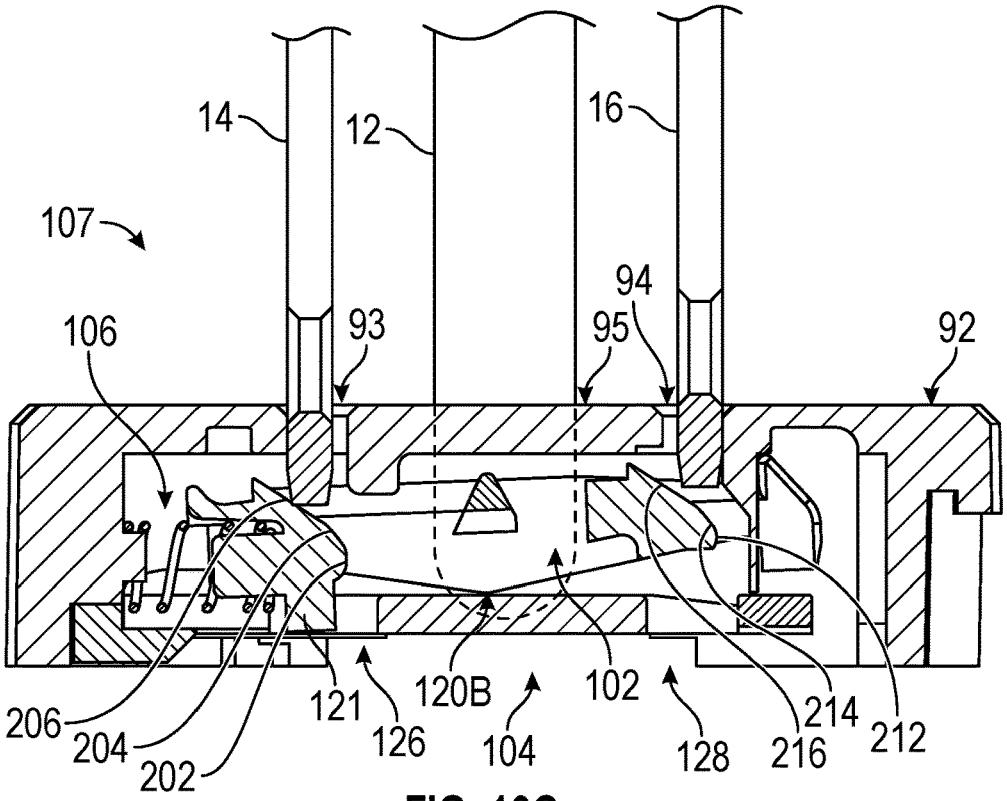
FIG. 10C shows the protection arrangement shown in FIG. 10B after the plug prongs have been pushed further into the hot and neutral slots of the individual outlet cover and the neutral prong has further engaged the front-most sloped surface of the blocking mechanism of the shutter that was engaged in FIG. 9B, in order to bring the shutter to a more horizontal disposition to enable the hot prong to engage the other blocking mechanism after the neutral prong loses engagement with the blocking mechanism it was previously engaged with, in accordance with an exemplary embodiment of the disclosed concept.
Figure 10D:
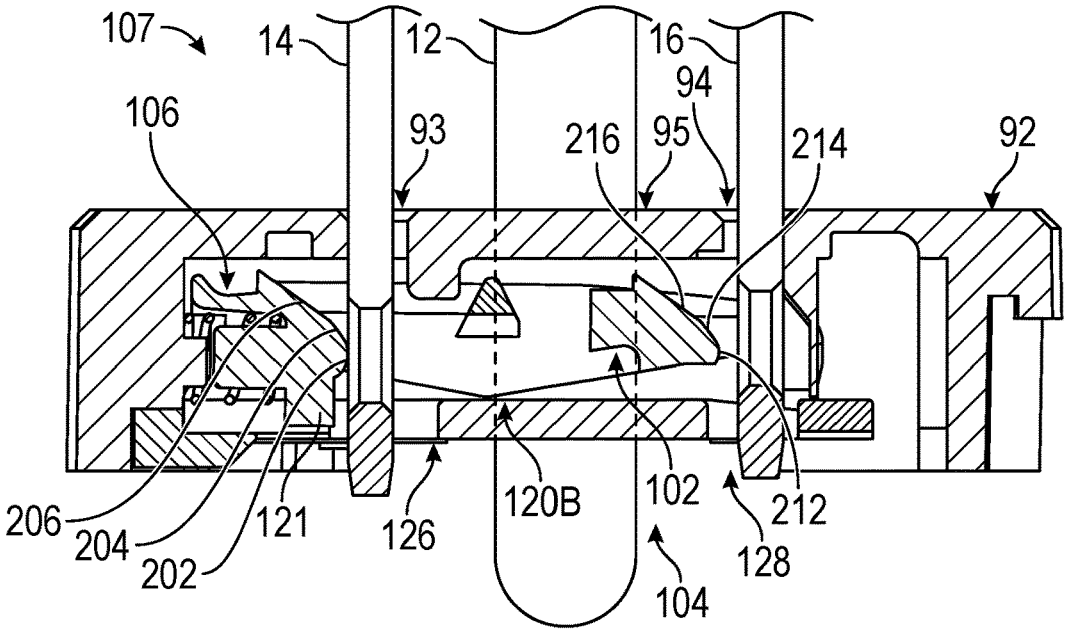
FIG. 10D shows the protection arrangement shown in FIG. 10C after the plug prongs have been pushed further into the hot and neutral slots of the individual outlet cover and have successfully moved the blocking mechanisms of the shutter out of the path of the hot and neutral openings in the base clip that allow the prongs to access the live electrical terminals of the electrical receptacle arrangement shown in FIG. 5A, in accordance with an exemplary embodiment of the disclosed concept.

FIG. 10C depicts how, after neutral prong 16 exerts enough force against the third sloped surface 216 of second block 211 to change the disposition of the shutter 102 such that the hot prong 14 makes contact with the third sloped surface 206 of first block 109 of shutter 109 after the hot and neutral prongs 14, 16 are inserted even further into the hot and neutral slots 93, 94 than shown in FIG. 10B, the neutral prong 16 loses contact with the surface of second block 111 of shutter 102 while hot prong 14 remains in contact with the surface of first block 109. FIG. 10D depicts how inserting the hot and neutral prongs 14, 16 far enough into the hot and neutral slots 93, 94 causes the hot prong 14 to push against the surface of first block 109 and cause the spring 106 to compress enough to make the hot and neutral openings 126, 128 of base clip 104 accessible to the hot and neutral prongs 14, 16 of plug 10.

After observing in FIGS. 8A-8I, 9A-9D, and 10A-10D how the shutter assembly 100 enables a plug to access the hot opening 126 and the neutral opening 128 of base clip 104 even if one prong is slightly shorter than the other and for a distance between the hot and neutral prongs ranging from $d_{min}$ to $d_{max}$, it will be understood that, when a plug with approximately equal length hot and neutral prongs is properly inserted into the electrical receptacle arrangement 80, the shutter 102 will move aside to expose the hot and neutral openings 126, 128 of the base clip 104 if both the hot and neutral plug prongs are pushing against the front side of the first and second blocks 109, 111 of the shutter 102 simultaneously. However, FIGS. 9A-9D and 10A-10D show that even in situations where initially only one of the prongs is in contact with its corresponding blocking mechanism 109 or 111 (due to, for example and without limitation, one plug prong being slightly shorter than the other and/or the space between the two prongs being a distance of $d_{max}$), inserting the plug further into the individual outlet cover 92 enables the other plug prong to subsequently engage its corresponding blocking mechanism 111 or 109 due to the fulcrum 120 of shutter 102 enabling shutter 102 to pivot and slide against the front surface of base clip 104. When one plug prong is slightly shorter than the other, shutter 102 can move aside to expose the hot and neutral openings 126, 128 of the base clip 104 because the front surfaces 201A, 201B, 211A, 211B of shutter 102 are disposed substantially parallel, i.e. no more than 3° offset from parallel, to the plane containing the front surface of the individual cover 92 (which is parallel to the plane containing the front surface of the base clip 104).

Figure 11A:
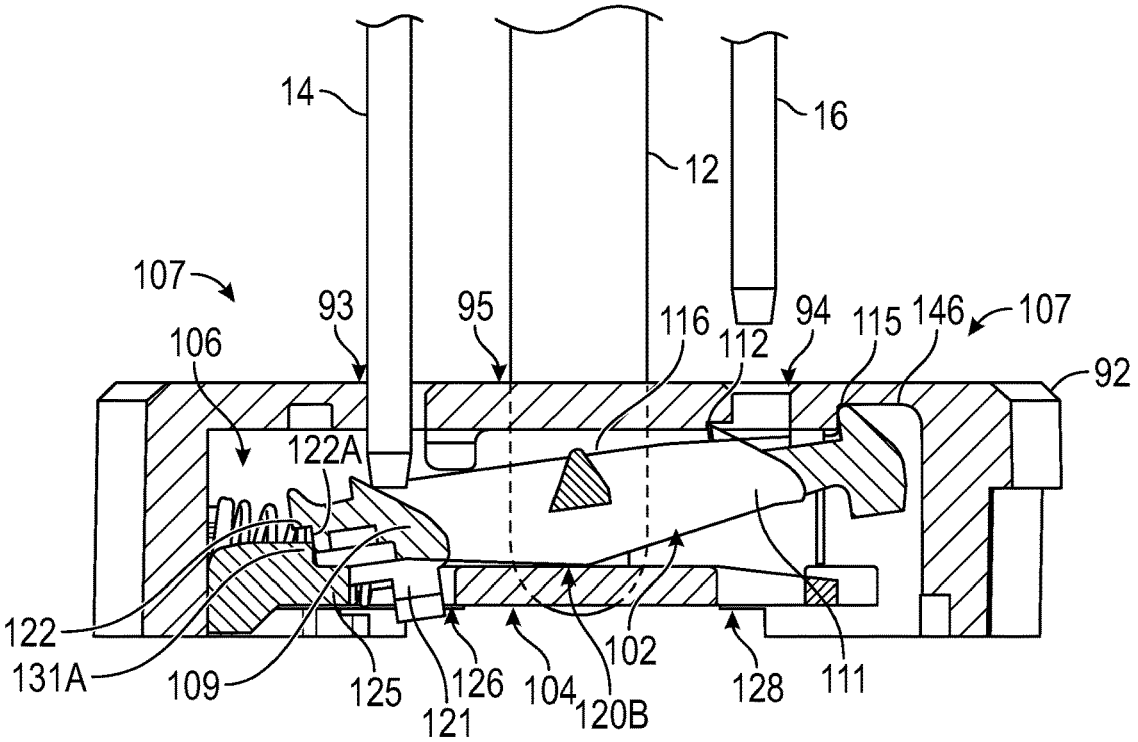
FIG. 11A shows the protection arrangement shown in FIG. 8A after an object has been inserted into the hot slot of the individual outlet cover at an angle substantially orthogonal to the front of the individual outlet cover and no object has been inserted into the neutral slot, with multiple features of the shutter assembly and outlet cover engaged to block the path between hot and neutral slots of the individual outlet cover and the hot and neutral openings of the base clip, in accordance with an exemplary embodiment of the disclosed concept.

In the situation of the neutral prong being shorter than the hot prong as shown in FIGS. 10A-10D, shutter 102 can only slide to compress the spring 106 if the shutter vertical walls 122A, 122B (shown in FIG. 6E) are able to clear the height of the first and second stoppers 131A, 131B of base clip 104 (shown in FIG. 6G), which is determined by the distance X that stoppers 131A, 131B extend from main body 125 of base clip 104 (distance X relative to main body 125 is shown in FIG. 6G). Accordingly, distance X is carefully chosen to enable the shutter vertical walls 122A, 122B to clear the stoppers 131A, 131B in order to accommodate plugs with a neutral prong slightly shorter than the hot prong. In contrast, the interaction between the shutter vertical walls 122A, 122B and the base clip stoppers 131A, 131B when the vertical walls 122A, 122B are not able to clear the stoppers 131A, 131B (due, for example, to improper insertion of an object into the individual outlet cover 92) is shown in FIG. 11A (only wall 122A and stopper 131A are visible in the view shown in FIG. 11A). FIG. 11A is described in more detail herein below.

Whereas FIGS. 8A-8I, 9A-9D, and 10A-10D show how the prongs of a standard plug can access live electrical terminals through the shutter assembly 100, FIGS. 11A-11D show how shutter assembly 100 prevents any object not resembling a standard plug from accessing the hot and neutral slots 130, 132 in base clip 104 and accordingly prevents such an object from accessing the live electrical terminals of an electrical receptacle arrangement 80, in accordance with some exemplary embodiments of the disclosed concept. Referring first to FIG. 11A, when an object (a hot plug prong 14 much longer than its corresponding neutral prong 16 is shown) enters the hot slot 93 of the outlet cover 92 and no other object simultaneously enters the neutral slot 94 such that only the first block 109 of the shutter 102 is being pushed from the front side, the fulcrum 120 of shutter 102 causes the shutter 102 to act as a lever such that shutter 102 pivots about fulcrum 120 (only fulcrum surface 120B is visible in the view shown in FIG. 11A) and moves shutter 102 into the disposition shown in FIG. 11A. When shutter 102 so pivots, three sets of features engage to block the hot path between hot slot 93 of individual outlet cover 92 and hot opening 126 of base clip 104, and the neutral path between the neutral slot 94 of individual outlet cover 92 and the neutral opening 128 of base clip 104. First, the overhang 122 and the vertical walls 122A,122B on the rear side of shutter 102 (previously shown in FIG. 6E) abut against the stoppers 131A and 131B on the front side of base clip 104 (previously shown in FIG. 6G), although it will be appreciated that only stopper 131A can be seen in the view shown in FIG. 11A. Second, the fourth and fifth shelves 114, 115 (previously shown in FIG. 6C) engage the second and third divots 144, 146 in individual outlet cover 92 (previously shown in FIG. 7A), although it will be appreciated that only fifth shelf 115 can be seen in the view shown in FIG. 11A. Third, the third shelf 112 of shutter 102 (also shown in FIG. 6C) abuts against the rear side of outlet cover 92. It should be noted that that the shutter assembly 100 moves to the disposition shown in FIG. 11A when an object is inserted in the hot prong 93 of individual outlet cover 92 regardless of whether the shutter assembly default state is the horizontal position shown in FIG. 8A or the inclined position as shown in FIG. 8G.

Figure 11B:
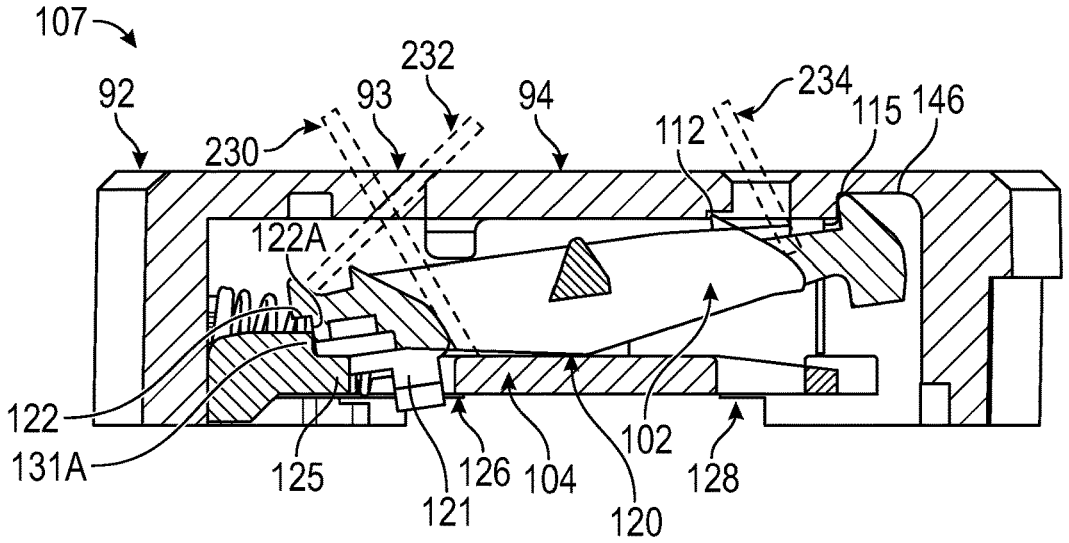
FIG. 11B shows the protection arrangement shown in FIG. 8A, and how the same features of the shutter assembly and outlet cover that engage in FIG. 11A to block the path between hot and neutral slots of the individual outlet cover and the hot and neutral openings of the base clip also engage when an object is inserted into either of the hot slot or the neutral slot of the individual outlet cover at various angles not orthogonal to the front of the individual outlet cover, in accordance with an exemplary embodiment of the disclosed concept.

In FIG. 11A, the object inserted through the hot slot 93 was inserted at an angle generally orthogonal to the surface of the individual outlet cover 92, but the shutter assembly 100 is also structured to prevent objects from accessing the live electrical terminals when such objects are inserted through the hot slot 93 or neutral slot 94 at an angle non-orthogonal to the front side of the individual outlet cover 92 as well. Referring now to FIG. 11B (which shows the perspective of the electrical receptacle protection arrangement 107 shown in FIG. 8A), three tilted paths 230, 232, 234 representing three of the possible ways in which a non-plug object can be inserted into one of the hot or neutral slots 93, 94 at an angle non-orthogonal to the front side of individual outlet cover 92 are drawn in phantom line. The shutter assembly 100 is structured to prevent an object inserted into either one of the hot or neutral slots 93, 94 following any one of the three tilted paths 230, 232, 234 from accessing the live electrical terminals through shutter assembly 100. It will be appreciated when comparing FIG. 11B with FIG. 11A that the same three sets of features that engage to block the hot path between the hot slot 93 of individual outlet cover 92 and the hot opening 126 of base clip 104, and the neutral path between the neutral slot 94 of individual outlet cover 92 and the neutral opening 128 of base clip 104 when an object is inserted into the hot slot 93 an orthogonal angle, also engage when an object is inserted at non-orthogonal angles as indicated by the three tilted paths 230, 232, 234 depicted in FIG. 11B. In addition, it will be appreciated that overhang 122 prevents the spring 106 (not shown in FIG. 11B) from being accessed by an object that is inserted through the hot slot 93 following tilted path 232. Once again, it should be noted that the results shown in FIG. 11B occur regardless of whether the shutter assembly default state is the horizontal position shown in FIG. 8A or the inclined position as shown in FIG. 8G.

Figure 11C:
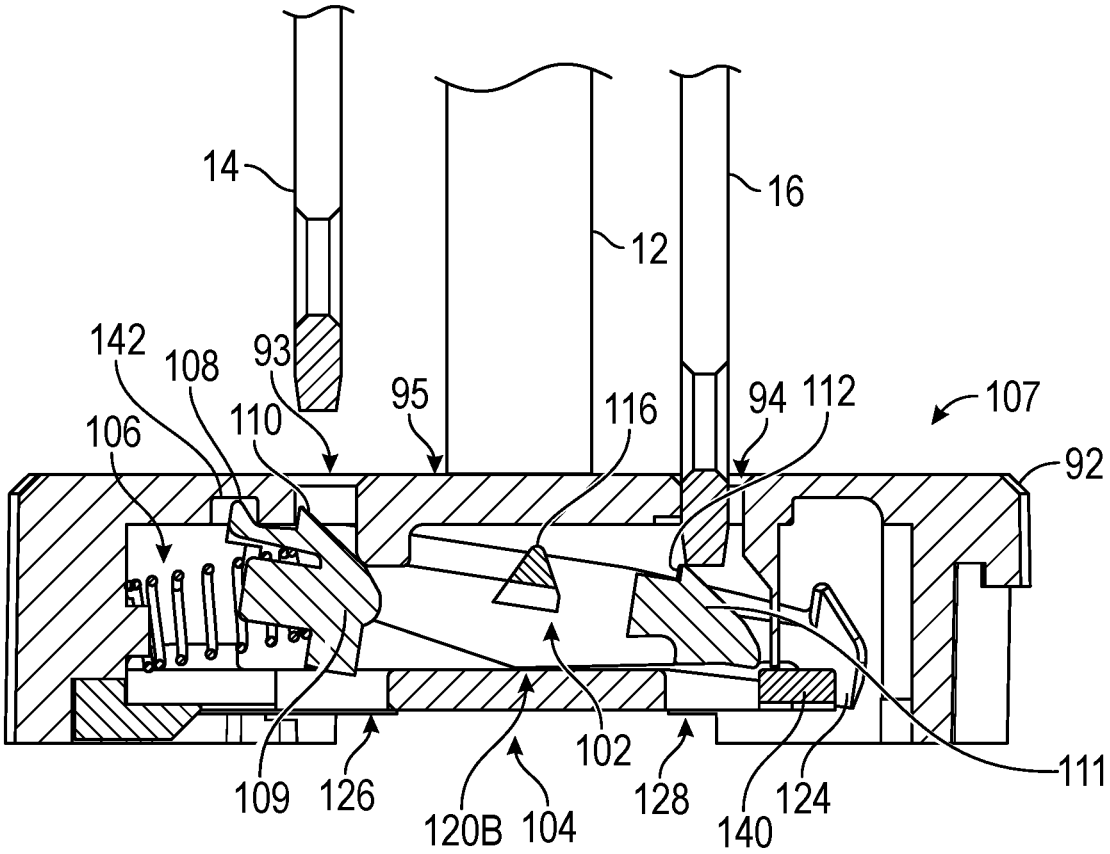
FIG. 11C shows the protection arrangement shown in FIG. 8A, with certain features of the base clip hidden in order to better view the features of the shutter, after an object has been inserted into the neutral slot of the individual outlet cover at an angle substantially orthogonal to the front of the individual outlet cover and no object has been inserted into the hot slot, with multiple sets of features of the shutter assembly and outlet cover engaged to block the path between hot and neutral slots of the individual outlet cover and the hot and neutral openings of the base clip, in accordance with an exemplary embodiment of the disclosed concept.

Referring now to FIG. 11C (in which certain features of the base clip 104 are hidden in order to better view the features of the shutter 102), when an object (a neutral plug prong 16 much longer than its corresponding hot prong 14 is shown) only enters the neutral slot 94 of the outlet cover 92 and no other object simultaneously enters the hot slot 93 such that only the second block 111 of the shutter 102 is being pushed from the front side, the fulcrum 120 (only fulcrum surface 120B is visible in the view shown in FIG. 11C) of shutter 102 again causes the shutter 102 to act as a lever and shutter 102 pivots about fulcrum 120 as shown. When shutter 102 so pivots, another three sets of locking features engage to block the neutral path between the neutral slot 94 of individual outlet cover 92 and the neutral opening 128 of base clip 104, and the hot path between the hot slot 93 of individual outlet cover 92 and the hot opening 126 of base clip 104. First, the first step 123 and second step 124 on the rear side of shutter 102 (previously shown in FIG. 6E) abut against vertical walls 137A and 139A aligned with ramps 137 and 139, respectively (previously shown in FIG. 6G). In the view shown in FIG. 11C, only second step 124 can be seen and it will be appreciated that ramp 139 and vertical wall 139A are obscured by bench arm 140. Second, the first shelf 108 of shutter 102 (previously shown in FIG. 6C) engages the first divot 142 in the rear side of individual outlet cover 92 (previously shown in FIG. 7A). Third, the second shelf 110 of shutter 102 (previously shown in FIG. 6C) abuts a side surface of interior outlet cover 92 forming a boundary of the hot slot 93. As noted in FIGS. 11A and 11B, should be noted that that the shutter assembly 100 moves to the disposition shown in FIG. 11C when an object is inserted in the neutral prong 94 of individual outlet cover 92 regardless of whether the shutter assembly default state is the horizontal position shown in FIG. 8A or the inclined position as shown in FIG. 8G.

Figure 11D:
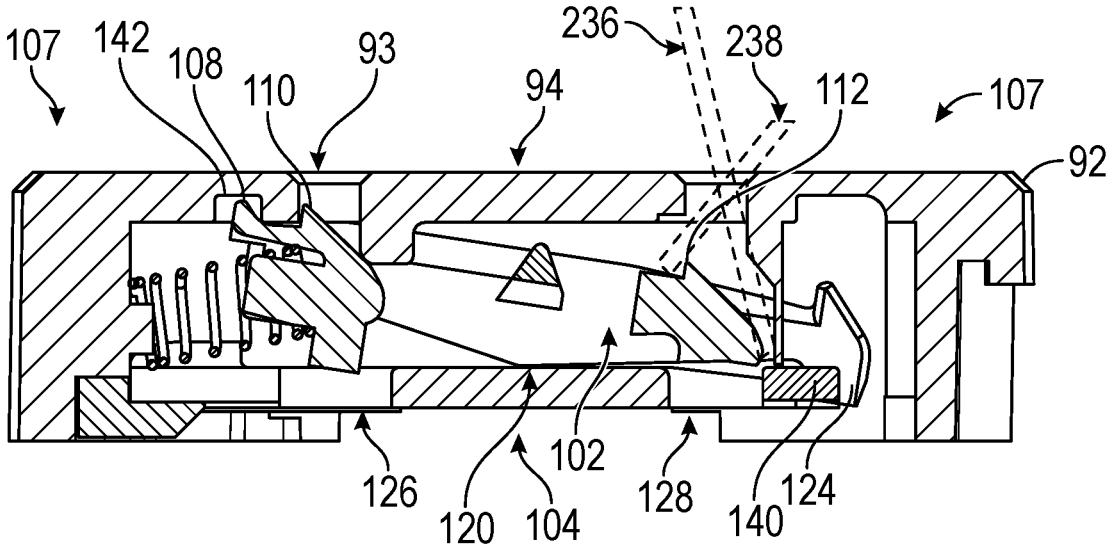
FIG. 11D shows the protection arrangement shown in FIG. 8A with certain features of the base clip hidden in order to better view the features of the shutter, and how the same features of the shutter assembly and outlet cover that engage in FIG. 11C to block the path between hot and neutral slots of the individual outlet cover and the hot and neutral openings of the base clip also engage when an object is inserted into the neutral slot of the individual outlet cover at various angles not orthogonal to the front of the individual outlet cover, in accordance with an exemplary embodiment of the disclosed concept.

In FIG. 11C, the object inserted through the neutral slot 94 was inserted at an angle generally orthogonal to the surface of the individual outlet cover 92, but the shutter assembly 100 is also structured to prevent objects from accessing the live electrical terminals when such objects are inserted through the neutral slot 94 or hot slot 93 at an angle non-orthogonal to the front side of the individual outlet cover 92 as well. Referring now to FIG. 11D (which shows the perspective of the electrical receptacle protection arrangement 107 shown in FIG. 8A), two tilted paths 236, 238 representing two of the possible ways in which a non-plug object can be inserted into the neutral slot 94 at an angle non-orthogonal to the front side of individual outlet cover 92 are drawn in phantom line. The shutter assembly 100 is structured to prevent an object inserted into either one of the neutral or hot slots 94, 93 following any one of the two tilted paths 236, 238 from accessing the live electrical terminals through shutter assembly 100. It will be appreciated when comparing FIG. 11D with FIG. 11C that the same three sets of features that engage to block the neutral path between the neutral slot 94 of individual outlet cover 92 and the neutral opening 128 of base clip 104, and the hot path between hot slot 93 of individual outlet cover 92 and hot opening 126 of base clip 104 when an object is inserted into the hot slot 93 an orthogonal angle, also engage when an object is inserted at non-orthogonal angles as indicated by the two tilted paths 236, 238 depicted in FIG. 11D. In addition, it should be noted once more that the results shown in FIG. 11D occur regardless of whether the shutter assembly default state is the horizontal position shown in FIG. 8A or the inclined position as shown in FIG. 8G.

Figure 12A:
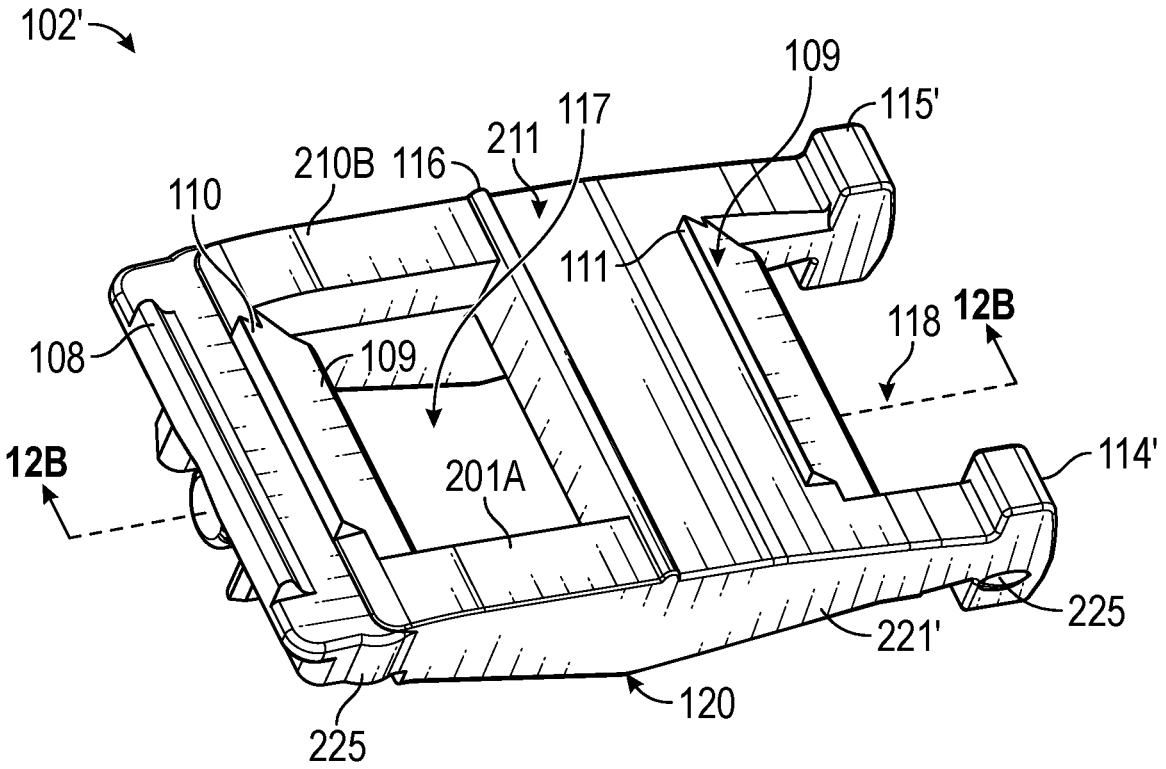
FIG. 12A is a partial isometric view of the front side of an alternative embodiment of the shutter component shown in FIG. 6C, in accordance with another exemplary embodiment of the disclosed concept.
Figure 12B:
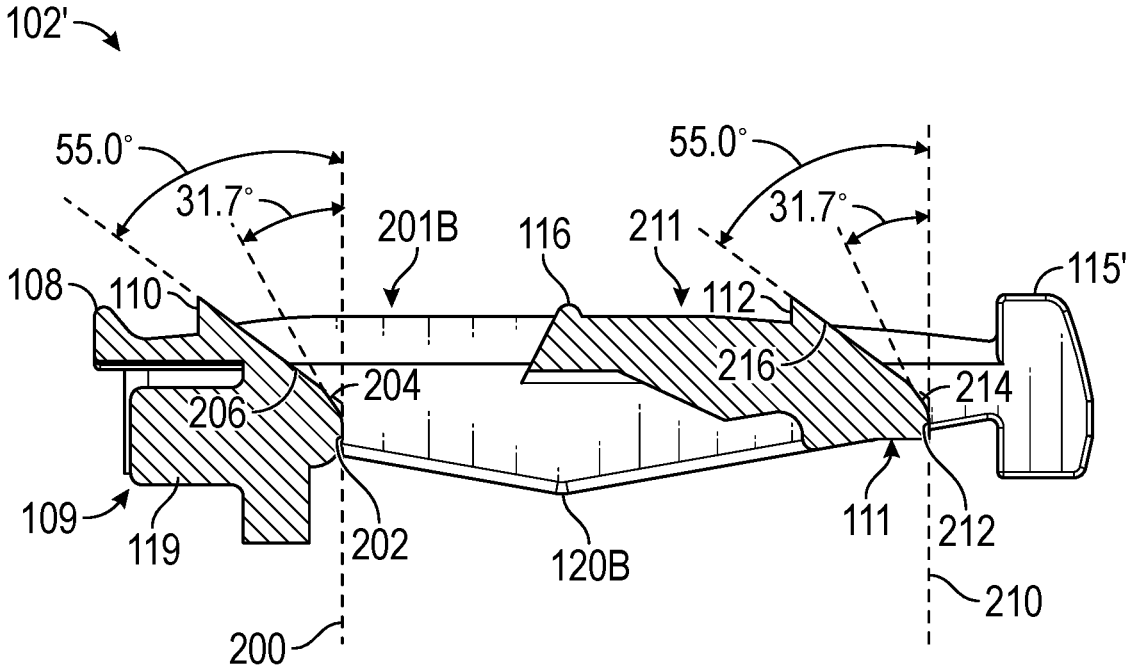
FIG. 12B is a sectional view of the shutter component shown in FIG. 12A as indicated by the line 12B-12B shown in FIG. 12A.

Referring to FIGS. 12A and 12B, in some exemplary embodiments of the disclosed concept, the shutter assembly 100 included in an electrical receptacle arrangement 80 may be produced using a shutter 102' instead of the shutter 102. FIG. 12B shows a sectional view of shutter 102' as indicated by the line 12B-12B in FIG. 12A. When viewed from the side perspective shown in FIGS. 12B and 6D, the front portion of the fourth shelf 114' and the front portion of the fifth shelf 115' of shutter 102' are flat (only the fifth shelf 115' is visible in the view shown in FIG. 12B) as opposed to being pointed like the front portion of fourth shelf 114 and the front portion of fifth shelf 115 of shutter 102 (only fifth shelf 115 is visible in the view shown in FIG. 6D). It will be appreciated that an individual outlet cover 92 included in an electrical receptacle arrangement 80 that includes a shutter 102' (such individual outlet cover 92 not being shown in the figures for economy of disclosure) instead of a shutter 102 includes a second divot 144' structured to seat and engage the flat fourth shelf 114' of shutter 102' and a third divot 146' structured to seat and engage the flat fifth shelf 115' of shutter 102', as opposed to the second divot 144 and the third divot 146 structured to receive the pointed fourth and fifth shelves 114, 115 of a shutter 102 (the second divot 144 and third divot 146 are shown numbered in FIGS. 7A, 11A, and 11B).

In addition to the fourth and fifth shelves 114', 115' of shutter 102' being flatter than the fourth and fifth shelves of 114, 115 of shutter 102, additional distinctions between shutter 102 and shutter 102' pertain to material that is cored out of a number of sections of shutter 102 in order to use consume less material than is used to produce shutter 102'. First, the material that is cored out of shutter 102 to form the gap between front surface 211A and 211B (shown in FIGS. 6D and 6F) is retained in shutter 102' as shown in FIG. 12A such that the front surface 211 of shutter 102' comprises only one continuous front surface 211 rather than the two portions 211A and 211B of shutter 102. Second, the material that is cored out of shutter 102 to form the gaps between the side surfaces 221 (shown in FIG. 6F) and the gaps between the side surfaces 223 (also shown in FIG. 6F) is retained in shutter 102' as shown in FIG. 12A such that the first side surface of shutter 102' comprises only one continuous first side surface 221' and the second side surface of shutter 102' comprises only one continuous second side surface 223' (not visible in the view shown in FIG. 12A) rather than the multiple side surfaces 221 and 223 of shutter 102.

As with the decision regarding which individual outlet cover 92, 92', or 92" and corresponding base clip 104 or 104' to include in the protection arrangement for the electrical receptacle 80, the decision regarding which shutter 102 or 102' to include is dictated by manufacturing and automated assembly targets. Including shutter 102 in the shutter assembly 100 instead of shutter 102' is preferable when reduced consumption of materials is desired (due to the coring out of the material that forms the gap between the front surfaces 211A and 211B and the coring out of the material that forms the gaps between the first side surfaces 221 and the second side surfaces 223), whereas including shutter 102' instead of shutter 102 is preferable when increased rigidity of the shutter is desired (due to retaining the material cored out of shutter 102). However, manufacturing a shutter 102' is simpler than manufacturing a shutter 102 due to manufacture of shutter 102' not requiring material to be cored out. It should be noted that when a shutter assembly 100 is coupled to an individual outlet cover 92 that includes second and third divots 144' and 146' structured for use with flat fourth and fifth shelves 114', 115', the shutter 102' functions in the same manner that the shutter 102 is depicted as functioning in FIGS. 8A-8I, 9A-9D, 10A-10D, and 11A-11D.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A tamper-resistant protection arrangement for an electrical receptacle, the protection arrangement comprising:
- a front cover;
- at least one number of individual outlet covers coupled to the front cover, each of the individual outlet covers including a front side and a rear side disposed opposite the front side, the at least one of the individual outlet covers comprising:
  - a spring coupling formation formed on the rear side;
  - a hot slot comprising an opening structured to receive a hot prong of an electrical plug; and
  - a neutral slot comprising an opening structured to receive a neutral prong of an electrical plug; and
- a shutter assembly coupled to the rear side of the at least one of the individual outlet covers, the shutter assembly comprising:
  - a shutter including a front side and a rear side disposed opposite the front side, the shutter comprising:
    - a spring mount formed at one end of the shutter;
    - a first blocking mechanism formed with a plurality of sloped surfaces;
    - a second blocking mechanism formed with a plurality of sloped surfaces; and
    - a fulcrum formed on the rear side of the shutter;
  - a base clip including a front side and a rear side disposed opposite the front side, the base clip comprising:
    - a main body including a hot opening structured to receive a hot prong of an electrical plug and a neutral opening structured to receive a neutral prong of an electrical plug; and
  - a spring coupled at a first end to the spring mount of the shutter and coupled at a second end disposed opposite the first end to the spring coupling formation of the individual outlet cover,
- wherein the fulcrum of the shutter is disposed upon the front side of the base clip main body such that, when no electrical plug is inserted into the protection arrangement, the first blocking mechanism blocks a hot path between the hot slot of the individual outlet cover and the hot opening of the base clip and the second blocking mechanism blocks a neutral path between the neutral slot of the individual outlet cover and the neutral opening of the base clip,
- wherein the shutter assembly is structured to only expose the hot path and the neutral path if an electrical plug is inserted into the individual outlet cover.

2. The protection arrangement of claim 1,
- wherein the shutter is structured to move closer toward the spring coupling formation of the individual outlet cover by compressing the spring when a front surface of the shutter is disposed no more than 3° offset from parallel to a plane containing the front surface of the individual outlet cover and at least one of the blocking mechanisms is being pushed from the front side.

3. The protection arrangement of claim 1,
- wherein the protection arrangement is structured to be electrically connected to a power source via a number of hot and neutral electrical terminals,
- wherein the shutter assembly is structured to be disposed between the individual outlet cover and the electrical terminals.

4. The protection arrangement of claim 1, wherein the shutter assembly is structured to be used with a NEMA 5-15R electrical receptacle.

5. The protection arrangement of claim 1,
- wherein the first blocking mechanism comprises three sloped surfaces,
- wherein the second blocking mechanism comprises three sloped surfaces.

6. The protection arrangement of claim 5,
- wherein the first blocking mechanism comprises a first sloped surface disposed orthogonally to a plane containing a front surface of the shutter,
- wherein the first blocking mechanism comprises a second sloped surface disposed between 31° and 32° relative to a plane containing the first sloped surface of the first blocking mechanism,
- wherein the first blocking mechanism comprises a third sloped surface disposed 55° relative to a plane containing the first sloped surface of the first blocking mechanism,
- wherein the second blocking mechanism comprises a first sloped surface disposed orthogonally to a plane containing a front surface of the shutter,
- wherein the second blocking mechanism comprises a second sloped surface disposed between 31° and 32° relative to a plane containing the first sloped surface of the second blocking mechanism,
- wherein the second blocking mechanism comprises a third sloped surface disposed 55° relative to a plane containing the first sloped surface of the second blocking mechanism.

7. The protection arrangement of claim 1, wherein pushing an object against a front side of either the first blocking mechanism or the second blocking mechanism causes non-linear travel of the shutter relative to the base clip.

8. The protection arrangement of claim 1,
- wherein the rear side of the individual outlet cover to which the shutter assembly is coupled further comprises a plurality of divots,
- wherein the shutter comprises a plurality of shelves protruding from the front side of the shutter,
- wherein the shutter is structured to rotate about the fulcrum and insert a first number of the plurality of shelves into a corresponding first number of the plurality of divots when an object is pushed against only the first blocking mechanism, wherein inserting the first number of the plurality of shelves into the corresponding first number of the plurality of divots blocks the hot path and the neutral path.

9. The protection arrangement of claim 1, wherein the rear side of the individual outlet cover to which the shutter assembly is coupled further comprises a plurality of divots, wherein the shutter comprises a plurality of shelves protruding from the front side of the shutter, wherein the shutter is structured to rotate about the fulcrum and insert a number of the plurality of shelves into a corresponding number of the plurality of divots when an object is pushed against only the second blocking mechanism, wherein inserting the number of the plurality of shelves into the corresponding number of the plurality of divots blocks the hot path and the neutral path.

10. The protection arrangement of claim 8, wherein the shutter is structured to rotate about the fulcrum and insert a second number of the plurality of shelves into a corresponding second number of the plurality of divots when an object is pushed against only the second blocking mechanism, wherein inserting the second number of the plurality of shelves into the corresponding second number of the plurality of divots blocks the hot path and the neutral path.

11. A tamper-resistant electrical receptacle, the electrical receptacle comprising:

a hot electrical terminal structured to be connected to a utility power supply;

a neutral electrical terminal structured to be connected to a utility power supply;

a grounding strap structured to divert current exceeding a predetermined threshold from flowing out of the electrical receptacle; and a tamper-resistant protection arrangement, the protection arrangement comprising:

a front cover;

at least one number of individual outlet cover coupled to the front cover, each of the individual outlet covers including a front side and a rear side disposed opposite the front side, the at least one of the individual outlet covers comprising:

a spring coupling formation formed on the rear side;

a hot slot comprising an opening structured to receive a hot prong of an electrical plug; and a neutral slot comprising an opening structured to receive a neutral prong of an electrical plug; and a shutter assembly coupled to the rear side of the at least one of the individual outlet covers, the shutter assembly comprising:

a shutter including a front side and a rear side disposed opposite the front side, the shutter comprising:

a spring mount formed at one end of the shutter;

a first blocking mechanism formed with a plurality of sloped surfaces;

a second blocking mechanism formed with a plurality of sloped surfaces; and a fulcrum formed on the rear side of the shutter;

a base clip including a front side and a rear side disposed opposite the front side, the base clip comprising:

a main body including a hot opening structured to receive a hot prong of an electrical plug and a neutral opening structured to receive a neutral prong of an electrical plug; and a spring coupled at a first end to the spring mount of the shutter and coupled at a second end disposed opposite the first end to the spring coupling formation of the individual outlet cover, wherein the shutter assembly is disposed between the individual outlet cover and the hot terminal and the neutral terminal, wherein the hot opening of the base clip provides access to the hot terminal and the neutral opening of the base clip provides access to the neutral terminal, wherein the fulcrum of the shutter is disposed upon the front side of the base clip main body such that, when no electrical plug is inserted into the protection arrangement, the first blocking mechanism blocks a hot path between the hot slot of the individual outlet cover and the hot opening of the base clip and the second blocking mechanism blocks a neutral path between the neutral slot of the individual outlet cover and the neutral opening of the base clip, wherein the shutter assembly is structured to only expose the hot path and the neutral path if an electrical plug is inserted into the individual outlet cover.

12. The electrical receptacle of claim 11, wherein the shutter is structured to move closer toward the spring coupling formation of the individual outlet cover by compressing the spring when a front surface of the shutter is disposed no more than 3° offset from parallel to a plane containing the front surface of the individual outlet cover and at least one of the blocking mechanisms is being pushed from the front side.

13. The electrical receptacle of claim 11, wherein the electrical receptacle is a NEMA 5-15R electrical receptacle.

14. The electrical receptacle of claim 11, wherein the first blocking mechanism comprises three sloped surfaces, wherein the second blocking mechanism comprises three sloped surfaces.

15. The electrical receptacle of claim 14, wherein the first blocking mechanism comprises a first sloped surface disposed orthogonally to a plane containing a front surface of the shutter, wherein the first blocking mechanism comprises a second sloped surface disposed between 31° and 32° relative to a plane containing the first sloped surface of the first blocking mechanism, wherein the first blocking mechanism comprises a third sloped surface disposed 55° relative to a plane containing the first sloped surface of the first blocking mechanism, wherein the second blocking mechanism comprises a first sloped surface disposed orthogonally to a plane containing a front surface of the shutter, wherein the second blocking mechanism comprises a second sloped surface disposed between 31° and 32° relative to a plane containing the first sloped surface of the second blocking mechanism, wherein the second blocking mechanism comprises a third sloped surface disposed 55° relative to a plane containing the first sloped surface of the second blocking mechanism.

16. The electrical receptacle of claim 11, wherein pushing an object against a front side of either the first blocking mechanism or the second blocking mechanism causes nonlinear travel of the shutter relative to the base clip.

17. The electrical receptacle of claim 11, wherein the rear side of the individual outlet cover to which the shutter assembly is coupled further comprises a plurality of divots, wherein the shutter comprises a plurality of shelves protruding from the front side of the shutter, wherein the shutter is structured to rotate about the fulcrum and insert a first number of the plurality of shelves into a corresponding first number of the plurality of divots when an object is pushed against only the first blocking mechanism, wherein inserting the first number of the plurality of shelves into the corresponding first number of the plurality of divots blocks the hot path and the neutral path.

18. The electrical receptacle of claim 11, wherein the rear side of the individual outlet cover to which the shutter assembly is coupled further comprises a plurality of divots, wherein the shutter comprises a plurality of shelves protruding from the front side of the shutter, wherein the shutter is structured to rotate about the fulcrum and insert a number of the plurality of shelves into a corresponding number of the plurality of divots when an object is pushed against only the second blocking mechanism, wherein inserting the number of the plurality of shelves into the corresponding number of the plurality of divots blocks the hot path and the neutral path.

19. The electrical receptacle of claim 17, wherein the shutter is structured to rotate about the fulcrum and insert a second number of the plurality of shelves into a corresponding second number of the plurality of divots when an object is pushed against only the second blocking mechanism, wherein inserting the second number of the plurality of shelves into the corresponding second number of the plurality of divots blocks the hot path and the neutral path.

* * * * *